US010716970B2

(12) United States Patent
Madson et al.

(10) Patent No.: US 10,716,970 B2
(45) **Date of Patent: *Jul. 21, 2020**

(54) GOLF BALLS WITH AERODYNAMIC SUBSURFACES

(71) Applicant: Acushnet Company, Fairhaven, MA (US)

(72) Inventors: Michael R. Madson, Easton, MA (US); Emilia DaCosta, New Bedford, MA (US); Nicholas M. Nardacci, Barrington, RI (US); Chris Hixenbaugh, Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/214,109

(22) Filed: Dec. 9, 2018

(65) Prior Publication Data

US 2019/0184236 A1 Jun. 20, 2019

Related U.S. Application Data

(63) Continuation-in-part of application No. 16/214,103, filed on Dec. 9, 2018, which is a continuation-in-part of application No. 15/829,075, filed on Dec. 1, 2017, now Pat. No. 10,369,417, which is a continuation-in-part of application No. 15/828,985, filed on Dec. 1, 2017, now Pat. No. 10,363,457.

(51) Int. Cl.

| | |
|---|---|
| ***A63B 37/00*** | (2006.01) |
| ***A63B 37/14*** | (2006.01) |
| ***A63B 1/00*** | (2006.01) |
| *A63B 102/32* | (2015.01) |

(52) U.S. Cl.

CPC ..... *A63B 37/0013* (2013.01); *A63B 1/00* (2013.01); *A63B 37/0006* (2013.01); *A63B 37/0007* (2013.01); *A63B 37/0022* (2013.01); *A63B 37/002* (2013.01); *A63B 37/0033* (2013.01); *A63B 2102/32* (2015.10)

(58) Field of Classification Search

CPC ..... A63B 37/0013; A63B 37/0006

See application file for complete search history.

(56) References Cited

U.S. PATENT DOCUMENTS

| | | | | |
|---|---|---|---|---|
| 7,018,310 | B2 | 3/2006 | Katsunori et al. | |
| 7,416,497 | B2 | 8/2008 | Simonds et al. | |
| 8,033,933 | B2 | 10/2011 | Sullivan et al. | |
| 8,137,216 | B2 | 3/2012 | Sullivan et al. | |
| 2005/0009643 | A1* | 1/2005 | Sato | A63B 37/0004 473/378 |

(Continued)

*Primary Examiner* — John E Simms, Jr.

(74) *Attorney, Agent, or Firm* — Kristin D. Wheeler

(57) ABSTRACT

The present invention provides a golf ball having an aerodynamic subsurface for packing dimples. More particularly, the invention relates to a golf ball having an exterior surface and at least a first subsurface containing at least two dimples located solely on the subsurface and lying below the exterior surface of the golf ball. A transition zone between the exterior surface and the subsurface is disclosed having an angle of transition and a top radius and a bottom radius. According to the present invention, the exterior surface and at least the first subsurface have at least a first and second surface colors that are different.

13 Claims, 47 Drawing Sheets

(56) References Cited

U.S. PATENT DOCUMENTS

| | | | | |
|---|---|---|---|---|
| 2012/0183691 | A1* | 7/2012 | Kuntimaddi | A63B 37/0004 427/259 |
| 2012/0301617 | A1* | 11/2012 | Fitchett | A63B 37/0022 427/277 |
| 2012/0329577 | A1* | 12/2012 | Anderl | A63B 37/0022 473/378 |
| 2016/0158605 | A1* | 6/2016 | Morgan | A63B 43/008 473/378 |
| 2016/0184647 | A1* | 6/2016 | Sajima | A63B 37/0019 473/374 |
| 2019/0168075 | A1* | 6/2019 | Nardacci | A63B 37/0006 |
| 2019/0168076 | A1* | 6/2019 | Nardacci | A63B 37/0013 |
| 2019/0168077 | A1* | 6/2019 | Nardacci | A63B 37/0013 |

* cited by examiner

GOLF BALLS WITH AERODYNAMIC SUBSURFACES

CROSS-REFERENCE TO RELATED APPLICATIONS

This application is a continuation-in-part of co-pending U.S. patent application Ser. No. 16/214,103, filed Dec. 9, 2018, which is a continuation-in-part of co-pending U.S. patent application Ser. No. 15/829,075, filed Dec. 1, 2017, which is a continuation-in-part of co-pending U.S. patent application Ser. No. 15/828,985, filed Dec. 1, 2017, the entire disclosure of which is hereby incorporated by reference.

FIELD OF THE INVENTION

This invention relates to golf balls, particularly to golf balls having an aerodynamic subsurface for packing dimples. More particularly, the invention relates to a golf ball having one or more subsurface levels on a golf ball used for distributing dimples creating a golf ball with additional dimple surfaces that lie below an exterior surface of the golf ball.

BACKGROUND OF THE INVENTION

Historically, dimple patterns for golf balls have had a variety of geometric shapes, patterns, and configurations. Primarily, patterns are laid out in order to provide desired performance characteristics based on the particular ball construction, material attributes, and player characteristics influencing the ball's initial launch angle and spin conditions. Therefore, pattern development is a secondary design step that is used to achieve the appropriate aerodynamic behavior, thereby tailoring ball flight characteristics and performance.

Aerodynamic forces generated by a ball in flight are a result of its velocity and spin. These forces can be represented by a lift force and a drag force. Lift force is perpendicular to the direction of flight and is a result of air velocity differences above and below the rotating ball. This phenomenon is attributed to Magnus, who described it in 1853 after studying the aerodynamic forces on spinning spheres and cylinders, and is described by Bernoulli's Equation, a simplification of the first law of thermodynamics. Bernoulli's equation relates pressure and velocity where pressure is inversely proportional to the square of velocity. The velocity differential, due to faster moving air on top and slower moving air on the bottom, results in lower air pressure on top and an upward directed force on the ball.

Drag is opposite in sense to the direction of flight and orthogonal to lift. The drag force on a ball is attributed to parasitic drag forces, which consist of pressure drag and viscous or skin friction drag. A sphere is a bluff body, which is an inefficient aerodynamic shape. As a result, the accelerating flow field around the ball causes a large pressure differential with high-pressure forward and low-pressure behind the ball. The low pressure area behind the ball is also known as the wake. In order to minimize pressure drag, dimples provide a means to energize the flow field and delay the separation of flow, or reduce the wake region behind the ball. Skin friction is a viscous effect residing close to the surface of the ball within the boundary layer.

The industry has seen many efforts to maximize the aerodynamic efficiency of golf balls, through dimple disturbance and other methods, though they are closely controlled by golf's national governing body, the United States Golf Association (U.S.G.A.). One U.S.G.A. requirement is that golf balls have aerodynamic symmetry. Aerodynamic symmetry allows the ball to fly with a very small amount of variation no matter how the golf ball is placed on the tee or ground. Preferably, dimples cover the maximum surface area of the golf ball without detrimentally affecting the aerodynamic symmetry of the golf ball.

In attempts to improve aerodynamic symmetry, many dimple patterns are based on geometric shapes. These may include circles, hexagons, triangles, and the like. Other dimple patterns are based in general on the five Platonic Solids including icosahedron, dodecahedron, octahedron, cube, or tetrahedron. Yet other dimple patterns are based on the thirteen Archimedian Solids, such as the small icosidodecahedron, rhomicosidodecahedron, small rhombicuboctahedron, snub cube, snub dodecahedron, or truncated icosahedron. Furthermore, other dimple patterns are based on hexagonal dipyramids. Because the number of symmetric solid plane systems is limited, it is difficult to devise new symmetric patterns. Moreover, dimple patterns based some of these geometric shapes result in less than optimal surface coverage and other disadvantageous dimple arrangements. Therefore, dimple properties such as number, shape, size, volume, and arrangement are often manipulated in an attempt to generate a golf ball that has improved aerodynamic properties.

U.S. Pat. No. 7,416,497 to Simonds et al. discloses a golf ball that minimizes land area by use of a lattice structure in conjunction with a sub-lattice structure within the dimple that is a feature of the dimple.

U.S. Pat. Nos. 8,033,933 and 8,137,216 to Sullivan et al. disclose a golf ball with channels or ridges on its surface. The channels do not contain any dimples and the ridges are not spherical.

SUMMARY OF THE INVENTION

In one aspect of the present invention a golf ball is provided comprising a core, a cover surrounding the core, an exterior surface provided on the cover having an exterior radius $R_0$, at least a first subsurface having a first perimeter and a subsurface radius $R_1$ and at least two subsurface dimples located solely within the first subsurface; where the first subsurface is offset from the exterior surface by a value $\delta_1$ such that $R_1=R_0-\delta_1$ and $\delta_1$ is between about 0.003 and about 0.020 and where the exterior surface has a first surface color and the first subsurface has a second surface color different than the first surface color.

In one aspect of the present invention a golf ball is provided comprising a core, a cover surrounding the core, an exterior surface provided on the cover having an exterior radius $R_0$, at least a first subsurface having a first perimeter and a subsurface radius $R_1$ and at least two subsurface dimples located solely within the first subsurface, where the first subsurface is offset from the exterior surface by a value $\delta_1$ such that $R_1=R_0-\delta_1$ and $\delta_1$ is between about 0.003 and about 0.020 and where the exterior surface has a first surface texture and the first subsurface has a second surface texture different than the first surface texture.

In one aspect of the present invention a golf ball is provided comprising a core, a cover surrounding the core, an exterior surface provided on the cover having an exterior radius $R_0$, at least a first subsurface having a first perimeter and a subsurface radius $R_1$ and at least two dimples located solely within the first subsurface; and a transition zone between the exterior surface and the first subsurface, the transition zone having an angle of transition and a top radius and a bottom radius, where the first subsurface is offset from the exterior surface by a value $\delta_1$ such that $R_1=R_0-\delta_1$ and $\delta_1$ is between about 0.003 and about 0.020.

In another aspect of the present invention, the angle of transition is between about 10° to about 90°, and preferably the angle of transition is between 30° to 60°. The top radius may be about 0.001 to about 0.010. The bottom radius may be about 0.001 to about 0.016. The transition zone has a transition wall that may be straight or curved. In another embodiment, the top radius is different than the bottom radius.

In a further aspect of the present invention, the first perimeter is non-circular. The first perimeter may have a non-constant radius of curvature. The radius of curvature along any point of the first perimeter may not exceed 0.2 inches. The first perimeter may have at least one inflection point. The $\delta_1$ may be between about 0.009 and about 0.015.

In another aspect of the invention, at least three dimples provided on the first subsurface adjacent the first perimeter have a dimple perimeter and at least 20 percent of the dimple perimeter is within about 0.010 inches of the first perimeter. The exterior surface may have a dimple arrangement sub-pattern having faces and vertices, and the first subsurface may be centered at the vertices of the sub-pattern. The exterior surface may have a dimple arrangement sub-pattern having faces and vertices and the first subsurface may be centered on the faces of the sub-pattern. The exterior surface may have a dimple arrangement sub-pattern having faces and vertices and the first subsurface may be centered on the faces of the sub-pattern. The dimples may have non-circular plan shapes. The golf ball may further have at least one dimple on the exterior surface. The first perimeter may be independent of the dimples on the exterior surface. The exterior surface may be spherical and may have a nearly equal radius at all points along the exterior surface. The exterior surface may have a dimple coverage of about 70% to about 90% and any subsurfaces may have dimple coverages of about 50% to about 90%.

In one embodiment, the present invention is directed to a golf ball having an exterior surface and one or more subsurfaces, each exterior surface and subsurface having one or more dimples, the subsurface levels lying below the exterior surface of the golf ball. In one embodiment a golf ball is provided having a core, a cover surrounding the core, an exterior surface provided on the cover having an exterior radius $R_0$, at least a first subsurface having a first perimeter and a subsurface radius $R_1$ and at least two dimples located solely within the first subsurface. The first subsurface is offset from the exterior surface by a value $\delta_1$ such that $R_1=R_0-\delta_1$ and $\delta_1$ is between about 0.009 and about 0.020 inches.

Preferably, the first perimeter is non-circular. The first perimeter may have a non-constant radius of curvature. The radius of curvature along any point of the first perimeter may not exceed 0.2 inches. Additionally, the first perimeter may have at least one inflection point. More preferably, $\delta_1$ may be between about 0.010 and about 0.015 inches. Additionally, at least three dimples may be provided on the first subsurface adjacent the first perimeter have a dimple perimeter and at least 20 percent of the dimple perimeter is within about 0.010 inches of the first perimeter.

The exterior surface may have a dimple arrangement sub-pattern having faces and vertices, and the first subsurface may be centered at the vertices of the sub-pattern. The exterior surface may have a dimple arrangement sub-pattern having faces and vertices and the first subsurface may be centered on the faces of the sub-pattern. Additionally, the golf ball may be provided with at least one dimple on the exterior surface. Preferably, the first perimeter may be independent of the dimples on the exterior surface. Moreover, at least two of the dimples may have non-circular plan shapes. The first subsurface may be spherical and concentric to the exterior surface.

Additionally, the golf ball may be provided with a second subsurface having a second perimeter and a subsurface radius $R_2$ and at least two dimples located solely within the second subsurface, where the second subsurface is offset from the exterior surface by a value $\delta_2$, such that $R_2=R_0-\delta_2=R_1-(\delta_2-\delta_1)$. The exterior surface may also include at least two noncontiguous sections. In another embodiment, all the dimples may be provided on any subsurfaces.

Preferably, the core may not pass through the cover providing for a cover thickness t:

$$t > \sum_{i=1}^{n} \delta_i + \max(CD_n)$$

where the number of subsurfaces is equal to n, t is the thickness of the cover, δ is the offset of the subsurface from the exterior surface, and $\max(CD_n)$ is the maximum chord depth from a set of dimples on the $n^{th}$ subsurface.

The exterior surface may be spherical and may have a nearly equal radius at all points along the exterior surface. The exterior surface may have a dimple coverage of about 70% to about 90% and any subsurfaces may have dimple coverages of about 50% to about 90%.

In another embodiment, a golf ball is provided having a core, a cover surrounding the core, an exterior surface provided on the cover having an exterior radius $R_0$, at least a first subsurface having a non-circular first perimeter and a subsurface radius $R_1$ and at least two dimples located solely within the first subsurface. The first subsurface is offset from the exterior surface by a value $\delta_1$ such that $R_1=R_0-\delta_1$ and $\delta_1$ is between about 0.003 and about 0.015 inches.

Preferably, the first perimeter has a non-constant radius of curvature. The radius of curvature along any point of the first perimeter may not exceed 0.2 inches. The first perimeter may have at least one inflection point. Preferably, at least three dimples are provided on the first subsurface adjacent the first perimeter and have a dimple perimeter and at least 20 percent of the dimple perimeter is within about 0.010 inches of the first perimeter.

The exterior surface may have a dimple arrangement sub-pattern having faces and vertices, and the first subsurface may be centered at the vertices of the sub-pattern. The exterior surface may have a dimple arrangement sub-pattern having faces and vertices and the first subsurface may be centered on the faces of the sub-pattern. The dimples may have non-circular plan shapes. At least one dimple may be provided on the exterior surface. The first perimeter may be independent of the dimples on the exterior surface.

The core may not pass through the cover providing for a cover thickness t:

$$t > \sum_{i=1}^{n} \delta_i + \max(CD_n)$$

where the number of subsurfaces is equal to n, t is the thickness of the cover, δ is the offset of the subsurface from the exterior surface, and max($CD_n$) is the maximum chord depth from a set of dimples on the $n^{th}$ subsurface.

The exterior surface may be spherical and may have a nearly equal radius at all points along the exterior surface. The exterior surface may have a dimple coverage of about 70% to about 90% and any subsurfaces have dimple coverages of about 50% to about 90%.

In yet another embodiment, a method of arranging dimples on a golf ball is provided comprising the steps of providing a spherical section of a golf ball having an exterior surface with an exterior radius $R_0$, providing at least a first subsurface on the spherical section having a first perimeter and a subsurface radius $R_1$, the first subsurface being offset from the exterior surface by a value $\delta_1$ such that $R_1=R_0-\delta_1$, where $\delta_1$ is between about 0.009 and about 0.020, arranging at least two dimples located solely within the subsurface; and locating multiple spherical sections on the golf ball to form a dimple arrangement.

The method may further comprise the step of providing a non-circular first perimeter. The method may further comprise the step of providing the first perimeter with a non-constant radius of curvature. The method may further comprise the step of providing the radius of curvature such that along any point of the first perimeter the radius of curvature does not exceed 0.2 inches. The method may further comprise the step of providing the first perimeter with at least one inflection point. Preferably, $\delta_1$ is between about 0.010 and about 0.015 inches. The method may further comprise the step of providing at least three dimples on the first subsurface adjacent the first perimeter with a dimple perimeter and at least 20 percent of the dimple perimeter is within about 0.010 inches of the first perimeter. The method may further comprise the step of providing the exterior surface with a dimple arrangement sub-pattern having faces and vertices, and locating the first subsurface centered at the vertices of the sub-pattern. The method may further comprise the step of providing the exterior surface with a dimple arrangement sub-pattern having faces and vertices and locating the first subsurface centered on the faces of the sub-pattern. The method may further comprise the step of providing a second subsurface having a second perimeter and a subsurface radius $R_2$ and at least two dimples located solely within the second subsurface, the second subsurface being offset from the exterior surface by a value $\delta_2$, such that $R_2=R_0-\delta_1-\delta_2=R_1-\delta_2$. The method may further comprise the step of providing at least one dimple on the exterior surface.

The method may further comprise the step of providing a core and a cover surrounding the core, wherein the core does not pass through the cover providing for a cover thickness t:

$$t > \sum_{i=1}^{n} \delta_i + \max(CD_n)$$

where the number of subsurfaces is equal to n, t is the thickness of the cover, δ is the offset of the subsurface from the exterior surface, and max($CD_n$) is the maximum chord depth from a set of dimples on the $n^{th}$ subsurface.

Preferably, the step of providing dimples results in the exterior surface has a dimple coverage of about 70% to about 90% and any subsurfaces have dimple coverages of about 50% to about 90%. Preferably, the step of providing a first subsurface with a first perimeter further comprises providing the first perimeter independent of the dimples on the exterior surface and the dimples on the subsurface have non-circular plan shapes.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

The present invention provides a golf ball having a core 46 and a cover 48 (see FIG. 3) having an outer surface with at least one subsurface having at least two dimples solely located on the subsurface and a method for arranging dimples on a golf ball surface in a pattern derived from the exterior surface and the at least one subsurface. The resulting golf ball has at least two surfaces, an exterior surface and at least a first subsurface, with the first subsurface containing at least two dimples solely located on the subsurface lying below the exterior surface of the golf ball.

Figure 1:
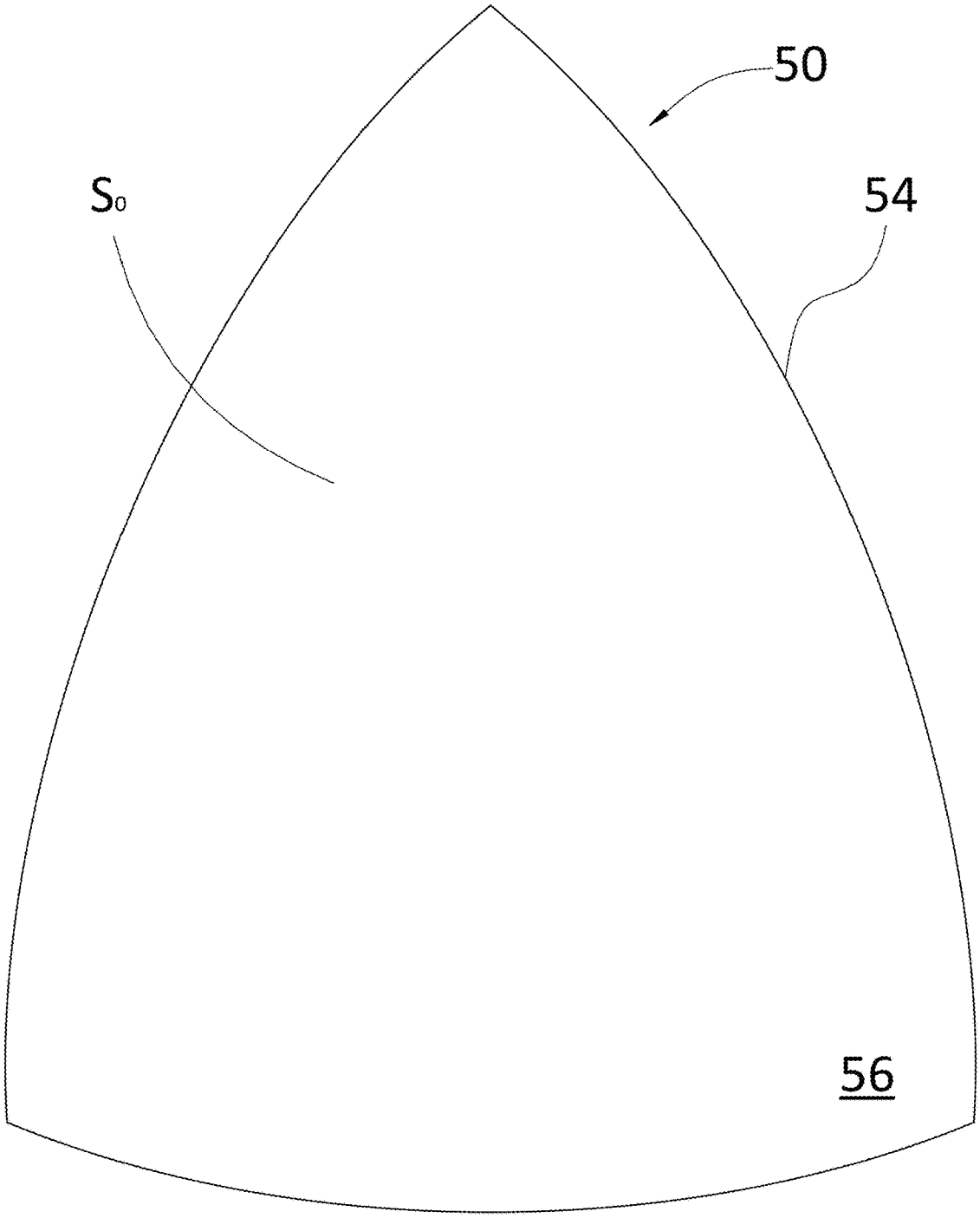
FIG. 1 illustrates a spherical section of a golf ball according to the present invention.
Figure 2:
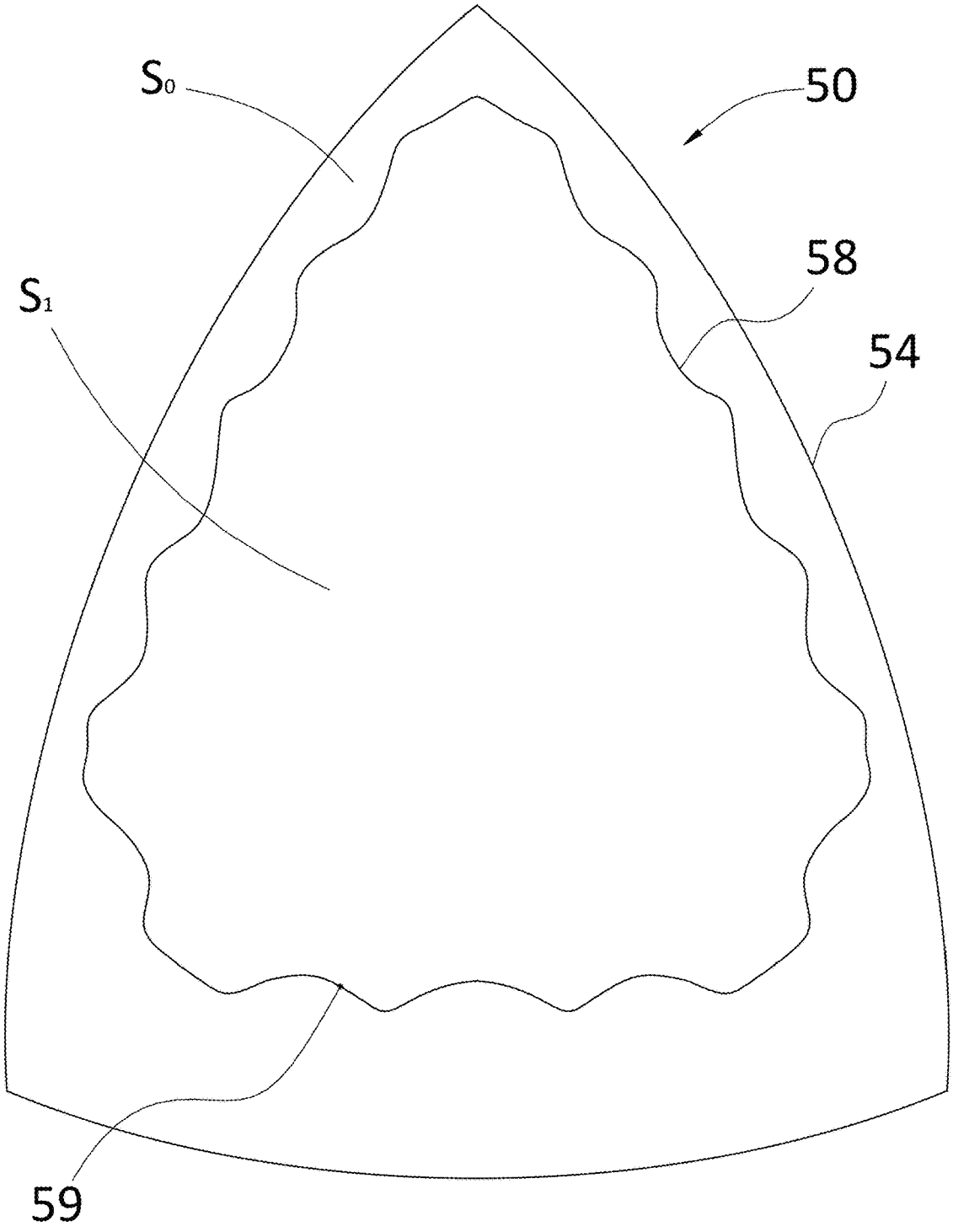
FIG. 2 illustrates an exterior surface and a first subsurface on the spherical section of the golf ball of FIG. 1.
Figure 3:
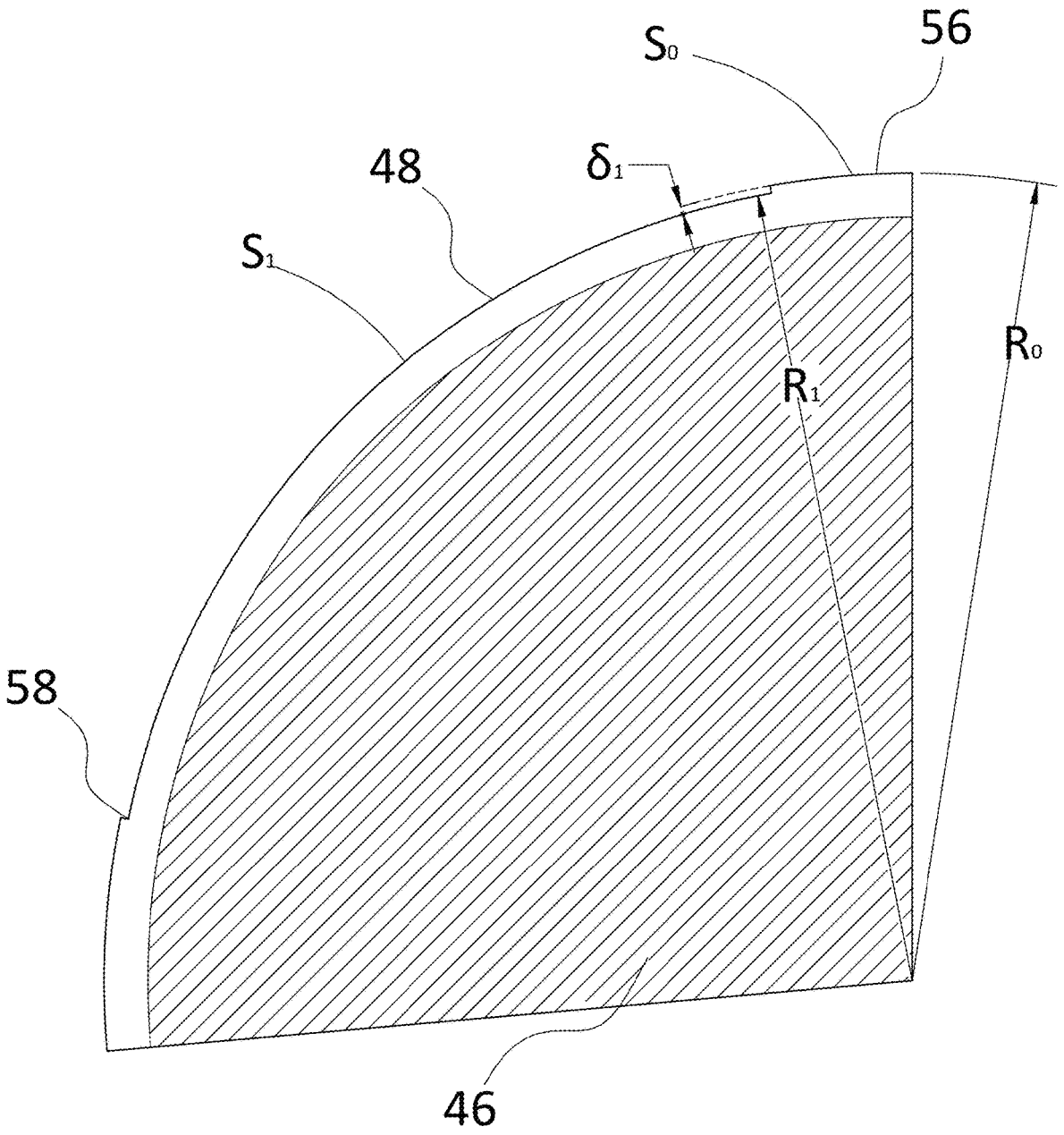
FIG. 3 shows a profile view of the exterior surface and first subsurface illustrated in FIG. 2.

Referring to FIG. 1, a spherical section 50 of a golf ball 52 having an edge 54 and an exterior surface $S_0$ is shown to create a pentagonal dipyramid dimple pattern. It will be appreciated that the exterior surface $S_0$ represents the outer surface 56 of the golf ball 52 (see FIG. 6). As shown in FIG. 2, a portion of the spherical section 50 is provided with a first subsurface $S_1$. The first subsurface $S_1$ has a first perimeter 58 defining the shape of the first subsurface $S_1$. It will be appreciated that the first subsurface $S_1$ may have any desired shape within the spherical section 50 including a regular or irregular shape and may be made of two or more noncontiguous portions or a portion that is provided along the edge 54 of the spherical section 50. Preferably, the first perimeter 58 is a non-circular perimeter. A non-circular perimeter may be defined as having a non-constant radius of curvature. Preferably, the radius of curvature along any point of the first perimeter 58 does not exceed 0.2 inches. It will also be appreciated that the first perimeter 58 may also have an inflection point 59. Moreover, it will be appreciated that the exterior surface $S_0$ may also be made of noncontiguous portions. FIG. 3 illustrates a profile view of the spherical section 50 showing the exterior surface $S_0$ and the first subsurface $S_1$. The exterior surface $S_0$ has a radius $R_0$. Preferably, radius $R_0$ is always greater than or equal to 0.84 inches to comply with the U.S.G.A. requirements. Preferably, the exterior surface $S_0$ has a nearly equal radius $R_0$ at all or nearly all points along the exterior surface $S_0$. The first subsurface $S_1$ has a radius $R_1$, such that the first subsurface $S_1$ is offset from the exterior surface $S_0$ by a first offset value $\delta_1$, such that $R_1=R_0-\delta_1$. The first offset value $\delta_1$ has a value of between about 0.002 and about 0.020 inches. Preferably, the first offset value $\delta_1$ has a value of between about 0.009 and about 0.020 inches, more preferably between about 0.010 and about 0.015 inches. In another embodiment, the first offset value $\delta_1$ has a value between about 0.003 and about 0.015 inches. As will be appreciated from FIG. 3, the first subsurface $S_1$ is spherical and concentric to the exterior surface $S_0$.

Figure 4:
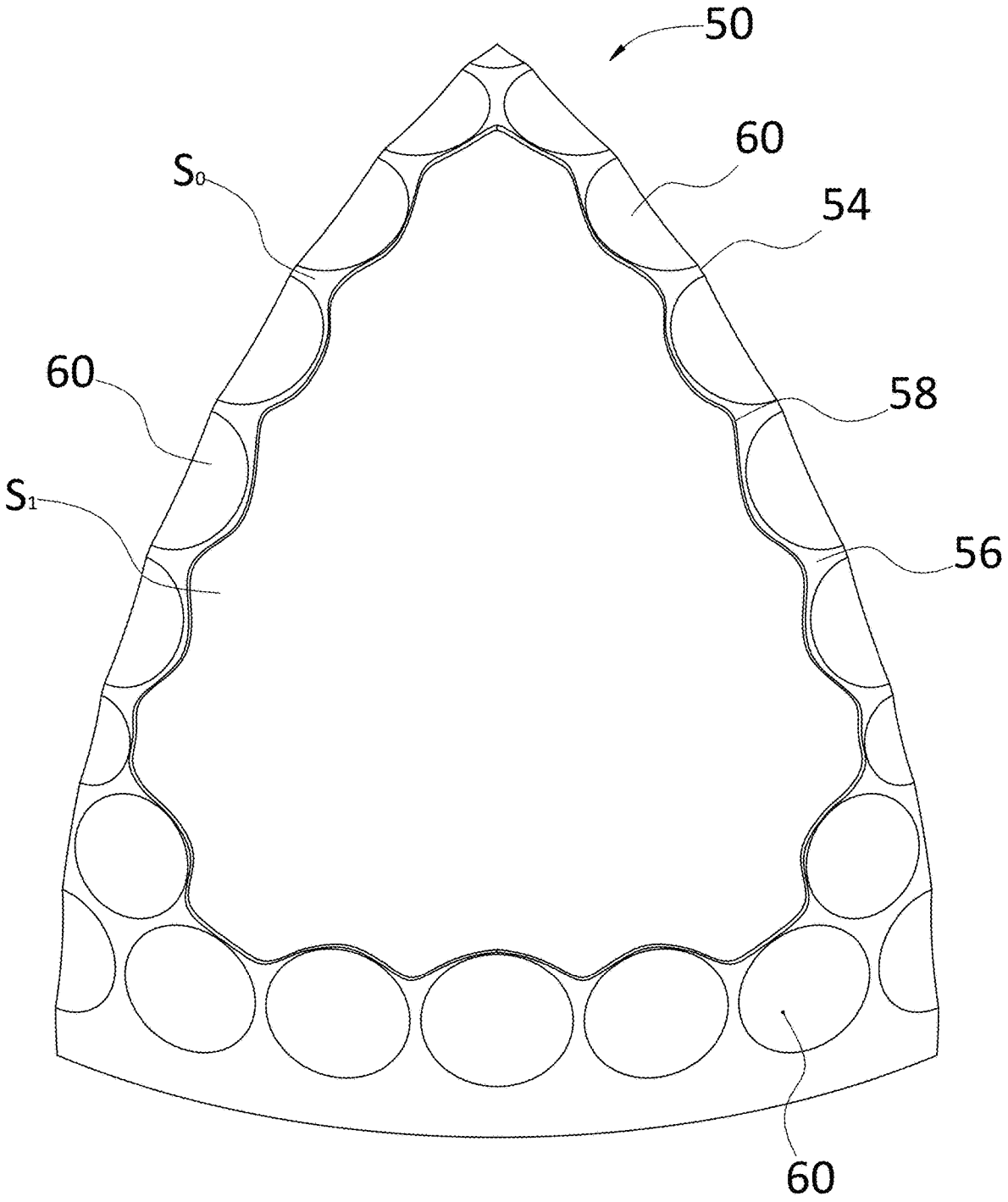
FIG. 4 illustrates dimples arranged on the exterior surface of the spherical section shown in FIGS. 1-3.
Figure 5:
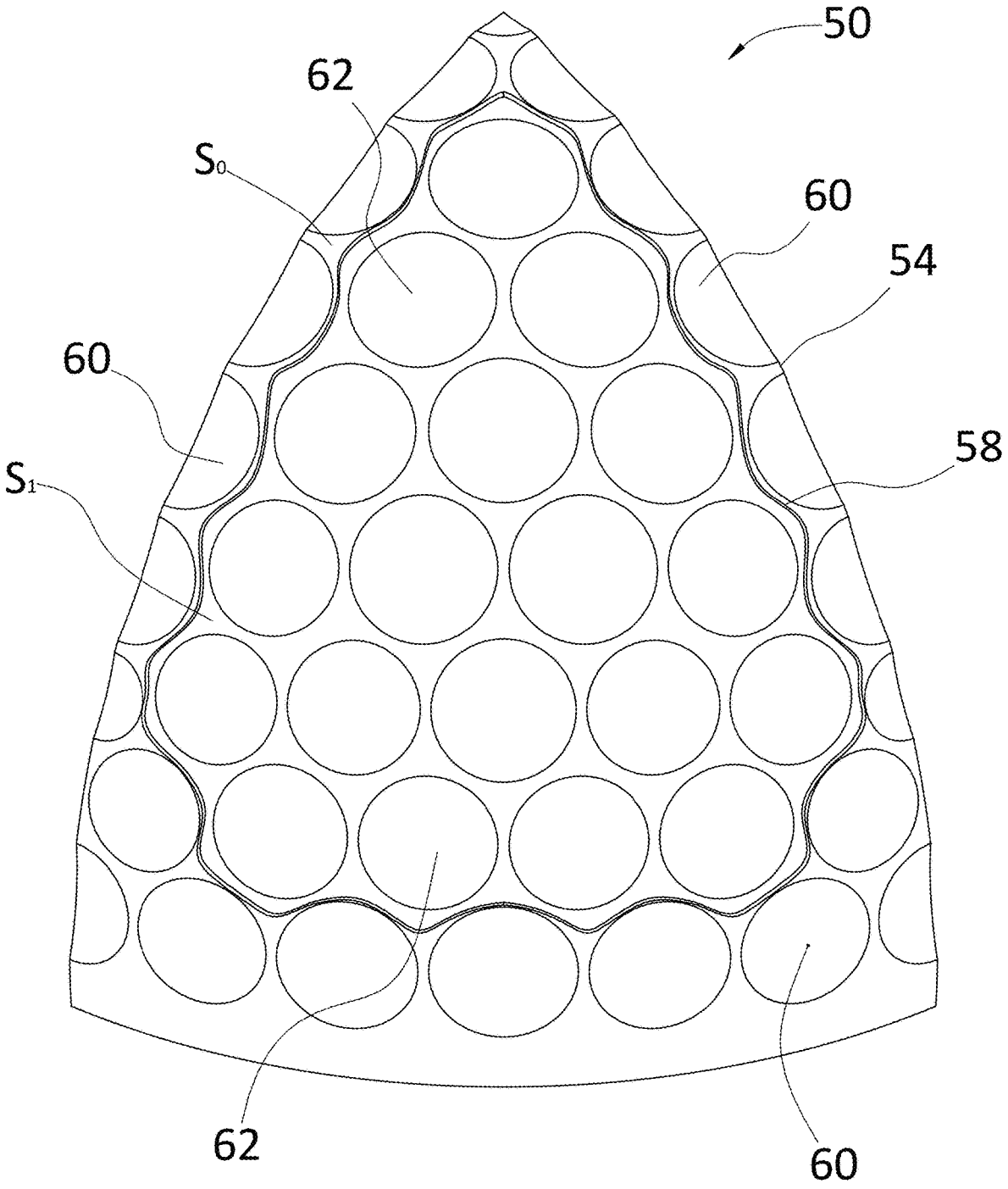
FIG. 5 illustrates additional dimples arranged on the first subsurface of the spherical section shown in FIGS. 1-4.
Figure 6:
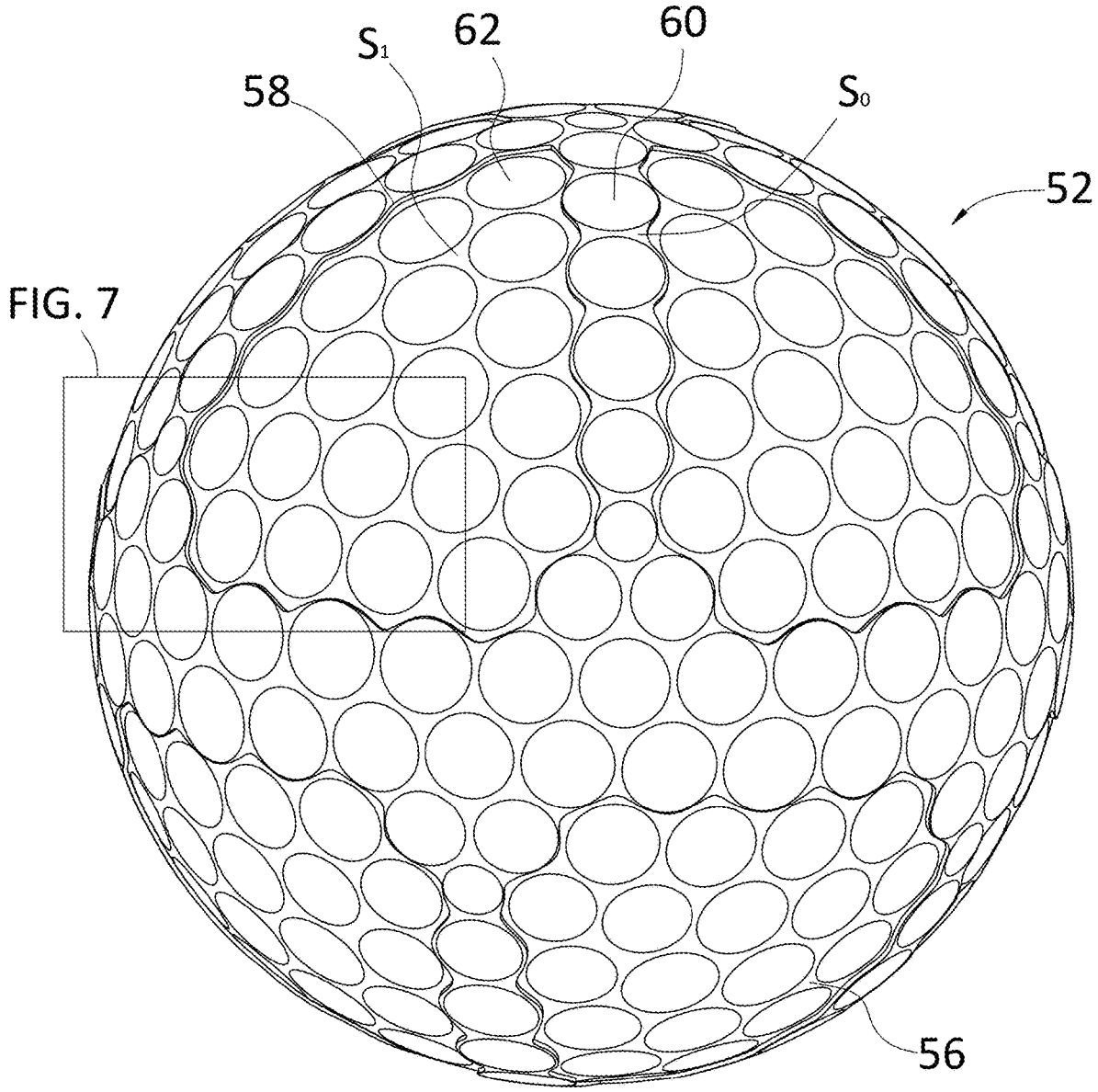
FIG. 6 illustrates a golf ball having spherical sections with dimples arranged on the exterior surface and the plurality of first subsurfaces as shown in FIGS. 1-5.
Figure 7:
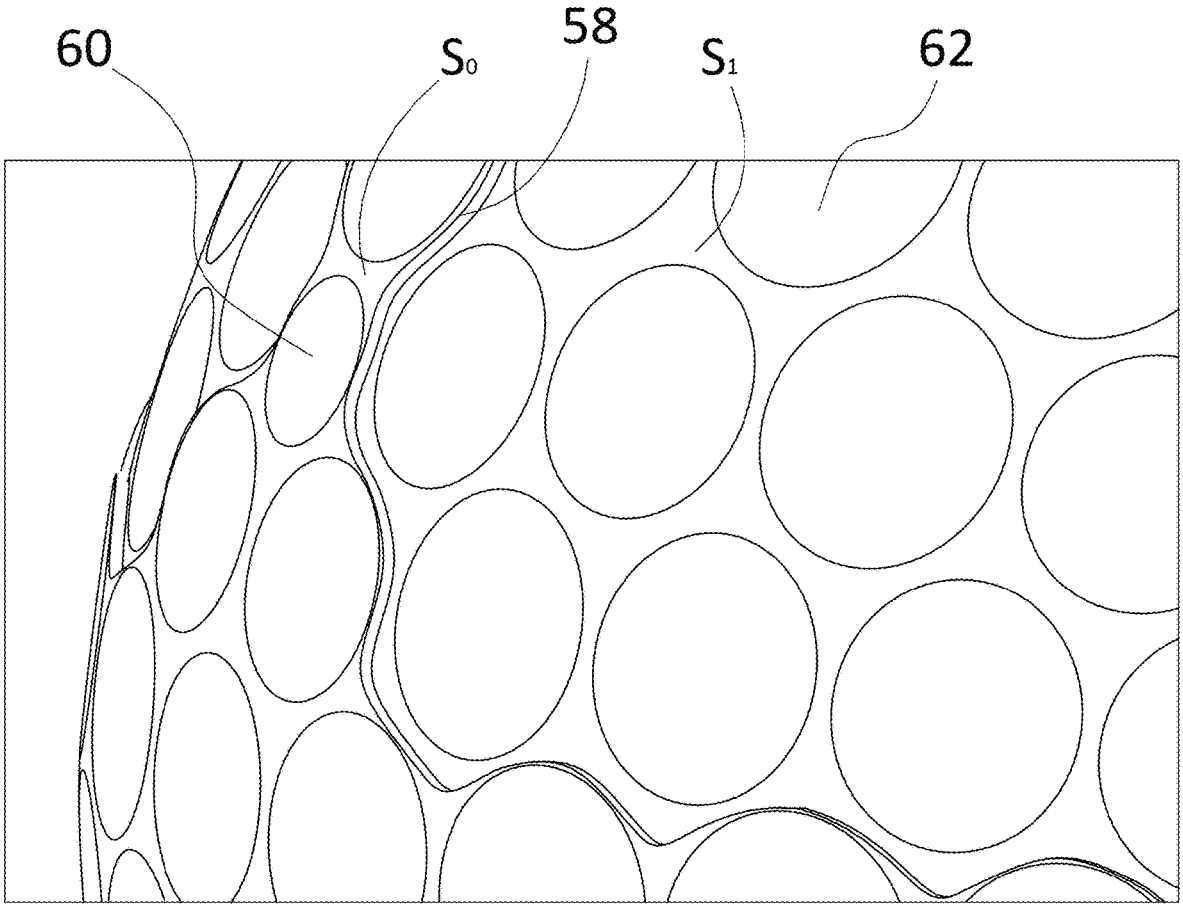
FIG. 7 illustrates a detailed view of the exterior surface and the first subsurface shown in FIG. 6.

Now referring to FIG. 4, preferably exterior surface dimples 60 have been packed on the exterior surface $S_0$. In this embodiment, the exterior surface dimples 60 are packed between the perimeter 58 of the first subsurface $S_1$ and the edge 54 of the spherical section 50 of the golf ball 52. As shown, the exterior surface dimples 60 may lie across the edge 54 of the spherical section 50. Turning now to FIG. 5, first subsurface dimples 62 have been packed on the first subsurface $S_1$. Preferably, at least two first subsurface dimples 62 are fit solely within the first subsurface $S_1$ perimeter 58. In this particular embodiment of the invention, nineteen first subsurface dimples 62 have been packed within the perimeter 58 of the first subsurface $S_1$, although it will be appreciated that any number of first subsurface dimples 62 may be packed within the space available. This embodiment results in two separate surfaces of the spherical section 50 that have dimples 60, 62. As illustrated in FIG. 6, this spherical section 50 is tiled on the outer surface 56 of the golf ball 52 to form a golf ball dimple pattern. FIG. 7 is a detailed view of one portion of the outer surface 56 of the golf ball 52 showing the exterior surface $S_0$ and the first subsurface $S_1$, each having dimples 60, 62.

Figure 8:
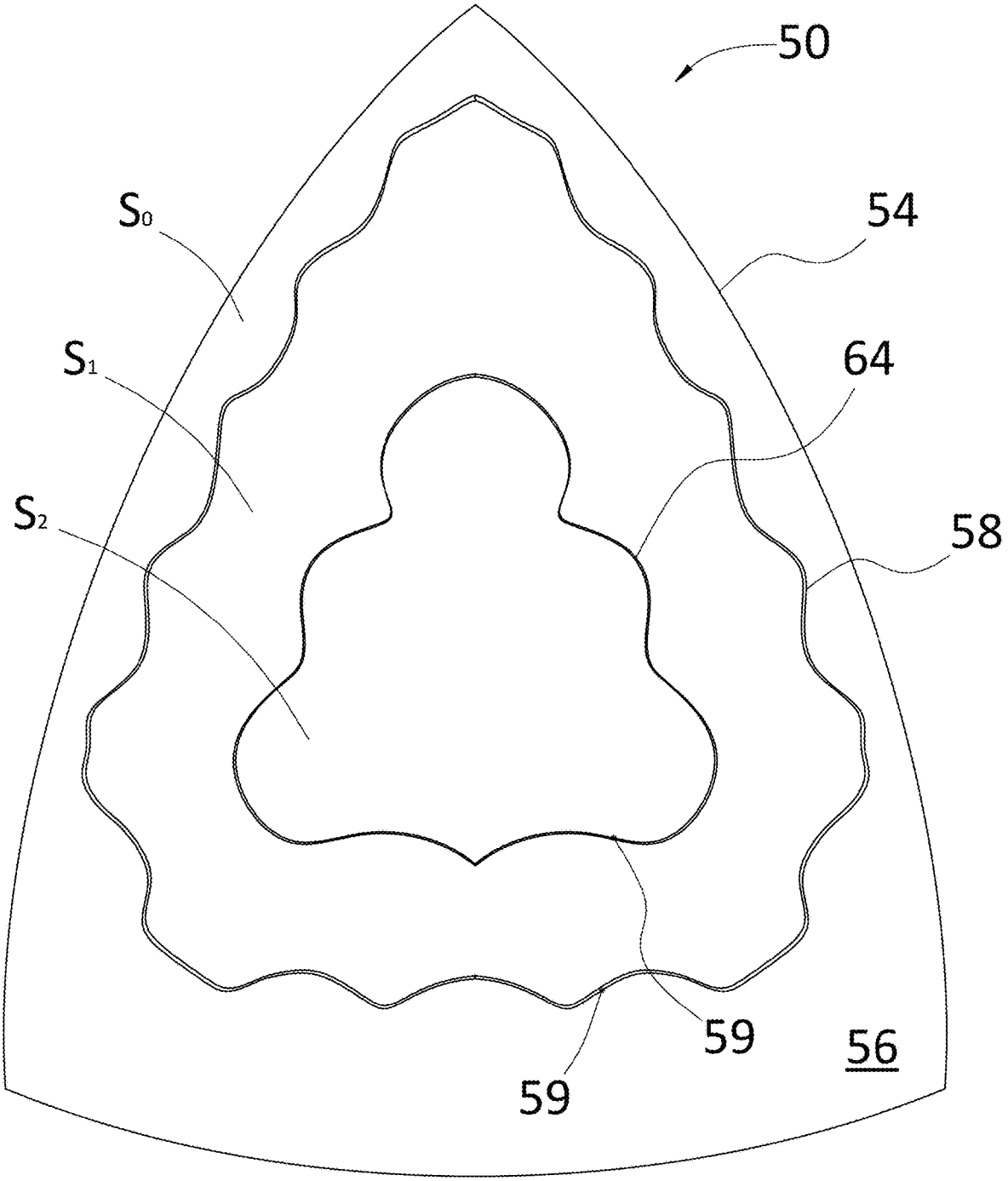
FIG. 8 illustrates another embodiment of a spherical section of a golf ball according to the present invention having an exterior surface and first and second subsurfaces on a spherical section of a golf ball.
Figure 9:
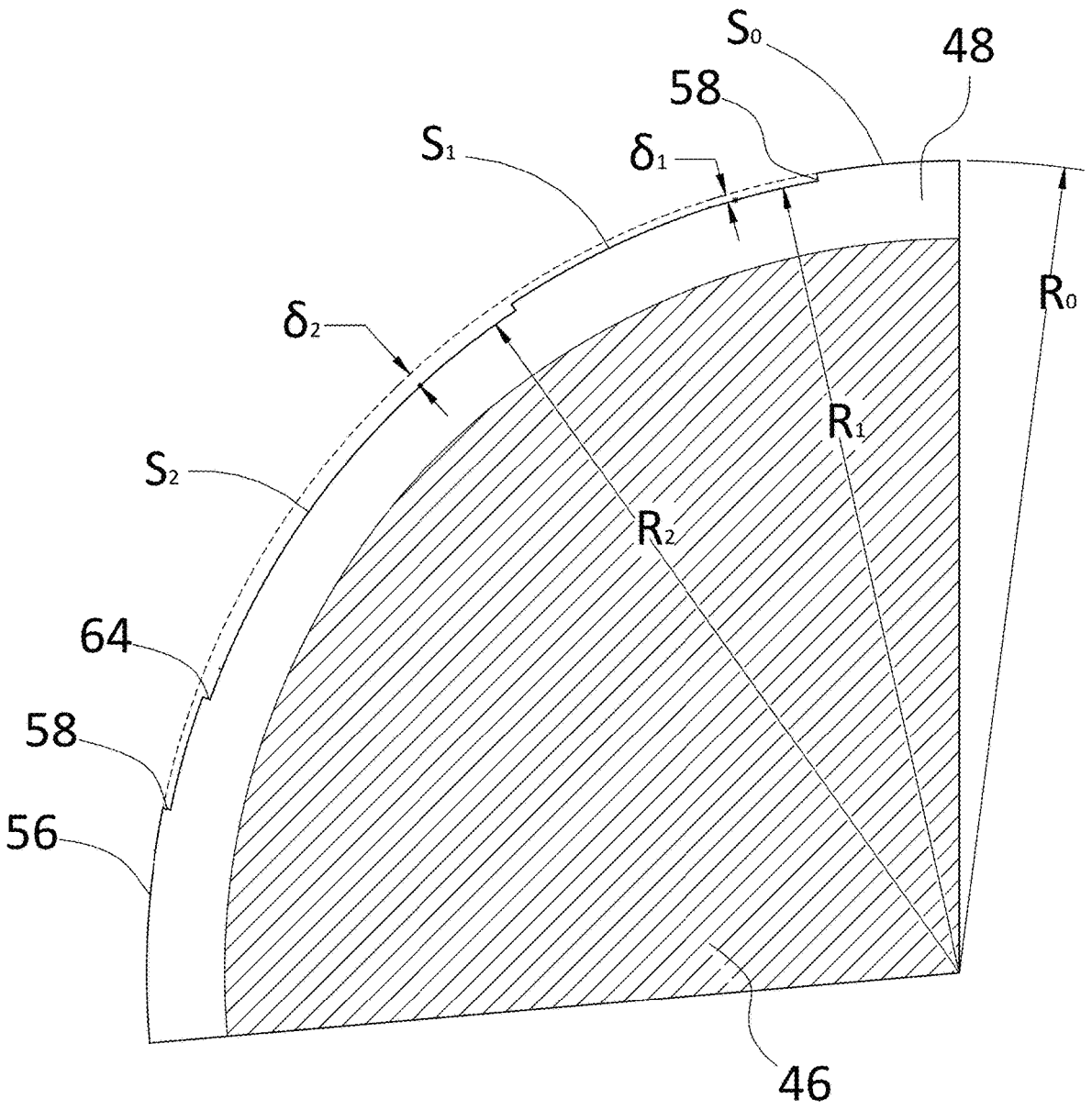
FIG. 9 shows a profile view of the exterior surface and first and second subsurfaces illustrated in FIG. 8.

In another embodiment illustrated in FIG. 8, the spherical section 50 of the golf ball 52 is shown with exterior surface $S_0$ having a first subsurface $S_1$ and a second subsurface $S_2$. As shown in FIG. 8, the second subsurface $S_2$ is provided fully within the first subsurface $S_1$. It will be appreciated that the second subsurface $S_2$ may be provided outside of the perimeter 58 of the first subsurface $S_1$. The first subsurface $S_1$ has perimeter 58 and the second subsurface $S_2$ has second perimeter 64. These are illustrated as being irregular shapes, although it will be appreciated that they could have any desired shape including regular shapes, such as regular polygons. As discussed above, the first perimeter 58 and the second perimeter 64 may preferably be non-circular perimeters. A non-circular perimeter may be defined as having a non-constant radius of curvature. Preferably, the radius of curvature along any point of the first perimeter 58 does not exceed 0.2 inches. It will also be appreciated that the first perimeter 58 may also have an inflection point. FIG. 9 illustrates a profile view of the spherical section 50 showing the exterior surface $S_0$, the first subsurface $S_1$ and the second subsurface $S_2$. The exterior surface $S_0$ has a radius $R_0$. The first subsurface $S_1$ has a radius $R_1$, such that the first subsurface $S_1$ is offset from the exterior surface $S_0$ by a first offset value $\delta_1$, such that $R_1=R_0-\delta_1$. The first offset value $\delta_1$ has a value of between about 0.002 and about 0.020 inches. Preferably, the first offset value $\delta_1$ has a value of between about 0.009 and about 0.020 inches, more preferably between about 0.010 and about 0.015 inches. In another embodiment, the first offset value $\delta_1$ has a value between about 0.003 and about 0.015 inches. As will be appreciated from FIG. 9, the first subsurface $S_1$ is spherical and concentric to the exterior surface $S_0$. The second subsurface $S_2$ is also spherical and concentric to the first subsurface $S_1$ and the exterior surface $S_0$. The second subsurface $S_2$ has a radius $R_2$, such that the second subsurface $S_2$ is offset from the exterior surface $S_0$ by a second offset value $\delta_2$, such that $R_2=R_0-\delta_2=R_1-(\delta_2-\delta_1)$. Preferably, the second offset value $\delta_2$ has a value of about 0.002 to about 0.030 inches.

Figure 10:
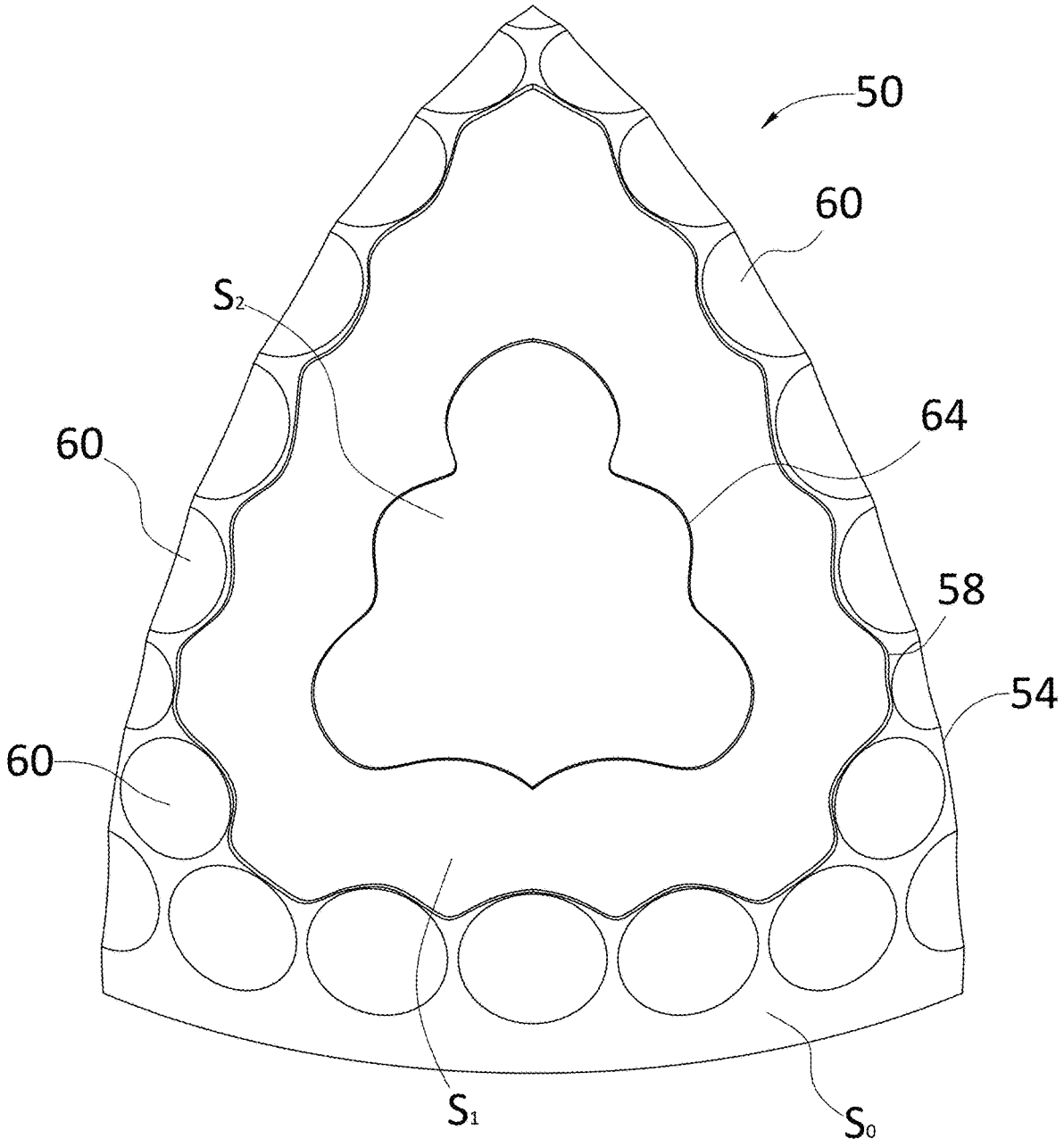
FIG. 10 illustrates dimples arranged on the exterior surface of the spherical section shown in FIGS. 8-9.
Figure 11:
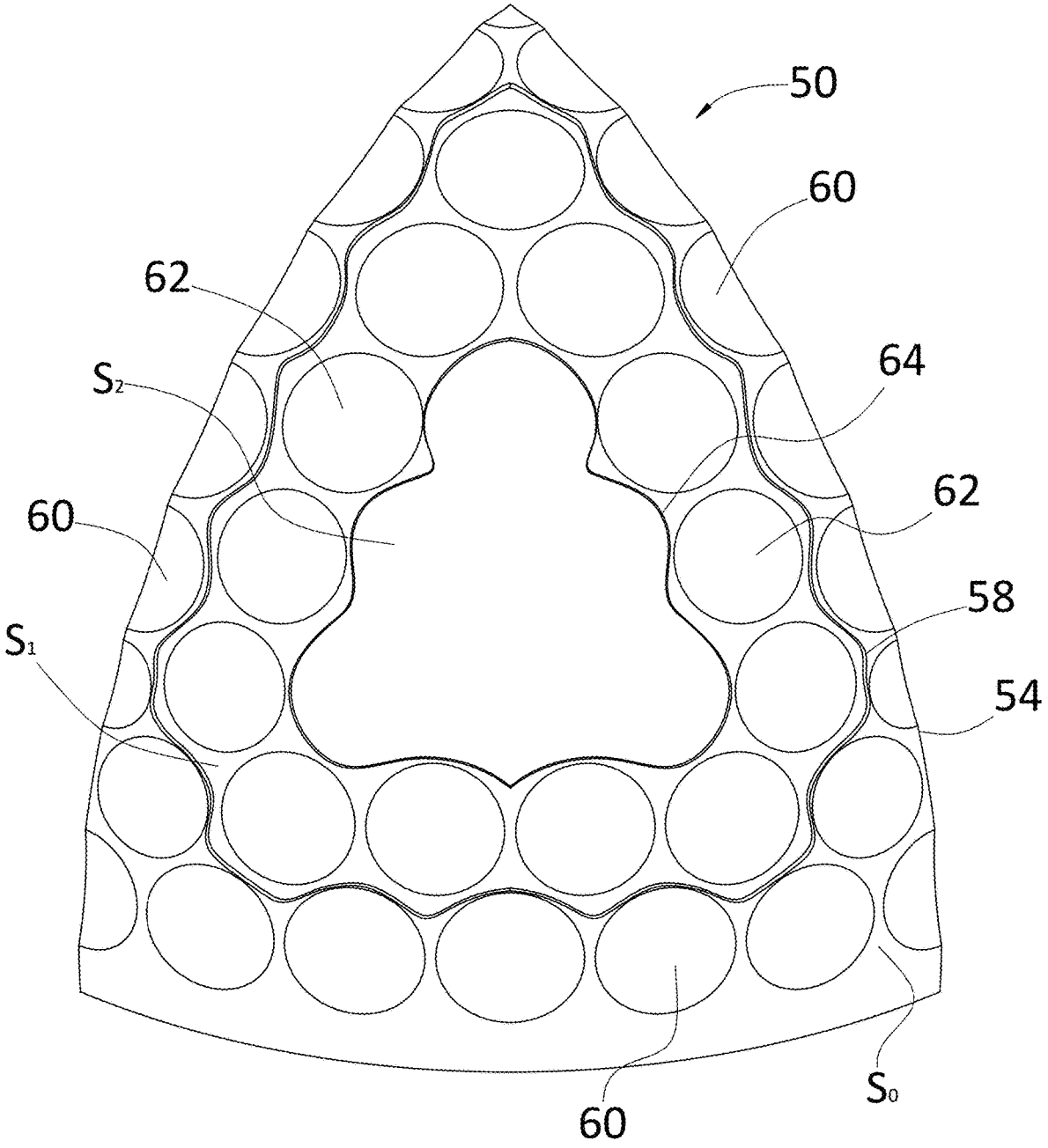
FIG. 11 illustrates additional dimples arranged on the first subsurface of the spherical section shown in FIGS. 8-10.
Figure 12:
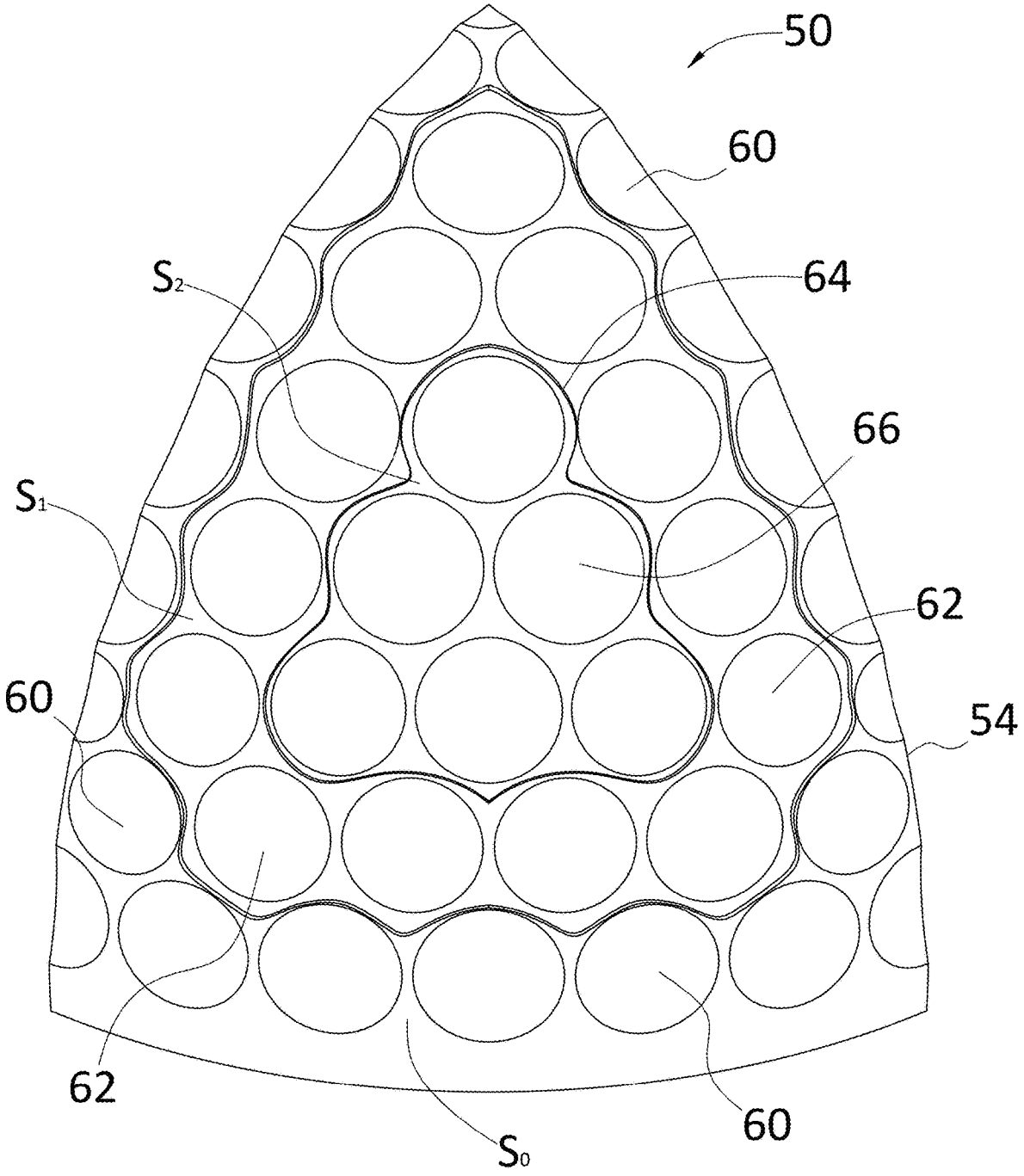
FIG. 12 illustrates additional dimples arranged on the second subsurface of the spherical section shown in FIGS. 8-11.
Figure 13:
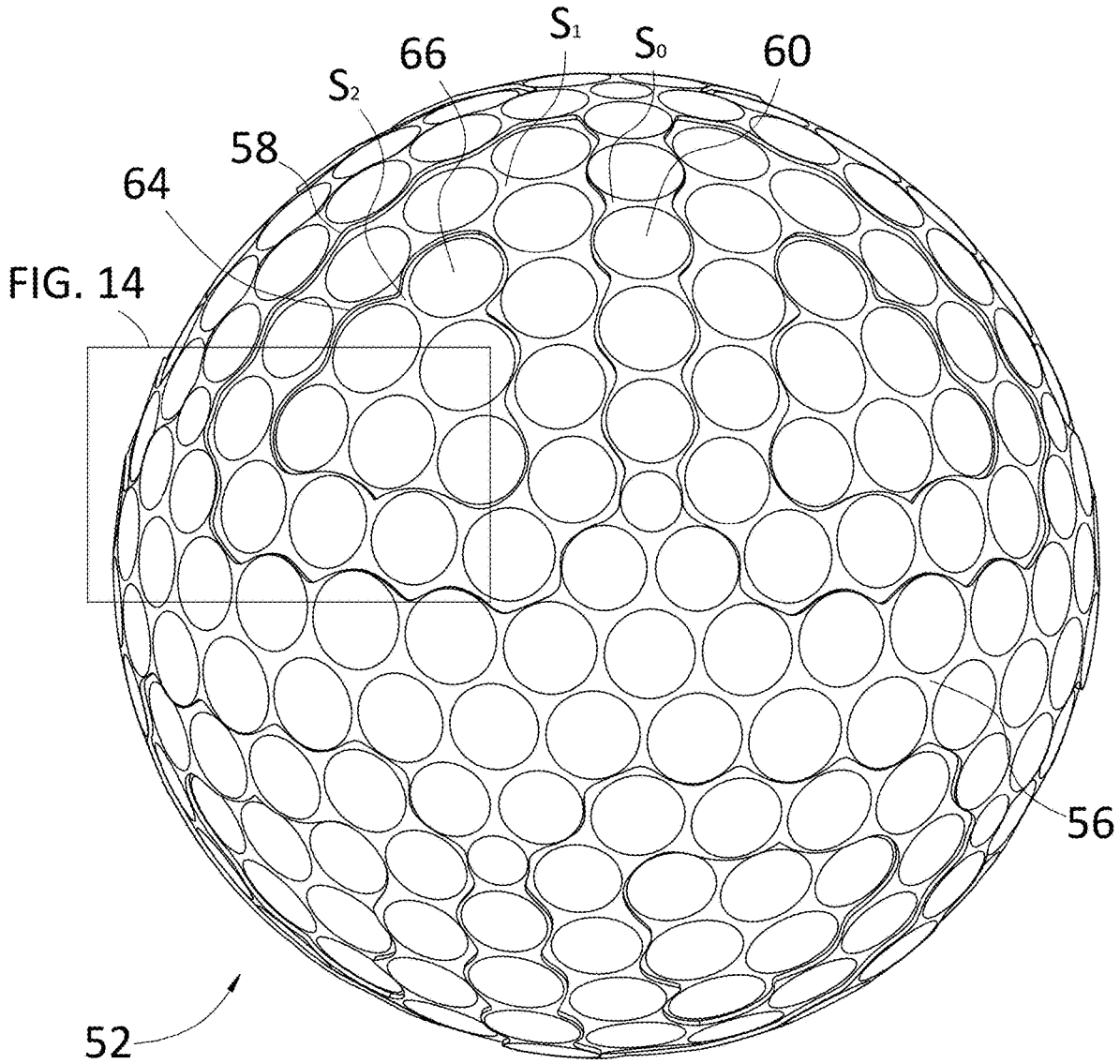
FIG. 13 illustrates a golf ball having spherical sections with dimples arranged on the exterior surface and the plurality of first and second subsurfaces as shown in FIGS. 8-12.
Figure 14:
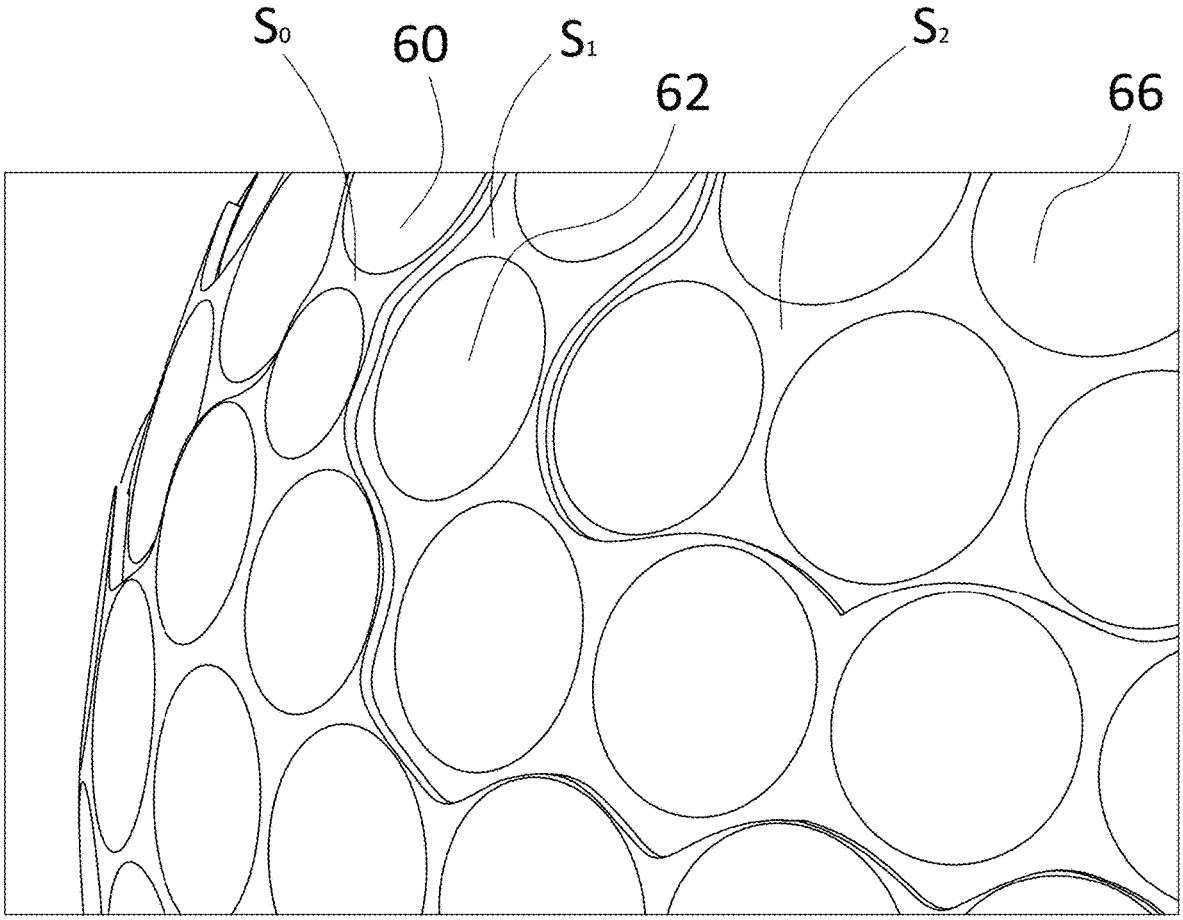
FIG. 14 illustrates a detailed view of the exterior surface and the first and second subsurfaces shown in FIG. 13.

Now referring to FIG. 10, preferably exterior surface dimples 60 have been packed on the exterior surface $S_0$. In this embodiment, the exterior surface dimples 60 are packed within the shape of the edge 54 of the spherical section 50 and the perimeter 58 of the first subsurface $S_1$. As shown, the exterior surface dimples 60 may lie across the edge 54 of the spherical section 50 of the golf ball 52. Turning now to FIG. 11, first subsurface dimples 62 have been packed on the first subsurface $S_1$. Preferably, at least two dimples 62 are fit solely within the perimeter 58 of the first subsurface $S_1$ and the second perimeter 64 of the second subsurface $S_2$. In this particular embodiment of the invention, thirteen first subsurface dimples 62 have been placed within the first subsurface $S_1$, although it will be appreciated that any number of first subsurface dimples 62 may be packed within the space available. Now referring to FIG. 12, second subsurface dimples 66 have been packed on the second subsurface $S_2$. Preferably, at least two second subsurface dimples 66 are provided solely within the second perimeter 64 of the second subsurface $S_2$. In this particular embodiment of the invention, six second subsurface dimples 66 have been packed on the second surface $S_2$, although it will be appreciated that any number of second subsurface dimples 66 may be packed within the space available. This embodiment results in three separate surfaces of the spherical section 50 that have dimples 60, 62, 66. As illustrated in FIG. 13, this spherical section 50 is tiled on the outer surface 56 of the golf ball 52 to form a golf ball dimple pattern. FIG. 14 is a detailed view of one portion of the outer surface 56 of the golf ball 52 showing the exterior surface $S_0$, the first subsurface $S_1$ and the second subsurface $S_2$, each having dimples 60, 62, 66.

Figure 15:
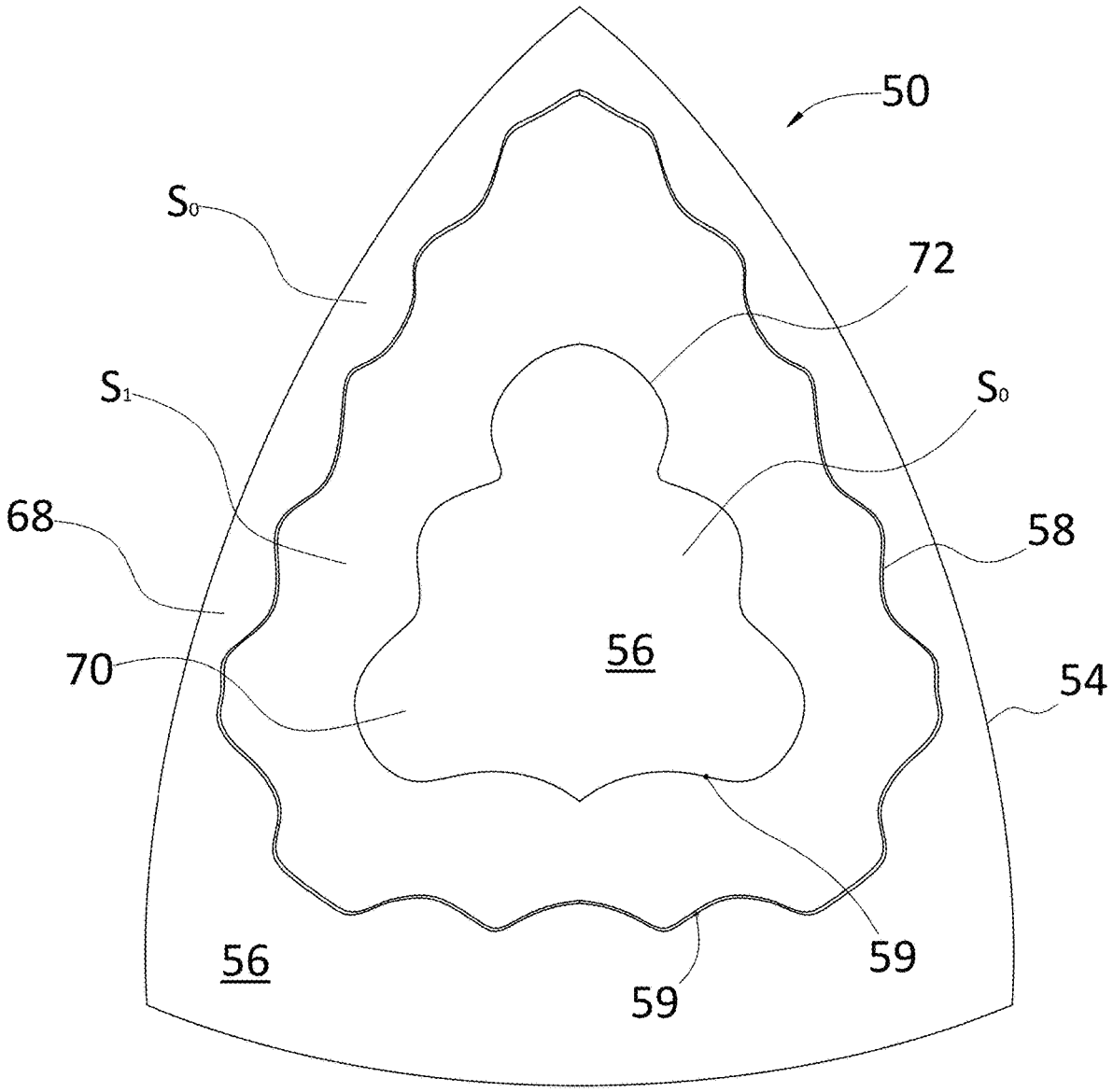
FIG. 15 illustrates a spherical section of a golf ball according to another embodiment of the present invention having an exterior surface with separate portions and a first subsurface.
Figure 16:
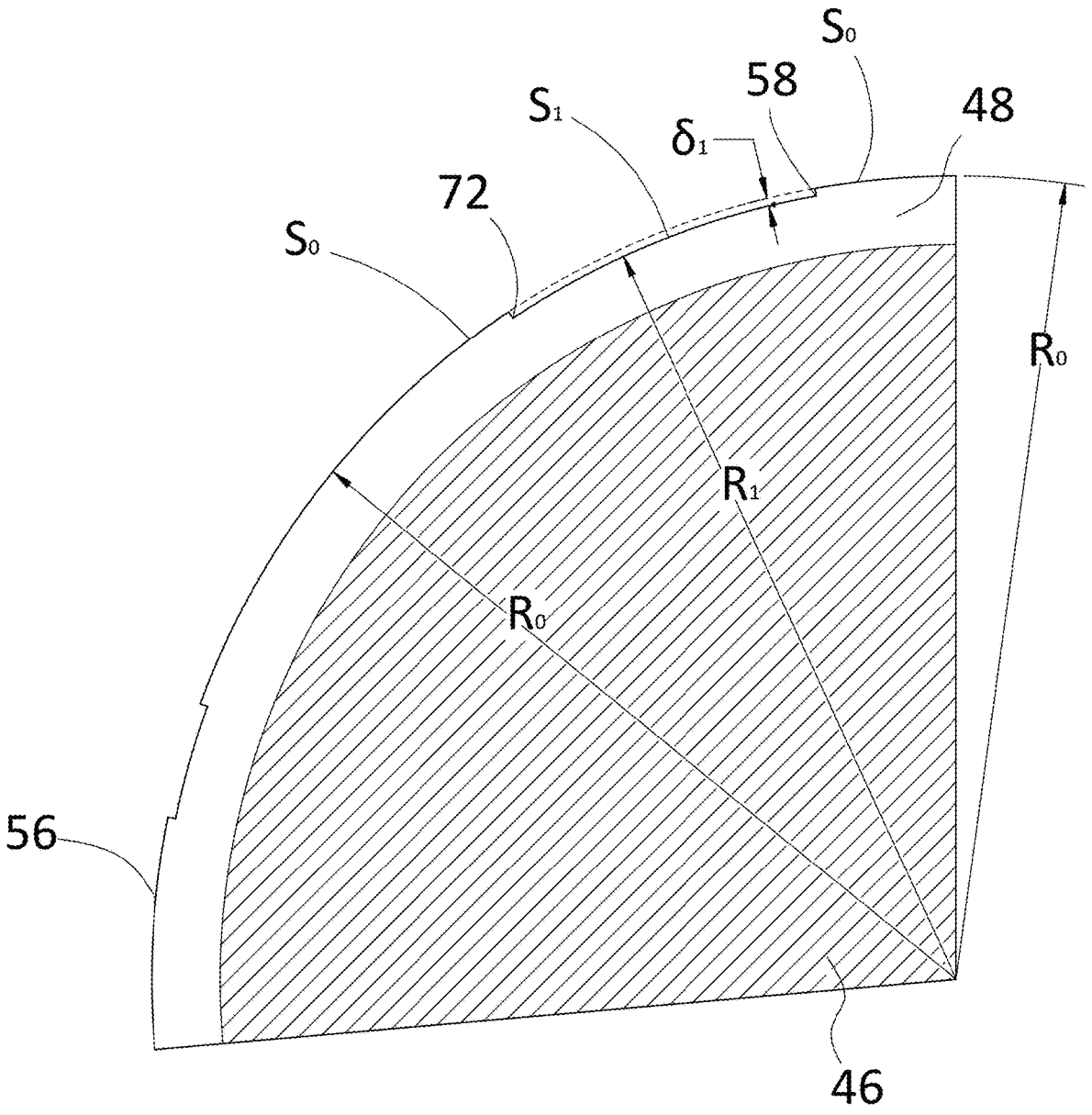
FIG. 16 shows a profile view of the exterior surface and first subsurface illustrated in FIG. 15.

Referring to FIG. 15 another embodiment of the present invention is illustrated. The spherical section 50 of the golf ball 52 is shown with exterior surface $S_0$ having two noncontiguous portions 68 and 70 on the spherical section 50 of the golf ball 52. A first subsurface $S_1$ is provided on the spherical section 50 and separates the two noncontiguous portions 68 and 70 of the exterior surface $S_0$. Although two noncontiguous portions 68 and 70 on the spherical section 50 are shown, it will be appreciated that any number could be provided. The first subsurface $S_1$ has an irregular shape, although it will be appreciated that it may have any desired shape including regular shapes, such as regular polygons. FIG. 16 illustrates a profile view of the spherical section 50 showing the two noncontiguous portions 68 and 70 of exterior surface $S_0$ and the first subsurface $S_1$. The exterior surface $S_0$ has a radius $R_0$. The first subsurface $S_1$ has a radius $R_1$, such that the first subsurface $S_1$ is offset from the exterior surface $S_0$ by a first offset value $\delta_1$, such that $R_1=R_0-\delta_1$. The first offset value $\delta_1$ has a value of between about 0.002 and about 0.020 inches. Preferably, the first offset value $\delta_1$ has a value of between about 0.009 and about 0.020 inches, more preferably between about 0.010 and about 0.015 inches. In another embodiment, the first offset value $\delta_1$ has a value between about 0.003 and about 0.015 inches. As will be appreciated from FIG. 16, the first subsurface $S_1$ is spherical and concentric to the exterior surface $S_0$.

Figure 17:
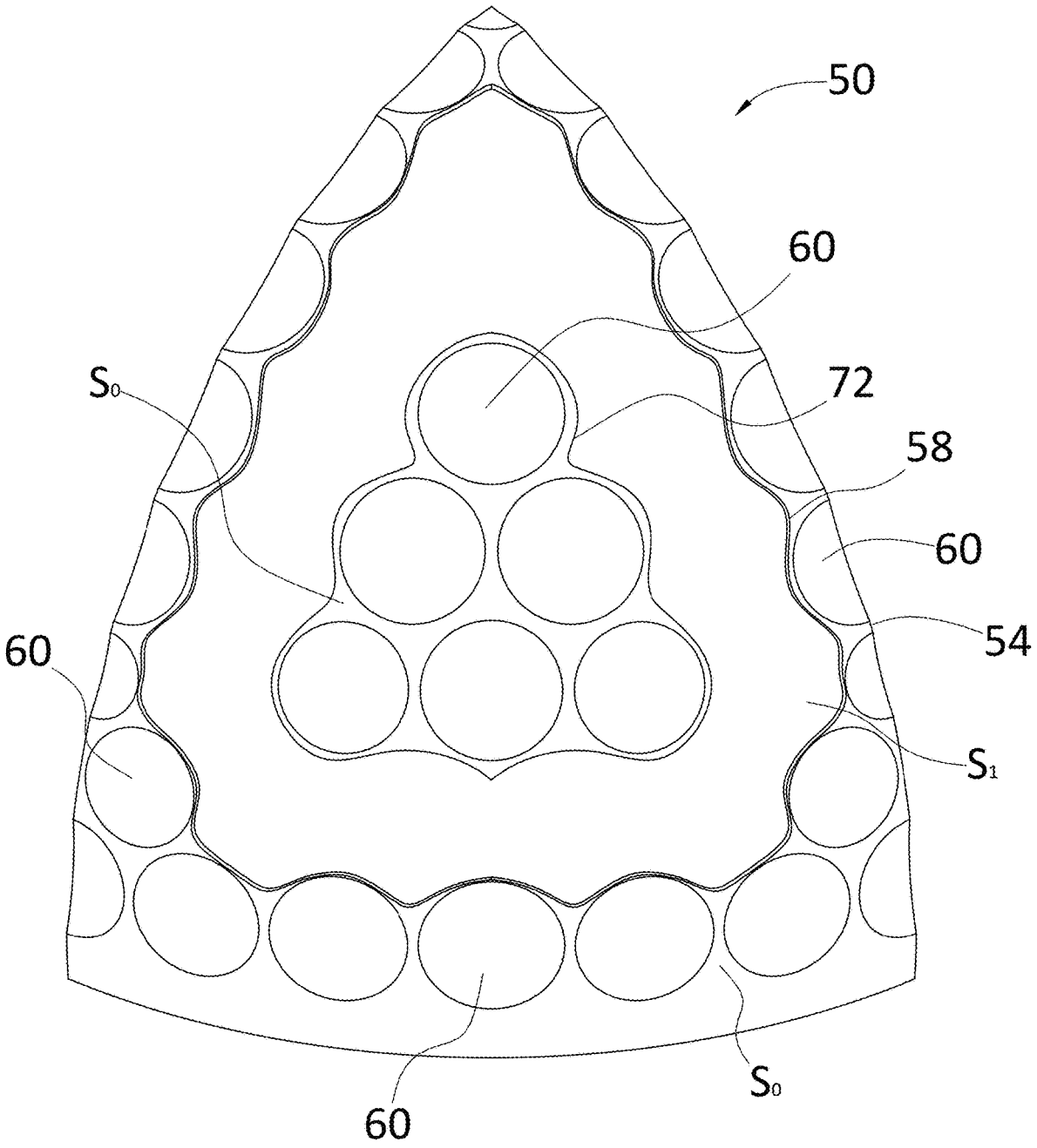
FIG. 17 illustrates dimples arranged on the exterior surface of the spherical section shown in FIGS. 15-16.
Figure 18:
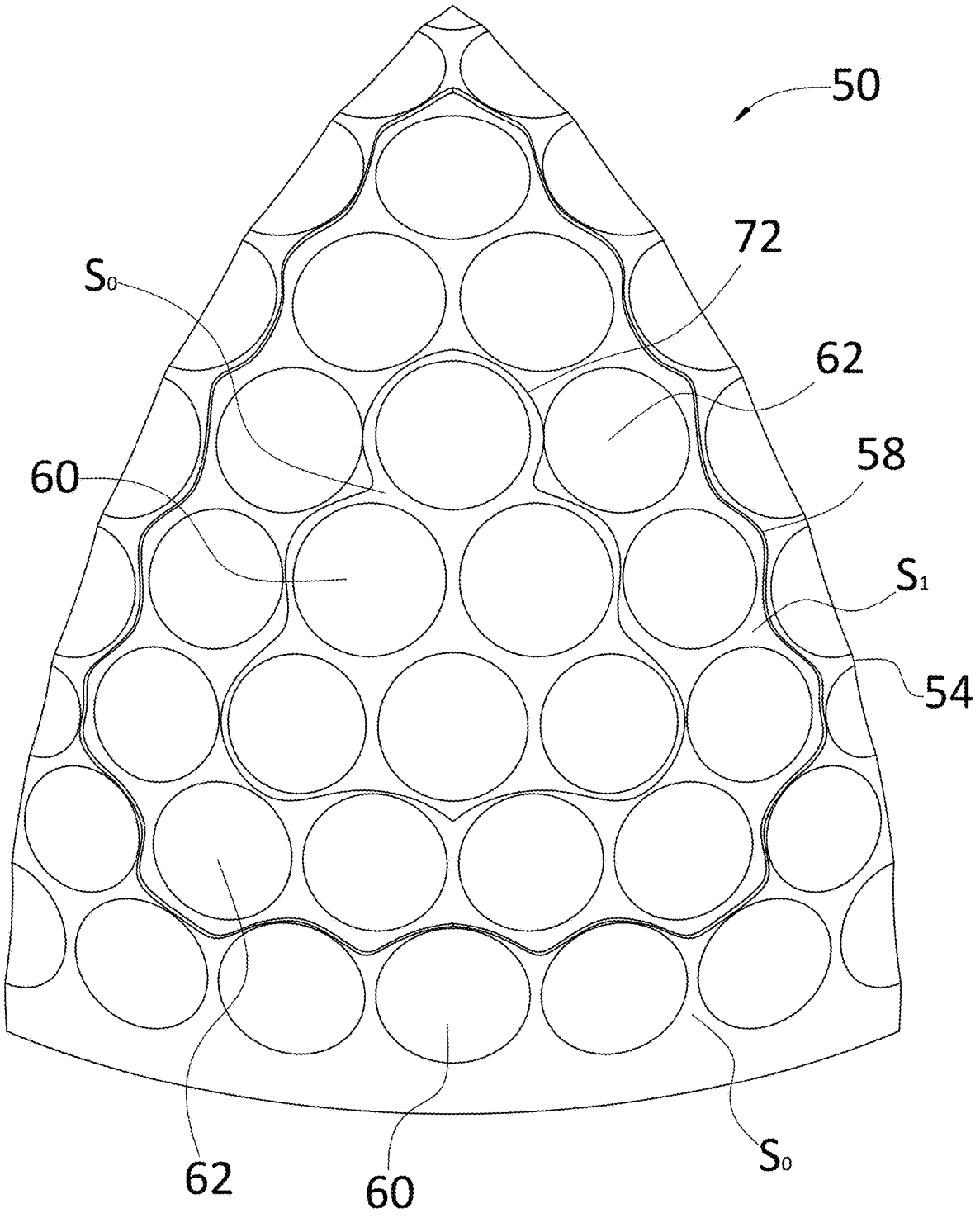
FIG. 18 illustrates additional dimples arranged on the first subsurface of the spherical section shown in FIGS. 15-17.
Figure 19:
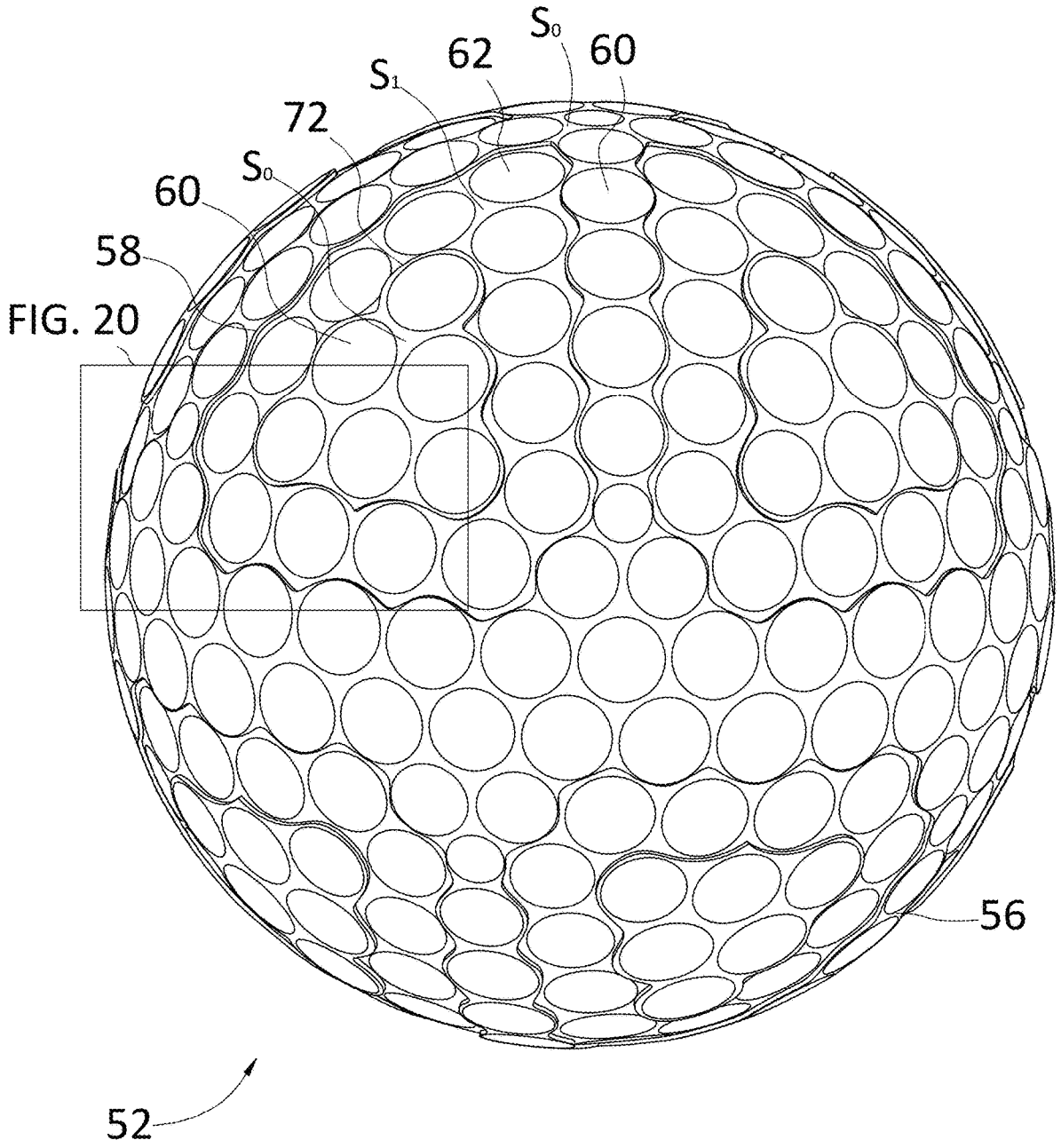
FIG. 19 illustrates a golf ball having spherical sections with dimples arranged on the exterior surface and first subsurface as shown in FIGS. 15-18.
Figure 20:
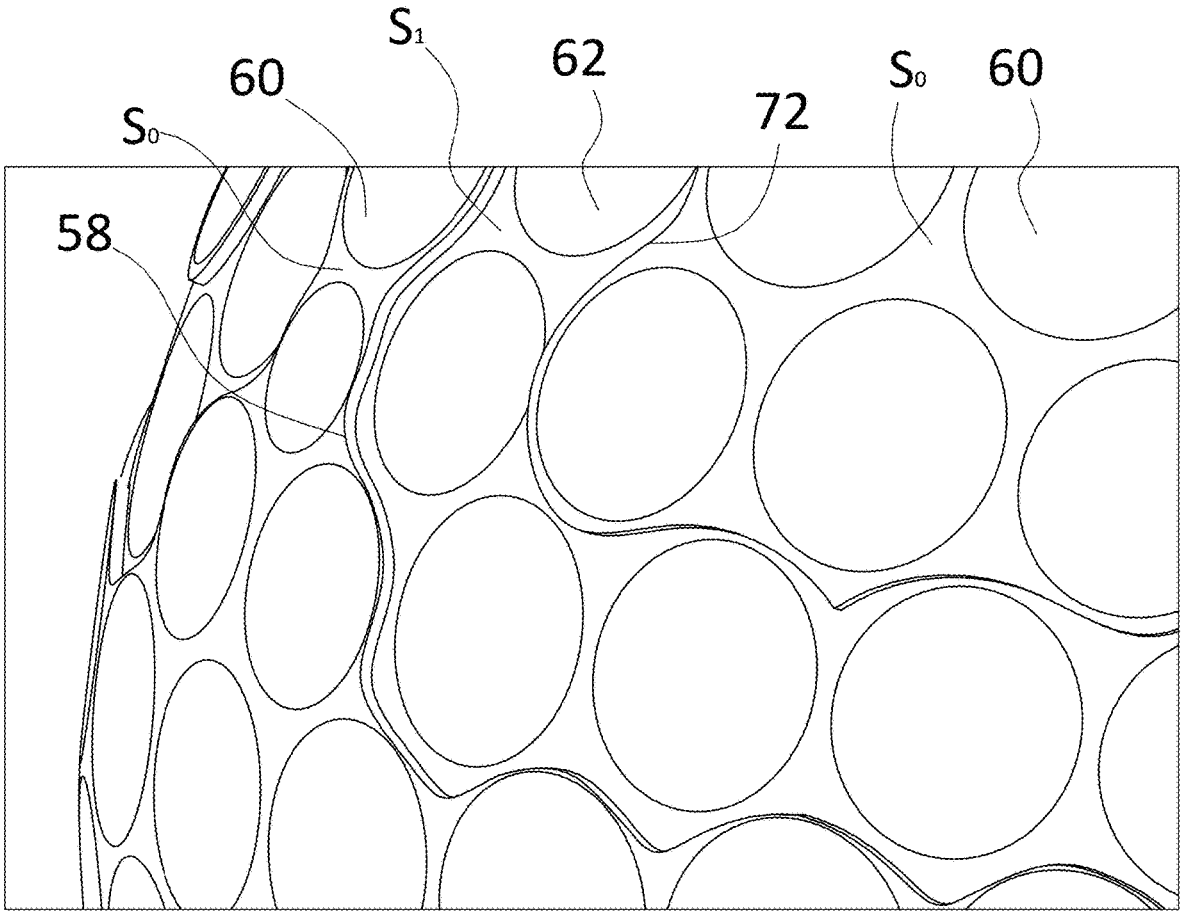
FIG. 20 illustrates a detailed view of the exterior surfaces and the first subsurface shown in FIG. 19.

Now referring to FIG. 17, preferably exterior surface dimples 60 have been packed on the noncontiguous portions 68 and 70 of the exterior surface $S_0$. In this embodiment, the dimples 60 are packed within the shape of the edge 54 of the spherical section 50 and a perimeter 58 of the first subsurface $S_1$ and within the interior of the inside perimeter 72 of the first subsurface $S_1$ to provide exterior surface dimples 60 on all the noncontiguous portions 68 and 70 of the exterior surface $S_0$. As shown, the exterior surface dimples 60 may lie across the edge 54 of the spherical section 50 of the golf ball 52. Turning now to FIG. 18, first subsurface dimples 62 have been packed on the first subsurface $S_1$. Preferably, at least two first subsurface dimples 62 are fit solely within the perimeter 58 of the first subsurface $S_1$. In this particular embodiment of the invention, thirteen first subsurface dimples 62 have been packed on the first subsurface $S_1$, although it will be appreciated that any number of first subsurface dimples 62 may be packed within the space available. This embodiment results in two separate surfaces of the spherical section 50 that have dimples 60, 62. As illustrated in FIG. 19, this spherical section 50 is tiled on the outer surface 56 of the golf ball 52 to form a golf ball dimple pattern. FIG. 20 is a detailed view of one portion of the outer surface 56 of the golf ball 52 showing the exterior surface $S_0$, the first subsurface $S_1$, each having dimples 60, 62.

It will be appreciated that in the embodiments described in FIGS. 1-20, a first subsurface $S_1$ may be centered at the vertices of the pentagonal dipyramid projected onto the sphere 52 and/or the subsurface $S_1$ may be centered on the faces of the pentagonal dipyramid pattern projected onto the sphere 52 as shown in FIGS. 2, 4-6, 8, 10-13, 15 and 17-19.

Figure 21:
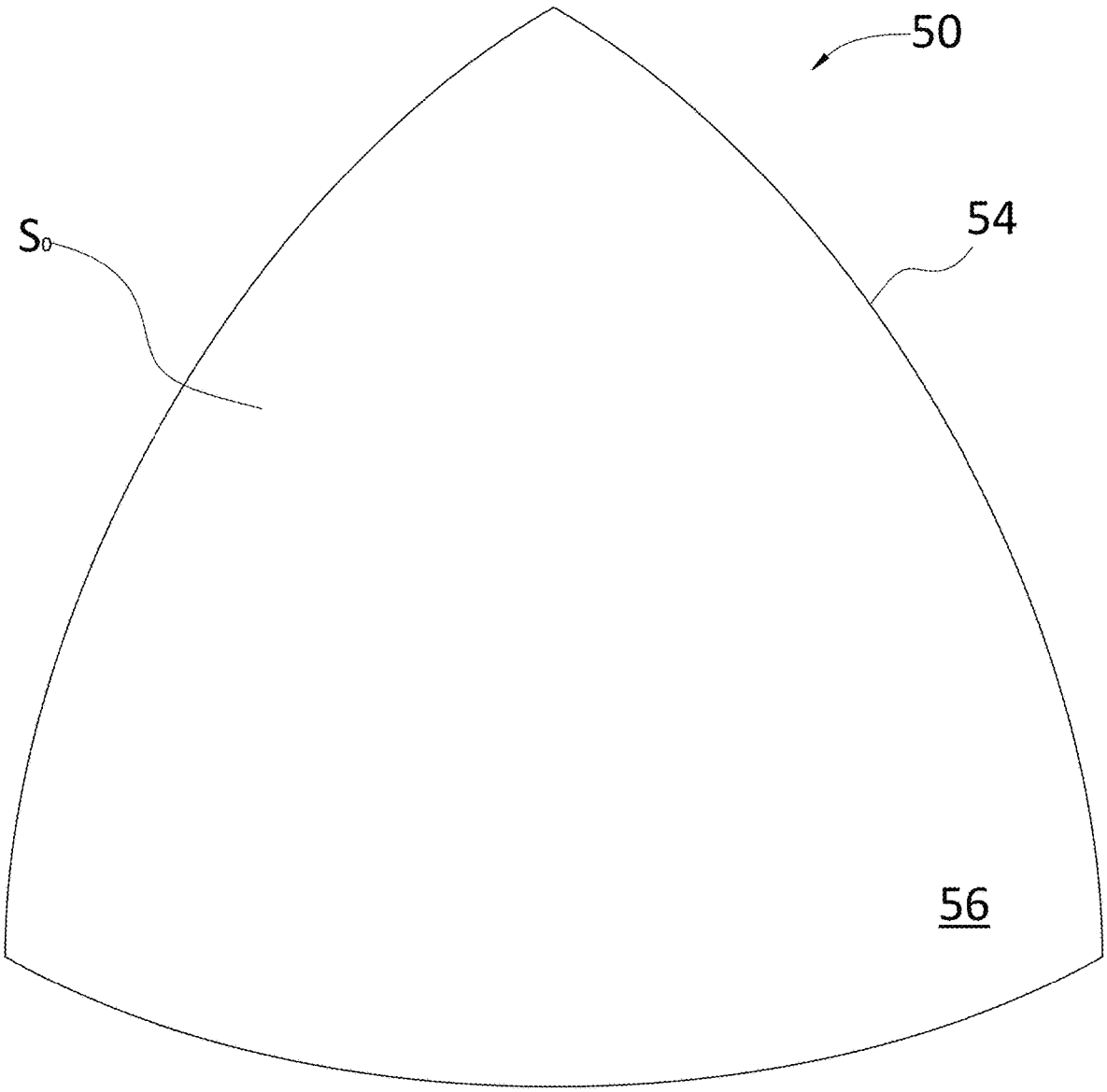
FIG. 21 illustrates a spherical section of a golf ball according to another embodiment of the present invention.
Figure 22:
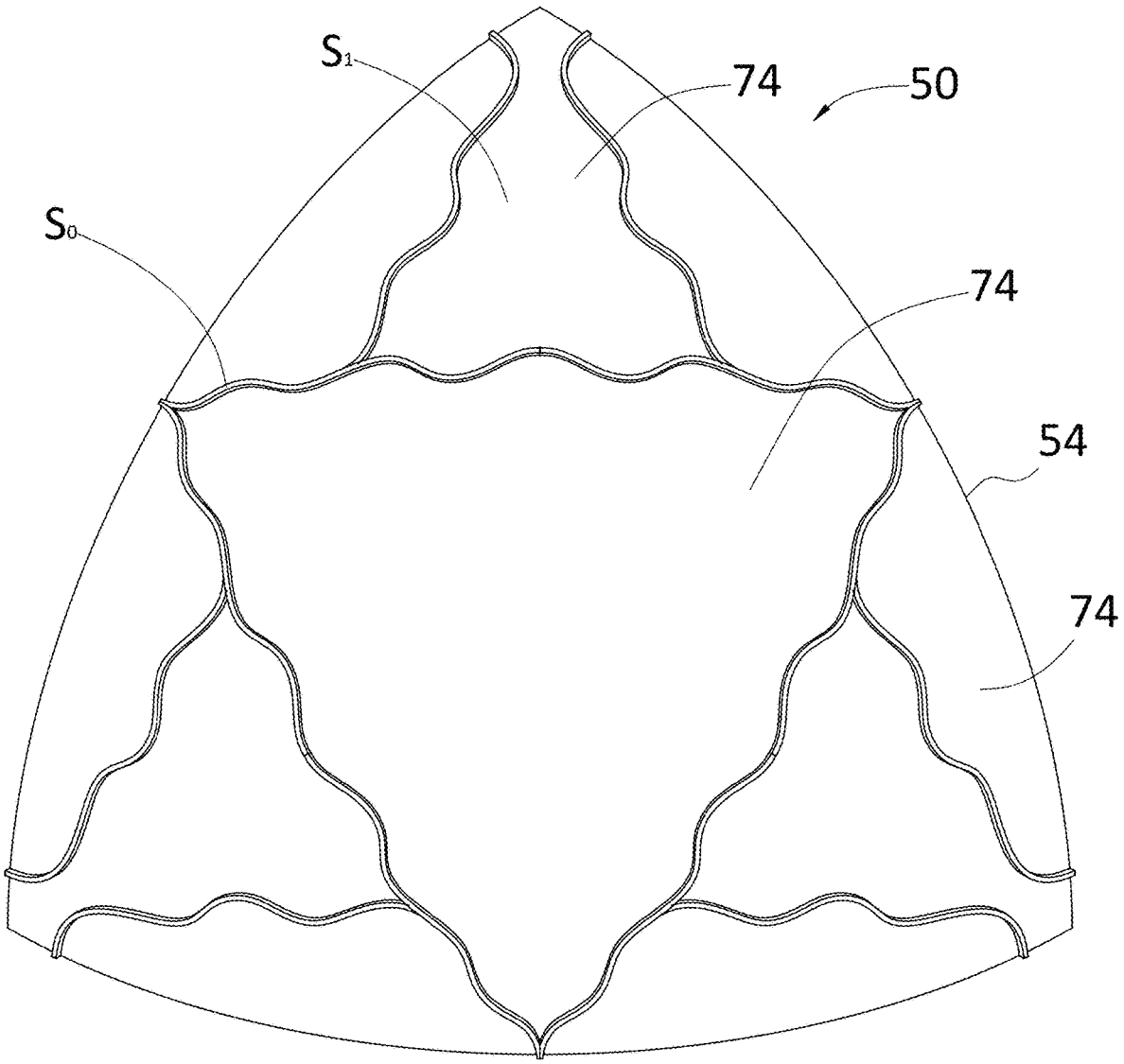
FIG. 22 illustrates an exterior surface and multiple sectors of the first subsurface on the spherical section of a golf ball of FIG. 21.
Figure 23:
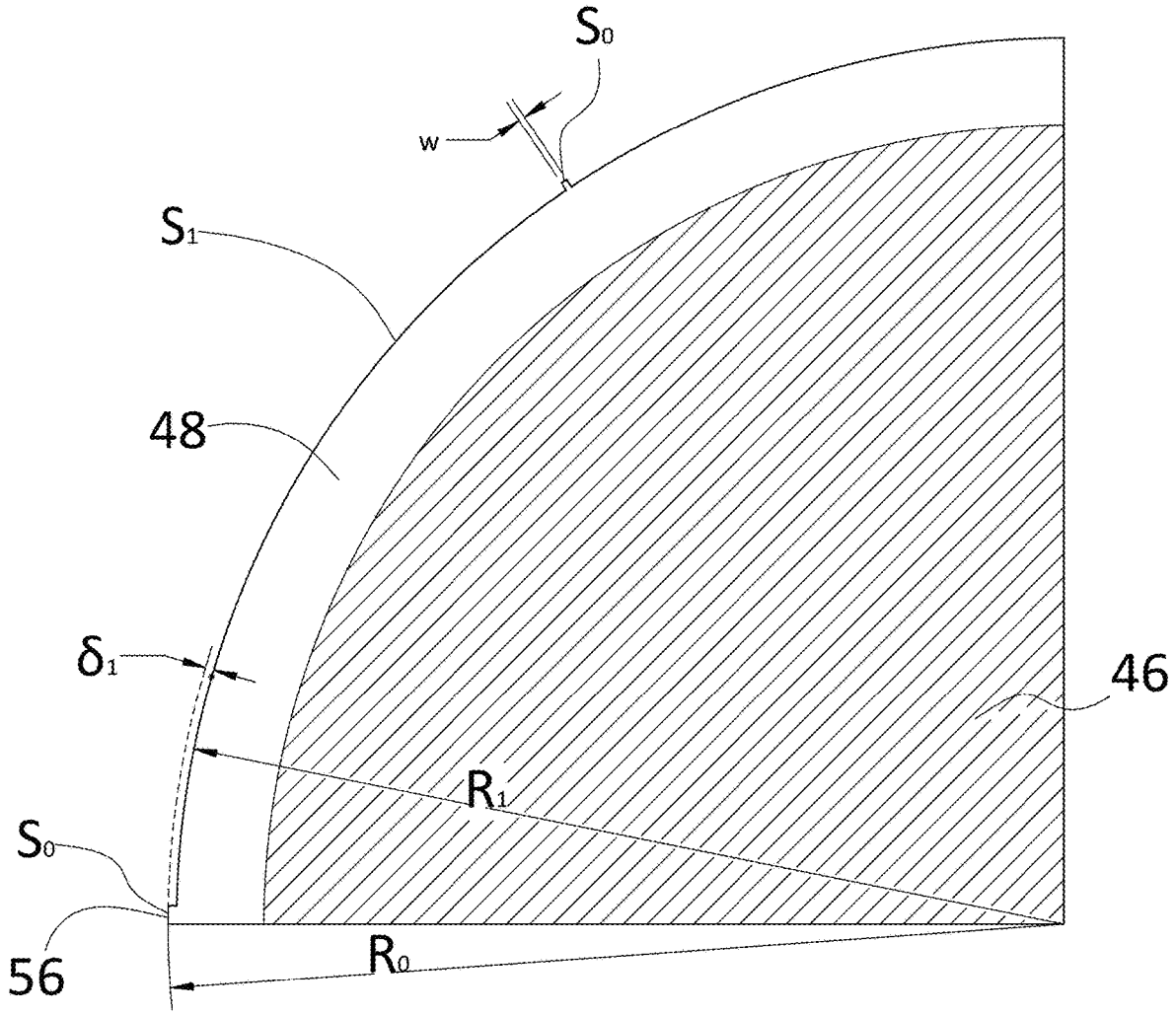
FIG. 23 shows a profile view of the exterior surface and multiple sectors of the first subsurface illustrated in FIGS. 21-22.

Referring now to FIG. 21 another embodiment of the present invention is illustrated. The spherical section 50 of the golf ball 52 is shown to create a triangular dipyramid dimple pattern having exterior surface $S_0$. FIG. 22 shows a first subsurface $S_1$ made of multiple sectors 74 provided on the spherical section 50. Although multiple sectors 74 are shown in this example, it will be appreciated that one sector may be provided. The first subsurface $S_1$ has multiple sectors 74 with irregular shapes, although it will be appreciated that they may have any desired shape including regular shapes, such as regular polygons. Preferably, the multiple sectors 74 have a non-circular perimeter. A non-circular perimeter may be defined as having a non-constant radius of curvature. Preferably, the radius of curvature along any point of the perimeter of the multiple sectors 74 does not exceed about 0.2 inches. It will also be appreciated that the perimeter of the multiple sectors 74 may also have an inflection point. FIG. 23 illustrates a profile view of the spherical section 50 showing the exterior surface $S_0$ and the first subsurface $S_1$. The exterior surface $S_0$ has a radius $R_0$. The first subsurface $S_1$ has a radius $R_1$, such that the first subsurface $S_1$ is offset from the exterior surface $S_0$ by a first offset value $\delta_1$, such that $R_1=R_0-\delta_1$. The first offset value $\delta_1$ has a value of between about 0.002 and about 0.020 inches. Preferably, the first offset value $\delta_1$ has a value of between about 0.009 and about 0.020 inches, more preferably between about 0.010 and about 0.015 inches. In another embodiment, the first offset value $\delta_1$ has a value between about 0.003 and about 0.015 inches. As will be appreciated from FIG. 26, the first subsurface $S_1$ is spherical and concentric to the exterior surface $S_0$.

Figure 24:
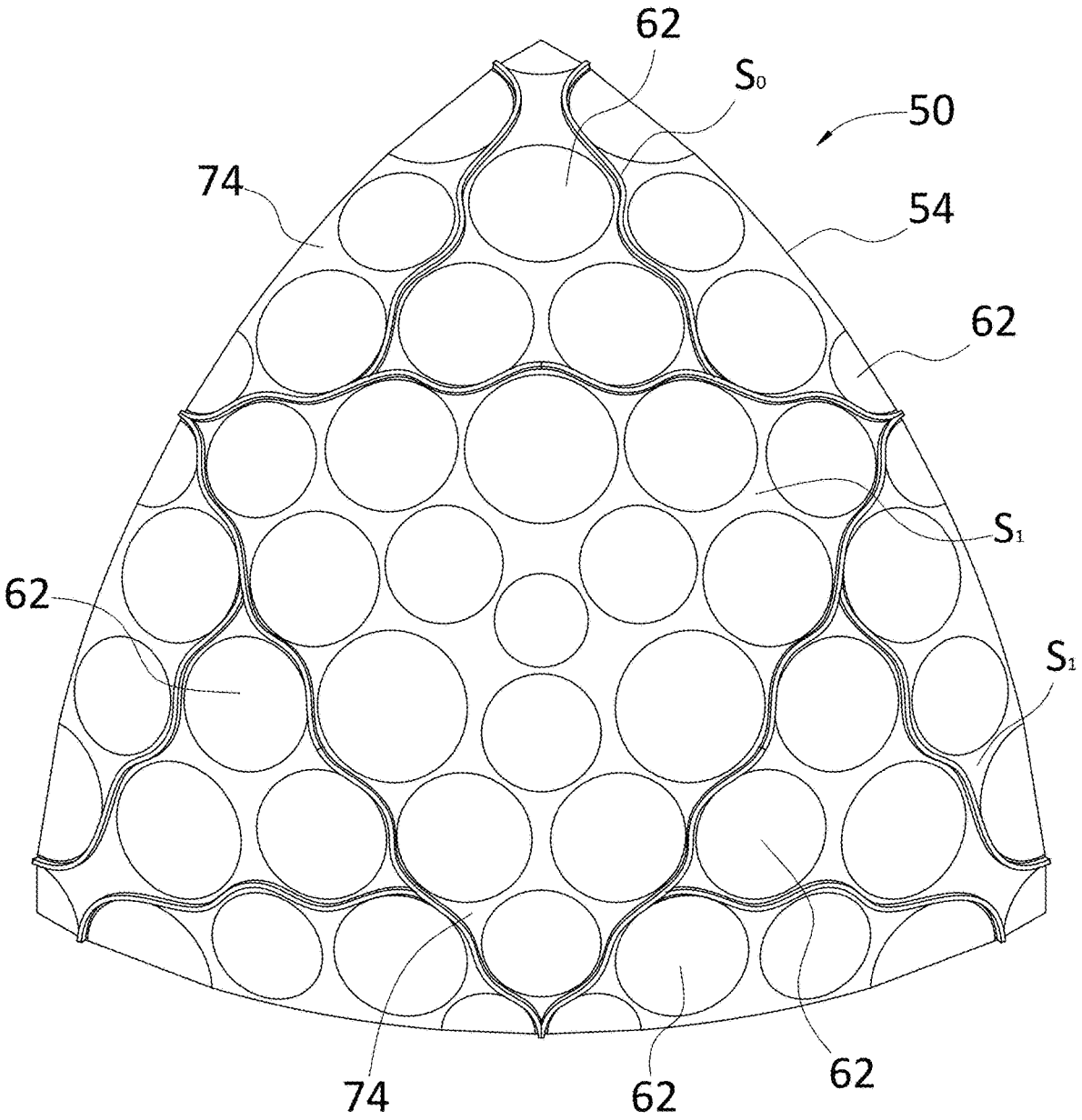
FIG. 24 illustrates dimples arranged on the multiple sectors of the first subsurface of the spherical section shown in FIGS. 21-23.
Figure 25:
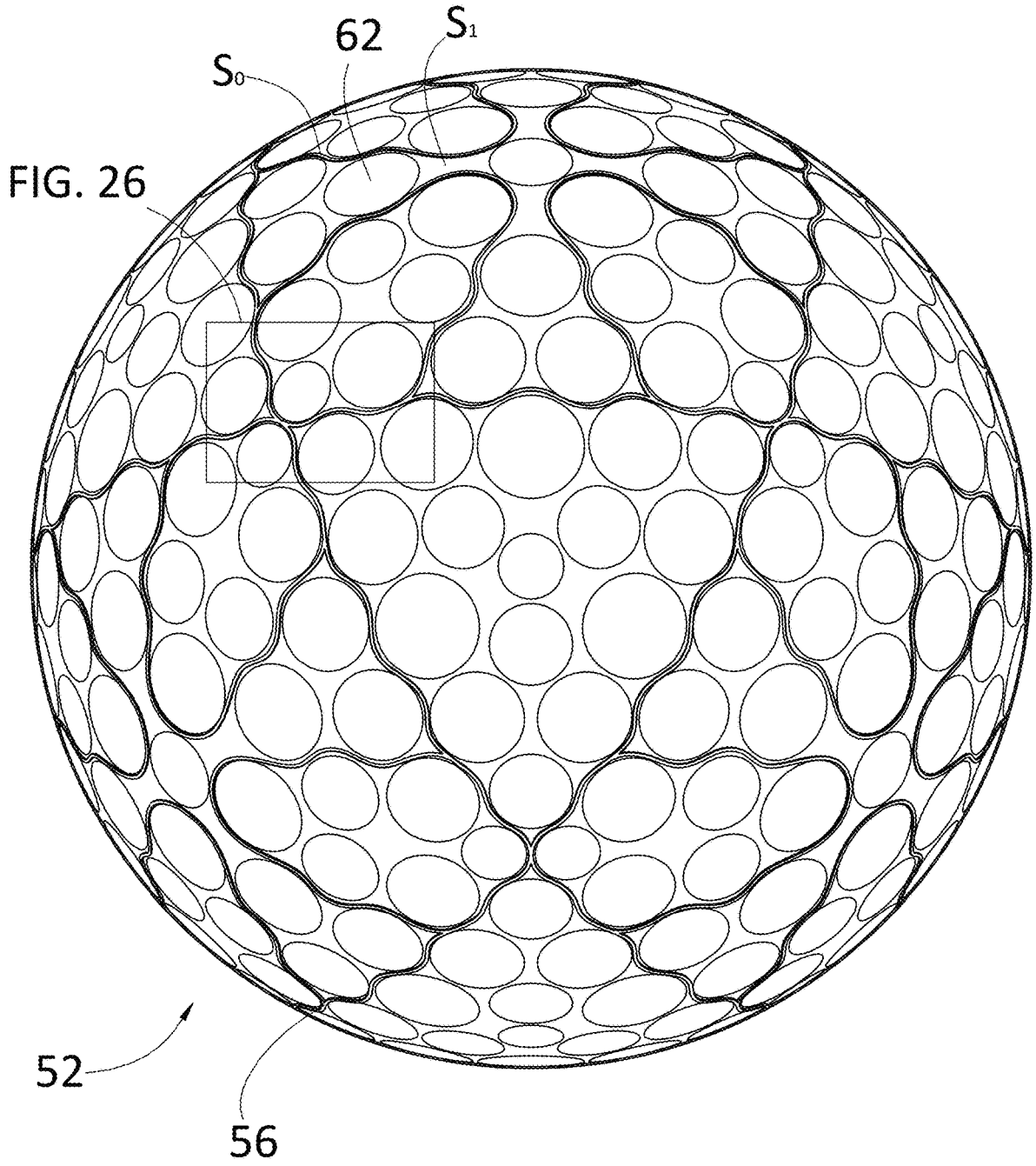
FIG. 25 illustrates a golf ball having spherical sections with dimples arranged on the first subsurface as shown in FIGS. 21-24.
Figure 26:
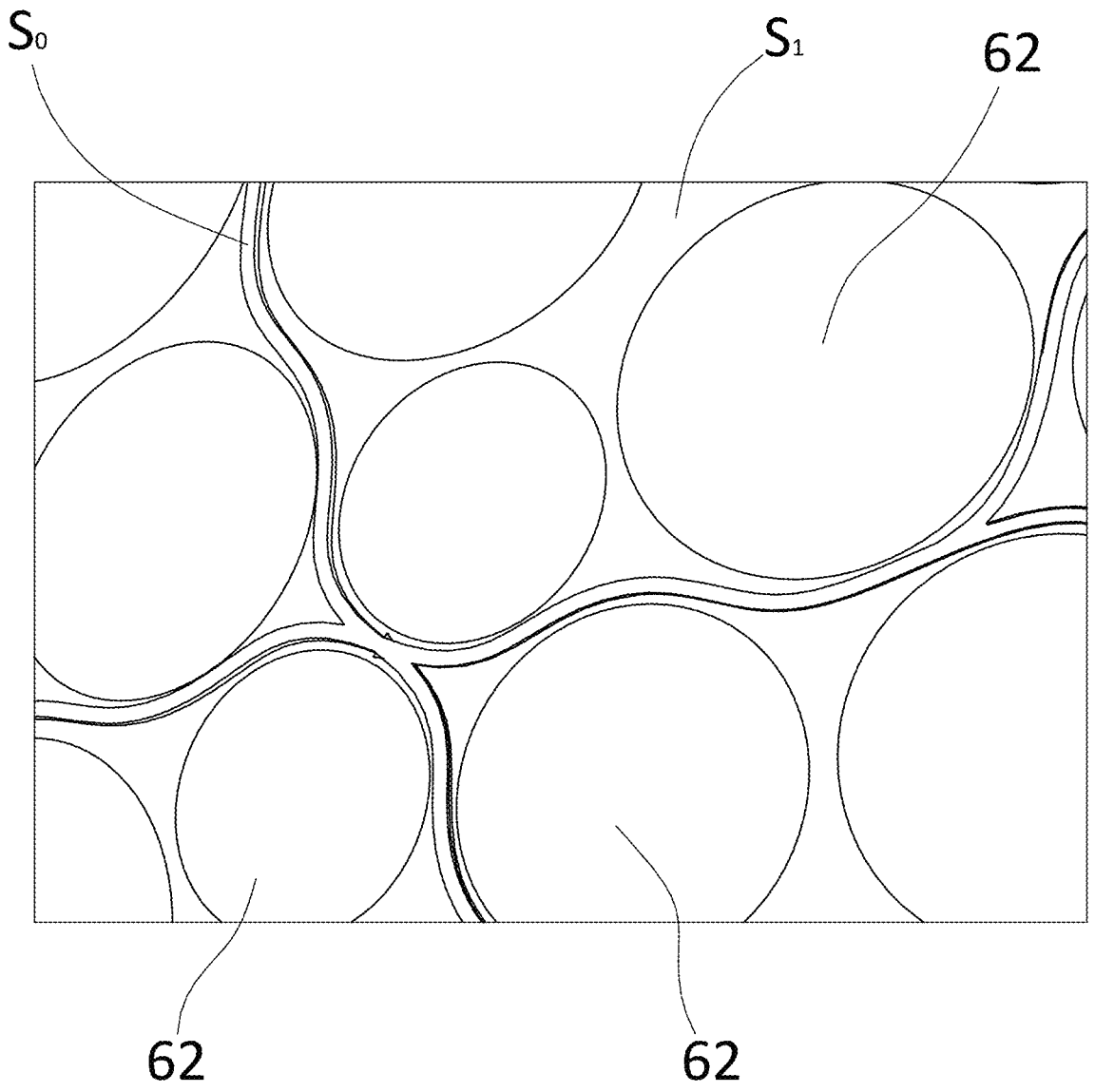
FIG. 26 illustrates a detailed view of the exterior surface and the first subsurface shown in FIG. 25.

Now referring to FIG. 24, no dimples have been packed on the exterior surface $S_0$. In this embodiment, the first subsurface dimples 62 are packed within the perimeter 58 of the first subsurface $S_1$'s multiple sectors 74. It will be appreciated that preferably at least two first subsurface dimples 62 are provided in each sector 74 of the first subsurface $S_1$. As shown in FIG. 23, the exterior surface $S_0$ has a width w, preferably about 0.010 to about 0.050 inches. It will be appreciated that width w of the exterior surface $S_0$ may be the same or may vary on the golf ball 52. In this embodiment, all of the dimples are located on the first subsurface $S_1$ of the spherical section 50. As shown, the first subsection dimples 62 may lie across the edge 54 of the spherical section 50 of the golf ball 52. Turning now to FIG. 25, the spherical section 50 is tiled on the outer surface 56 of the golf ball 52. This embodiment results in a golf ball 52 with all of the dimples 62 being packed on the first subsurface $S_1$. FIG. 26 is a detailed view of one portion of the outer surface 54 of the golf ball 52 showing the exterior surface $S_0$, the first subsurface $S_1$, with only the first subsurface $S_1$ having first subsurface dimples 62.

Figure 27:
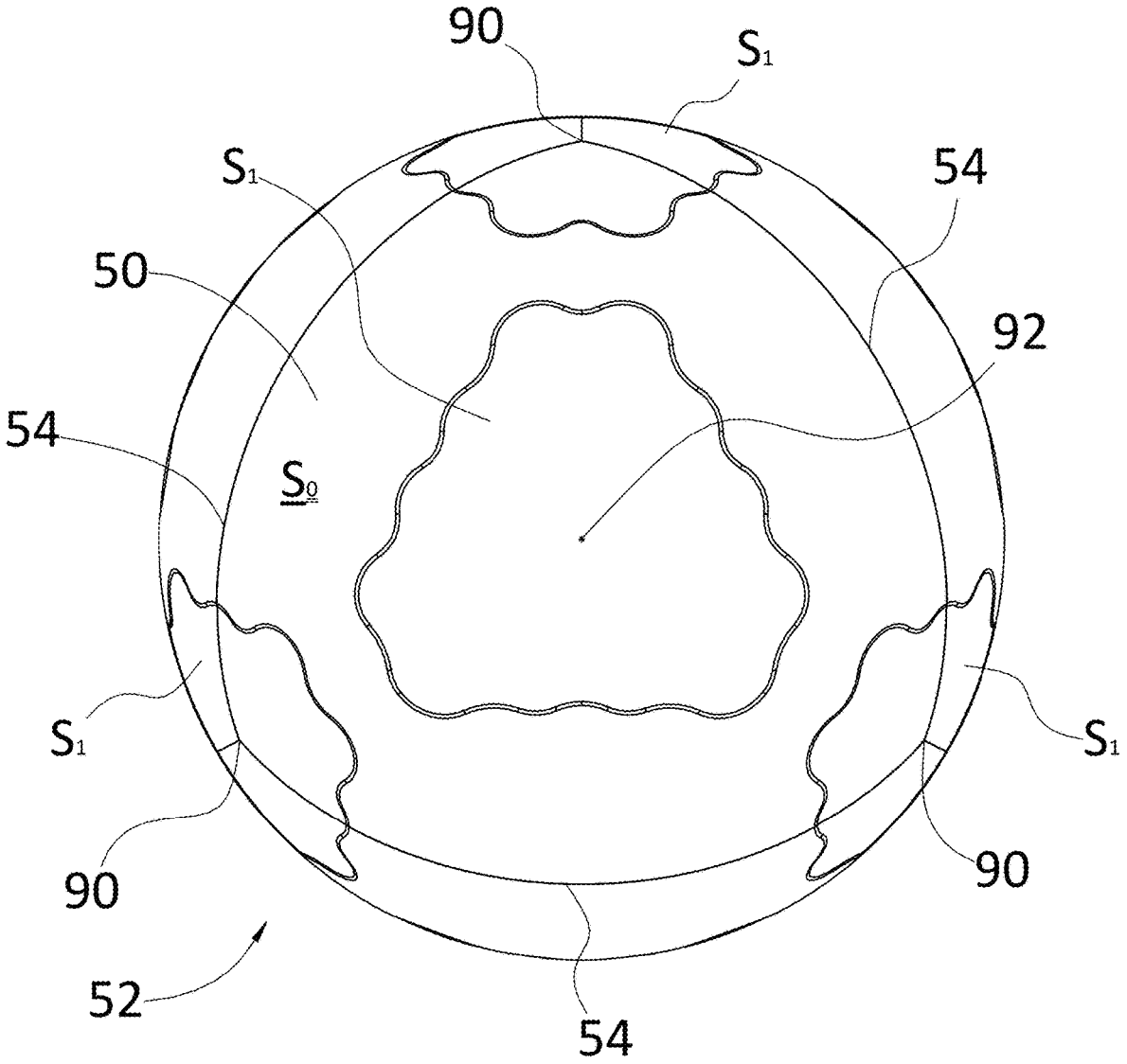
FIG. 27 illustrates an embodiment of the present invention where a subsurface is centered at the vertices and faces of a spherical tetrahedron pattern.

FIG. 27 illustrates a spherical tetrahedron projected onto a sphere 52 to create a tetrahedron pattern having edges 54. It will be appreciated that in one embodiment, a first subsurface $S_1$ may be centered at the vertices 90 of the spherical tetrahedron as shown and/or the subsurface $S_1$ may be centered on the faces 92 of the spherical tetrahedron as shown.

Figure 28:
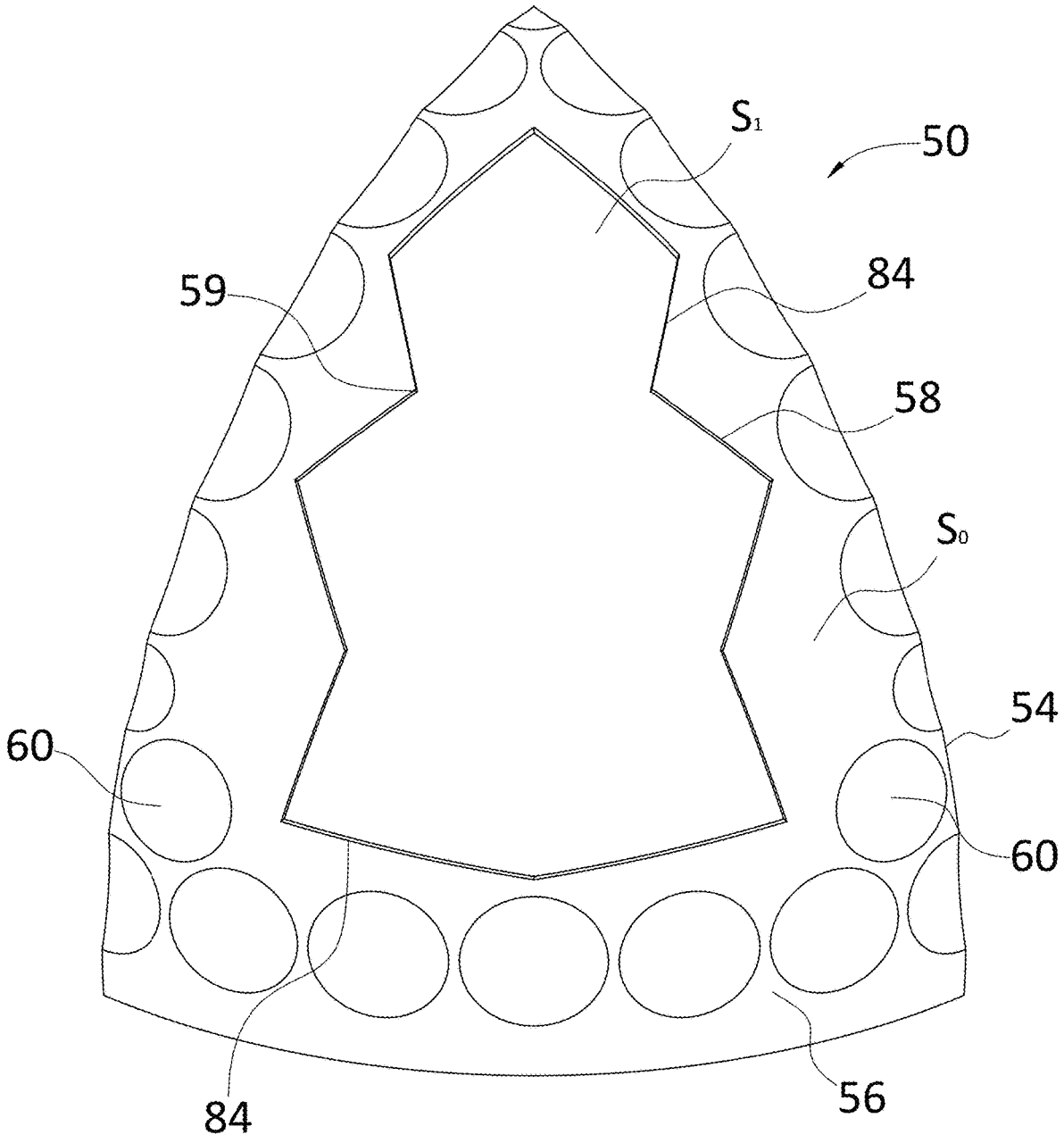
FIG. 28 illustrates an exterior surface arranged with dimples and a first subsurface on a spherical section of a golf ball according to the present invention.

FIG. 28 illustrates a spherical section 50 of a golf ball 52 having an edge 54 and an exterior surface $S_0$. A portion of the spherical section 50 is provided with a first subsurface $S_1$. The first subsurface $S_1$ has a perimeter 58 with straight sides 84. It will be appreciated that the exterior surface $S_0$ has a radius $R_0$ as shown previously. Preferably, $R_0$ is always greater than or equal to 0.84 inches to comply with the U.S.G.A. requirements. Preferably, the exterior surface $S_0$ has a nearly equal radius $R_0$ at all or nearly all points along the exterior surface $S_0$. Additionally, as shown previously, the first subsurface $S_1$ has a radius $R_1$, such that the first subsurface $S_1$ is offset from the exterior surface $S_0$ by a first offset value $\delta_1$, such that $R_1=R_0-\delta_1$. The first offset value $\delta_1$ has a value of between about 0.002 and about 0.020 inches. Preferably, the first offset value $\delta_1$ has a value of between about 0.009 and about 0.020 inches, more preferably between about 0.010 and about 0.015 inches. In another embodiment, the first offset value $\delta_1$ has a value between about 0.003 and about 0.015 inches. The first subsurface $S_1$ is spherical and concentric to the exterior surface $S_0$.

Figure 29:
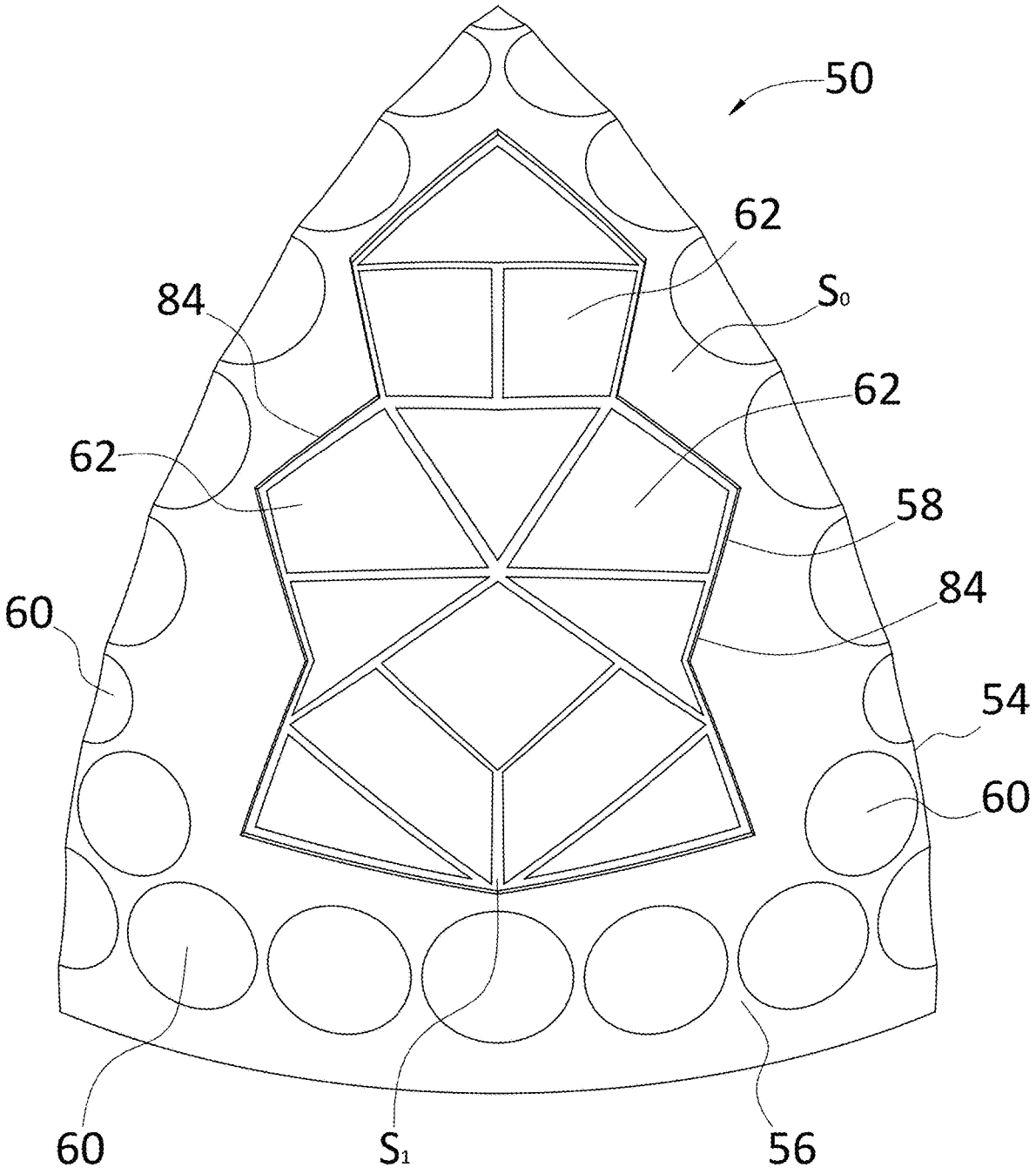
FIG. 29 illustrates additional dimples arranged on the first subsurface having non-circular plan shapes that follow the shape of a perimeter of the subsurface.

Now referring to FIG. 29, preferably exterior surface dimples 60 have been packed on the exterior surface $S_0$ and first subsurface dimples 62 have been packed on the first subsurface $S_1$. In this embodiment, the exterior surface dimples 60 packed on the exterior surface $S_0$ are fitted within the perimeter 58 of the first subsurface $S_1$ and lie across the edge 54 of the spherical section 50 of the golf ball 52. The first subsurface dimples 62 provided on the first subsurface $S_1$ and within the perimeter 58 are noncircular plan shaped dimples. Preferably, at least two first subsurface dimples 62 are fit solely within the perimeter 58 of the first subsurface $S_1$. In this particular embodiment of the invention, thirteen noncircular plan shaped first subsurface dimples 62 have been placed within the perimeter 58 of the first subsurface $S_1$. In this embodiment, some of the first subsurface dimples 62 use the straight sides 84 of the perimeter 58 to form their noncircular plan shape. This embodiment results in two separate surfaces of the spherical section 50 that have dimples. This spherical section 50 is tiled on the outer surface 56 of the golf ball 52 to form a golf ball dimple pattern. This results in a golf ball 52 having the exterior surface $S_0$ and the first subsurface $S_1$, each having dimples 60, 62. The first subsurface $S_1$ has a perimeter 58 and the perimeter 58 is independent of the exterior surface dimples 60 on the exterior surface $S_0$. The first subsurface dimples 62 have non-circular plan shapes. The first subsurface dimples 62 provided on the first subsurface $S_1$ preferably are packed to follow the shape of the perimeter 58 of the first subsurface $S_1$. It will be appreciated that the exterior surface $S_0$ may have non-circular plan dimple shapes.

Figure 30:
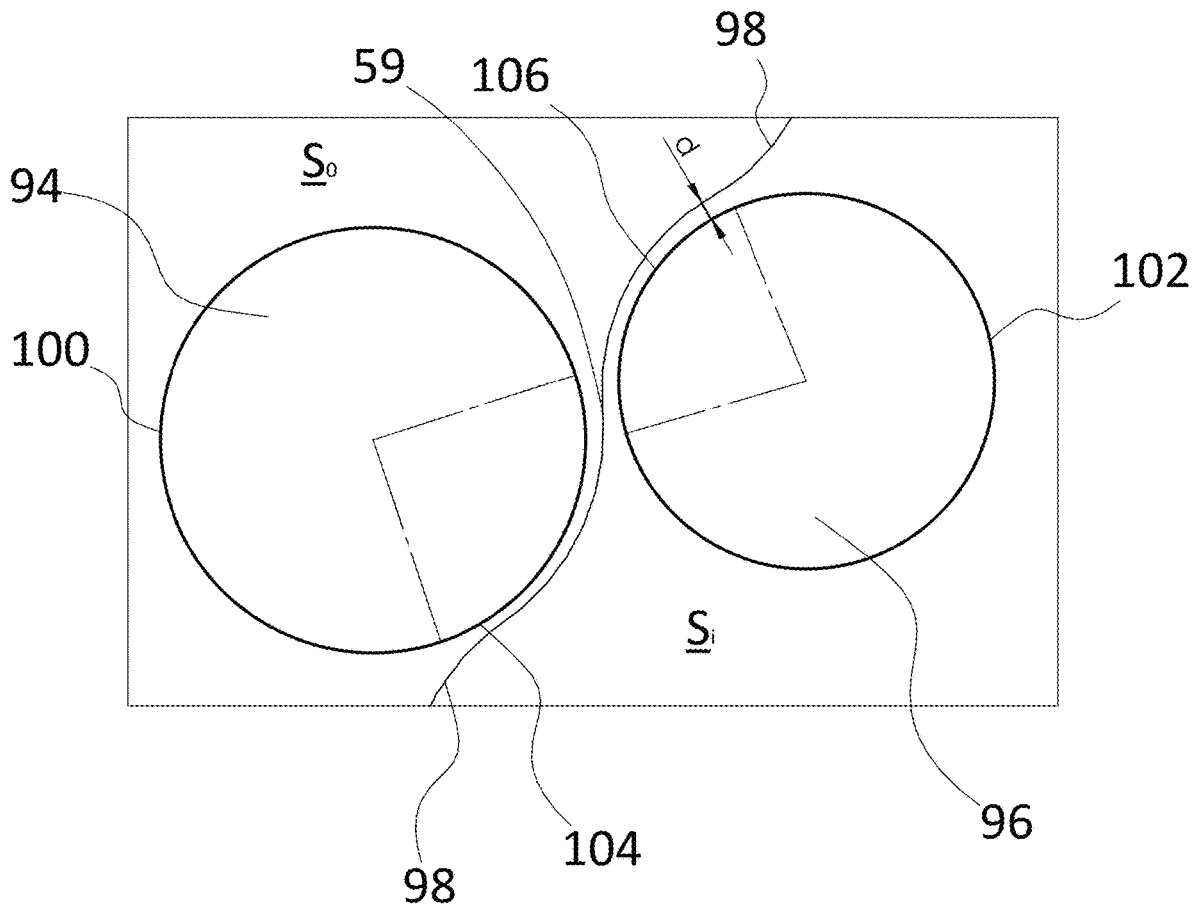
FIG. 30 illustrates an embodiment of the present invention where the dimples follow the shape of the perimeter of the subsurface.

Referring now to FIG. 30, an embodiment of the dimples 94, 96 provided on the exterior surface $S_0$ and subsurface $S_i$ adjacent the subsurface perimeter 98 is illustrated. The dimples 96 provided on the subsurface $S_i$ follow the shape of the perimeter 98 of the subsurface $S_i$. The dimples 94, 96 have dimple perimeters 100, 102. Preferably, for a particular dimple to follow the shape of the subsurface perimeter 98 of the subsurface $S_i$, at least 20 percent of the dimple perimeter 102 is within about 0.010 inches of the subsurface $S_i$ perimeter 98. On a given subsurface $S_i$ at least three dimples should follow the shape of the subsurface $S_i$ perimeter 98. For the purposes of this definition, the subsurface $S_i$ perimeter 98 begins whenever the transition from the subsurface $S_i$ to the adjacent surface begins. FIG. 30 shows an example of a subsurface $S_i$ with a first perimeter 98. A first dimple 94 with a circumference $C_1$ equal to $\pi D_1$ and a second dimple 96 with a circumference $C_2$ equal to $\pi D_2$ where $D_1$ and $D_2$ are the dimple 94, 96 diameters. The distance d from the dimple perimeter can be determined for all points along the dimple perimeter 100, 102. FIG. 30 shows a first arc section 104 with an arc length $x_1$ that is less than or equal to about 0.010 inches from the subsurface perimeter 98, and a second arc section 106 with an arc length $x_2$ that is less than or equal to about 0.010 inches from the subsurface perimeter 98. By definition, the first dimple 94 and the second dimple 96 follow the shape of the subsurface $S_i$ perimeter 98 if $x_1/C_1$ and $x_2/C_2$ are greater than or equal to about 0.20.

It will be appreciated that subsurface $S_i$ is defined as all three dimensional surfaces of the golf ball 52 that are located at a depth $\delta_i$ from the exterior surface $S_0$ of the golf ball 52, and are not a dimple. A subsurface may or may not contain multiple sectors 74 that together make up the subsurface. For example, the pentagonal dipyramids in FIGS. 1-7 and 8-14 contain a single sector within each spherical section 50 used to define the golf ball pattern such that ten sectors make up the subsurface $S_1$. To be considered a subsurface, all sectors defining a subsurface will include at least two dimples located solely on that subsurface.

Preferably, the golf ball 52 should be defined such that the exterior surface $S_0$ of the golf ball 52 should be connected and not part of multiple sectors 74, and the exterior surface $S_0$ should always be nearly spherical with a nearly equal radius at all points.

A preferred embodiment does not allow for the core 46 to pass through the cover 48, so given a cover thickness t:

$$t > \sum_{i=1}^{n} \delta_i + \max(CD_n)$$

Where the number of subsurfaces is equal to n, and $\max(CD_n)$ is the maximum chord depth from the set of dimples on the $n^{th}$ subsurface. Preferably, the thickness of the cover t is about 0.02 to about 0.130 inches.

Preferably, the exterior surface $S_0$ has a dimple coverage of about 70% to about 90% and any subsurfaces $S_i$ have dimple coverages of about 50% to about 90%. It will be appreciated that the exterior surface $S_0$ and any subsurfaces $S_i$ may be packed with any desired number of dimples that will fit within the space and that those dimples may be any size or shape. Preferably, the dimples have diameters from about 0.090 to about 0.210 inches. Additionally, the dimples preferably have depths from about 0.004 to about 0.015 inches as measured from the phantom ball surface of the ball to the bottom of the dimple as is commonly known in the art as surface depth.

It will be appreciated that any kind of dimples may be provided on the exterior surface $S_0$ and any subsurfaces $S_i$. There are no limitations to the dimple shapes or profiles selected to pack the spherical sections 50. Though the present invention includes substantially circular dimples in some embodiments, dimples or protrusions (brambles) having any desired characteristics and/or properties may be used. For example, in one embodiment the dimples may have a variety of shapes and sizes including different depths and perimeters. In particular, the dimples may be concave hemispheres, or they may be triangular, square, hexagonal, catenary, polygonal or any other shape known to those skilled in the art. They may also have straight, curved, or sloped edges or sides. To summarize, any type of dimple or protrusion (bramble) known to those skilled in the art may be used with the present invention. The dimples may all fit within each spherical section 50, or dimples may be shared between one or more spherical sections 50, so long as the dimple arrangement on each independent spherical section 50 remains consistent across all copies of that spherical section 50 on the outer surface 54 of a particular golf ball 52.

In other embodiments, the spherical sections 50 may not be packed with dimples, and the borders of the exterior surface $S_0$ and subsurfaces $S_i$ may instead comprise ridges or channels.

Figure 31:
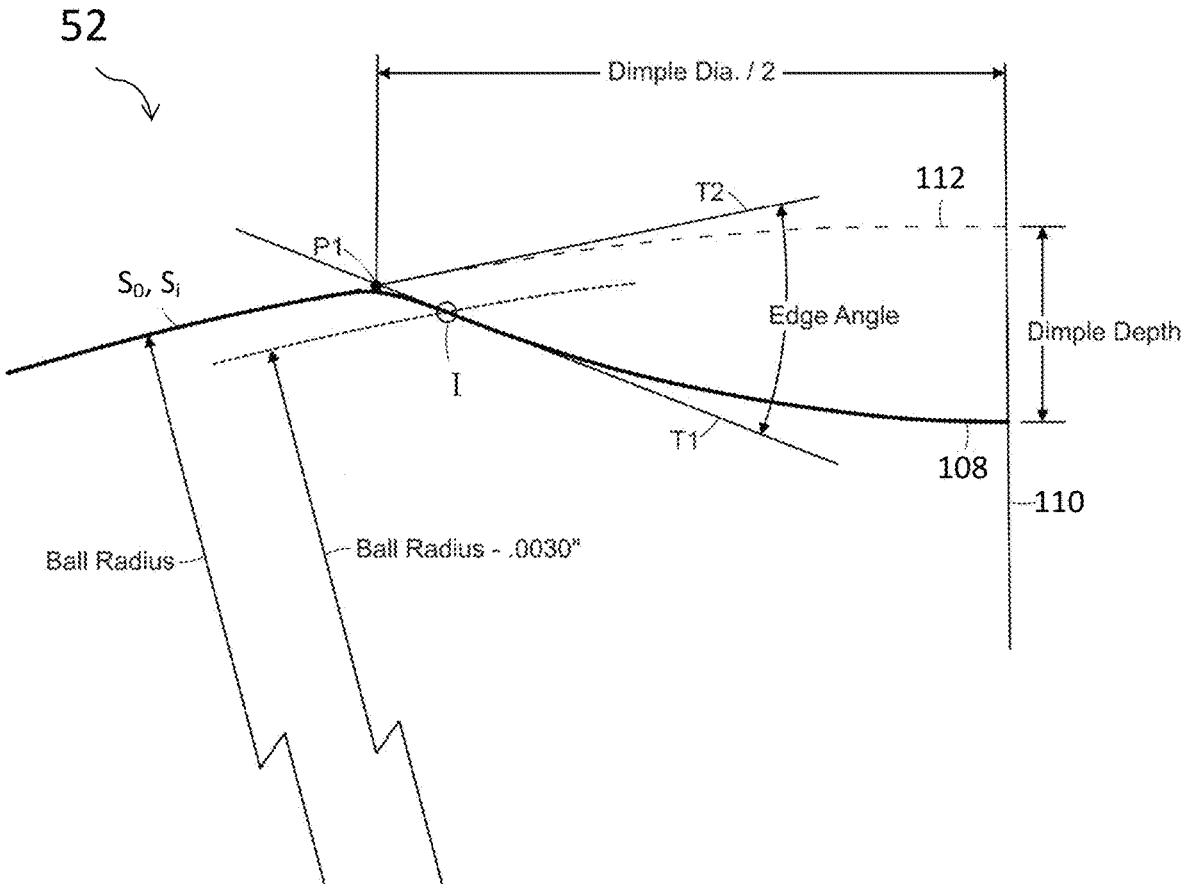
FIG. 31 is a partial sectional view of a dimple of a finished ball including layers of paint and a clear coat.

It will be appreciated that all measurements described herein are made on a finished golf ball. Turning to FIG. 31, golf ball 52 is shown as a finished ball including layers of paint and clear coat which creates a varied curvature at the demarcation between exterior surface or subsurface $S_0$, $S_i$ and dimple wall 108. It will be appreciated that FIG. 31 shows a half dimple up to the dimple centerline 110. This curvature makes the location of the dimple edge indistinct. In this case, the edge angle $\Phi$ is defined to be the angle between tangents T1 and T2. T1 is the tangent to the dimple wall 108 at the inflection point I. T2 is the tangent to the ball periphery surface 112 at point P1 which is the intersection of T2 and periphery surface 112.

Figure 32:
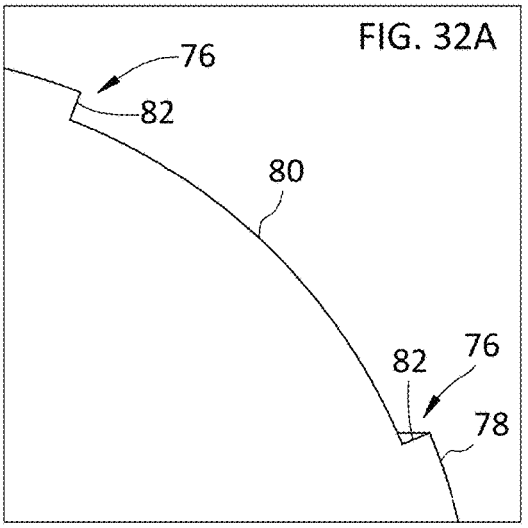
FIG. 32A illustrates a profile view of the transition zone between the different surfaces of the present invention.
FIG. 32B illustrates a profile view of the transition zone between the different surfaces of the present invention.
FIG. 32C illustrates a profile view of the transition zone between the different surfaces of the present invention.
FIG. 32D illustrates a profile view of the transition zone between the different surfaces of the present invention.
FIG. 32E illustrates a profile view of the transition zone between the different surfaces of the present invention.
FIG. 32F illustrates a profile view of the transition zone between the different surfaces of the present invention.
Figure 32:
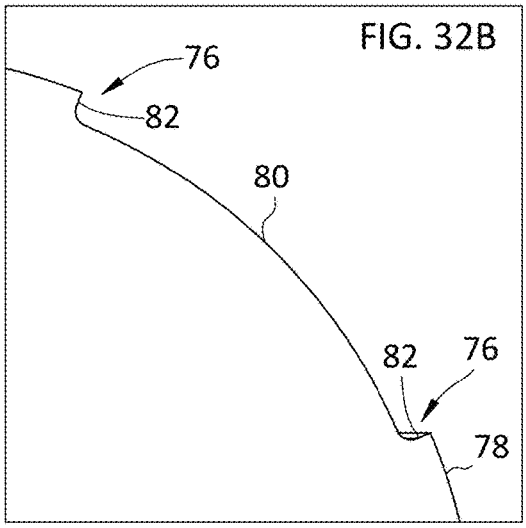
Figure 32:
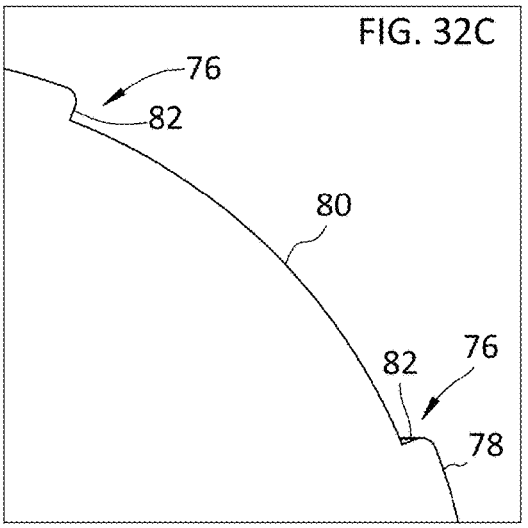
Figure 32:
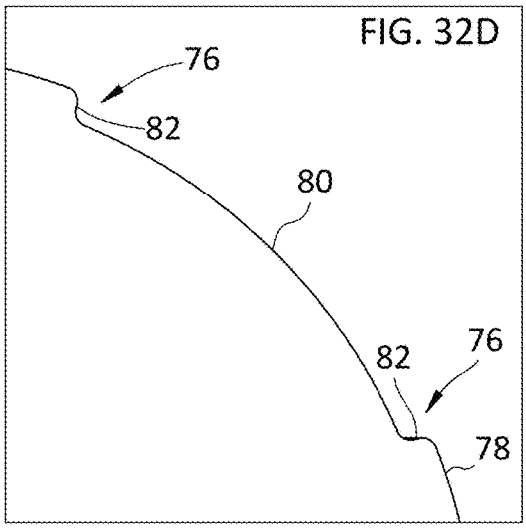
Figure 32:
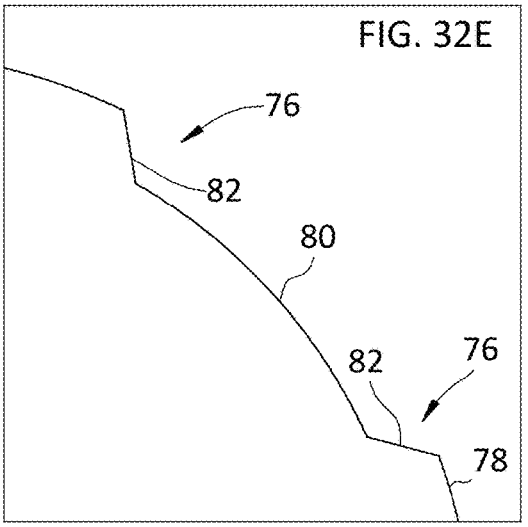
Figure 32:
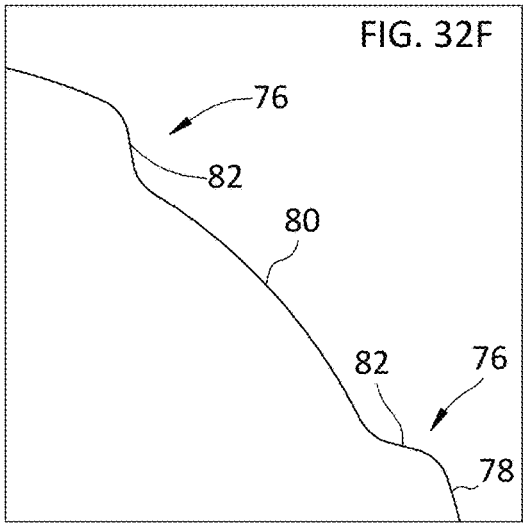

FIGS. 32A-32F illustrate profile views showing the transition zones 76 between a representative first surface 78 and second surface 80 with a transition wall 82 therebetween. The representative surfaces 78 and 80 may be the exterior surface $S_0$, the first subsurface $S_1$, the second subsurface $S_2$ or any other subsurface. FIG. 32A illustrates transition zones 76 having sharp right angles between the first surface 78 and the transition wall 82 and the second surface 80 and the transition wall 82. FIG. 32B illustrates the transition zones 76 between the first surface 78 and the transition wall 82 having a sharp angle and the transition zone 76 between the second surface 80 and the transition wall 82 being curved. FIG. 32C illustrates the transition zones 76 between the first surface 78 and the transition wall 82 being curved and the transition zone 76 between the second surface 80 and the transition wall 82 having a right angle. FIG. 32D illustrates both the transition zones 76 connecting the first surface 78 to the transition wall 82 and the second surface 80 to the transition wall 82 being curved. FIG. 32E illustrates the transition zones 76 between the first and second surfaces 78 and 80 and the transition wall 82 being sharp angles and the transition wall 82 being an angled surface between the first and second surfaces 78 and 80. Finally, FIG. 32F illustrates the transition zones 76 between the first and second surfaces 78 and 80 and the transition wall 82 being curved and the transition wall 82 being angled between the first and second surfaces 78 and 80. It will be appreciated that the transition zones 76 may have any combination of angled, curved or other shaped surfaces to connect the representative first and second surfaces 78 and 80 to each other.

Figure 33:
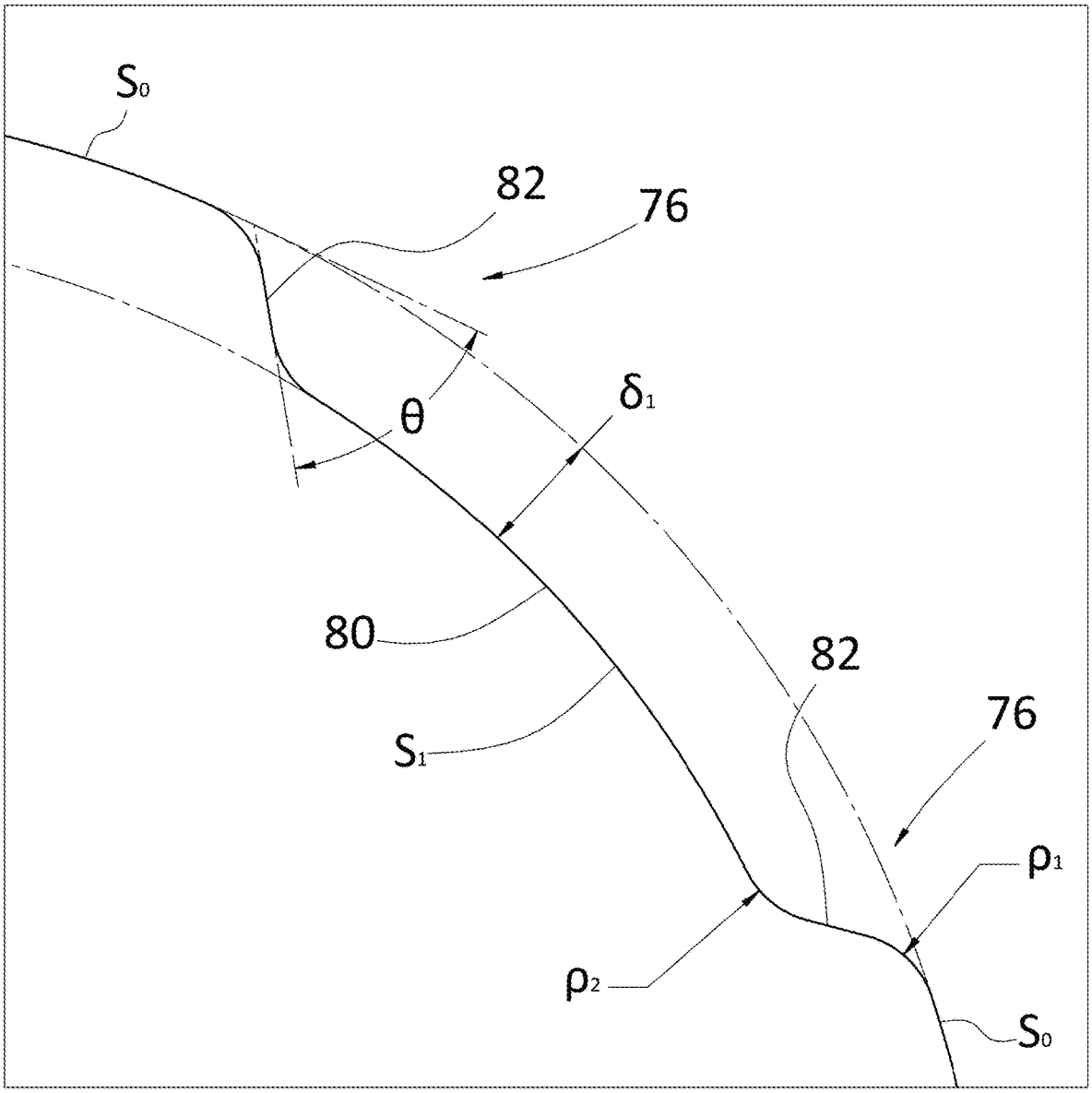
FIG. 33 illustrates a detailed view of an embodiment of the transition zone of the present invention.

More particularly, as shown in FIG. 33, in a preferred embodiment the transition zone 76 between the exterior surface $S_0$ to the subsurface $S_1$ is shown. In this embodiment there is a top or first radius, $\rho_1$, leading from the exterior surface $S_0$ to the transition wall 82 and a bottom or second radius, $\rho_2$, between the transition wall 82 and the subsurface $S_1$. The values of these radii (in inches) are preferably as follows:

$$0.001 \leq \rho_1 \leq 0.010$$

$$0.001 \leq \rho_2 \leq 0.016$$

The transition wall 82 may additionally form an angle of transition θ with the exterior surface $S_0$ between about 10° and about 90° as shown in FIGS. 32A-32F. More preferably, and this angle is between about 30° and about 60°. It will be appreciated that the first radius $\rho_1$ may differ from the second radius $\rho_2$.

Figure 34A:
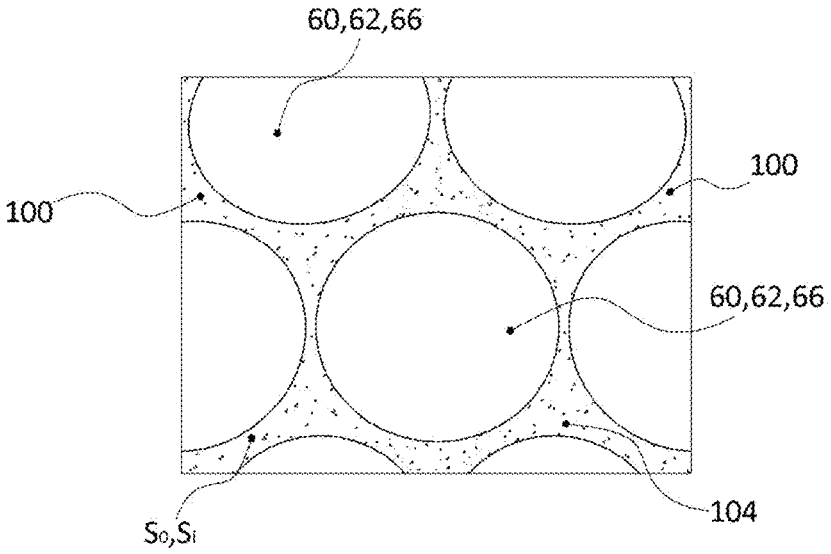
FIG. 34A illustrates a detailed view of an embodiment of the present invention showing a surface having a surface texture on the frets.
Figure 34B:
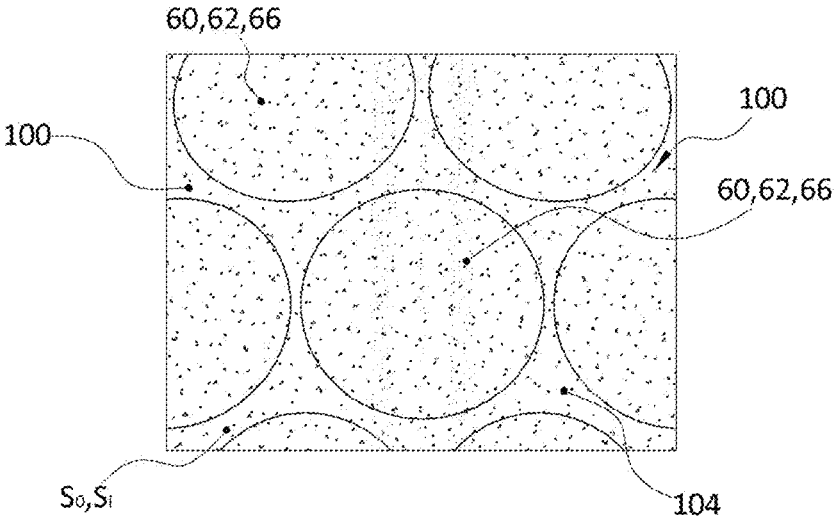
FIG. 34B illustrates a detailed view of an embodiment of the present invention showing a surface having a surface texture on the frets and dimples.
Figure 35A:
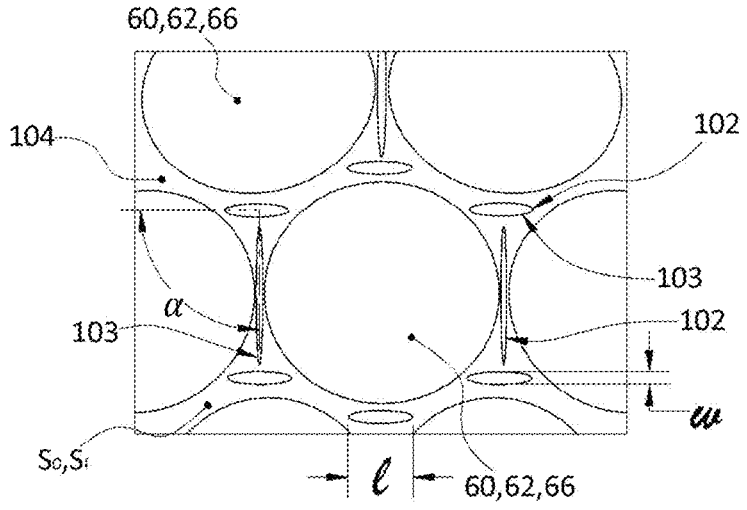
FIG. 35A illustrates a detailed view of an embodiment of the present invention showing a surface having an alternative surface texture on the frets.
Figure 35B:
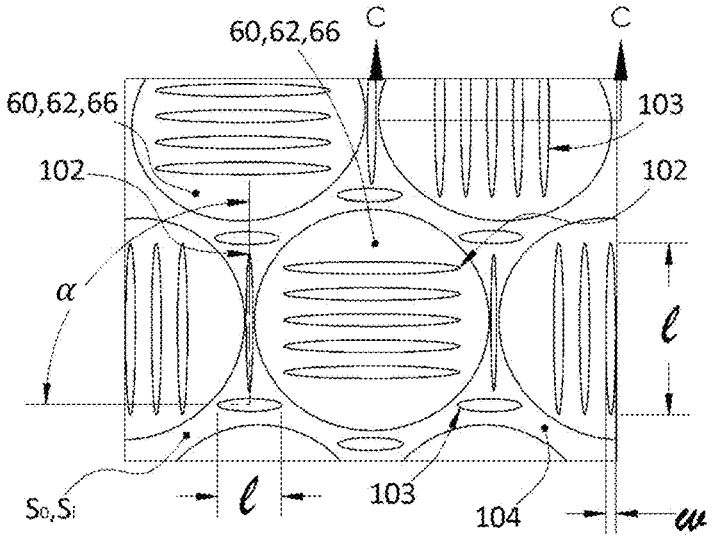
FIG. 35B illustrates a detailed view of an embodiment of the present invention showing a surface having an alternative surface texture on the frets and dimples.
Figure 35C:
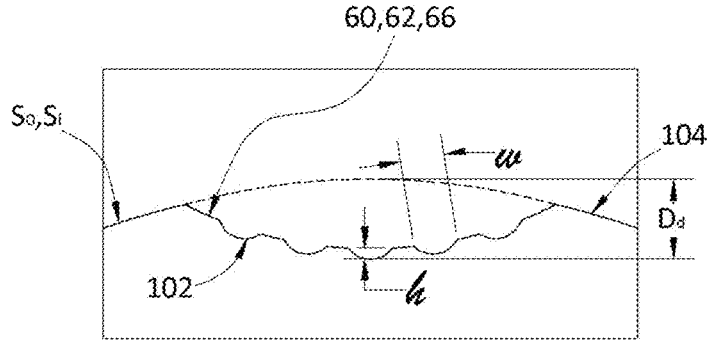
FIG. 35C illustrates a cross-sectional view taken along line C-C in FIG. 35B.

In another embodiment shown in FIGS. 34-35C, surface features 100, 102 may be applied to either the frets 104 or dimples 60, 62, 66 or both of any exterior surface $S_0$ or subsurface $S_i$. As is understood in the art, frets 104 are the surfaces on a golf ball that reside between the dimples. The frets 104 and the dimples 60, 62, 66 of the exterior surface $S_0$ and each subsurface $S_i$ have a first surface texture and second texture and possibly a third surface texture 106, 108, 110. This surface texture may be a substantially smooth surface or may include a surface feature 100, 102 or increased surface roughness.

The surface texture 106, 108, 110 surface roughness may be measured. A common measure of roughness in surface finish is average roughness, Ra. Ra, also known as Arithmetic Average (AA) and Center Line Average (CLA), is a measure of the distance from the peaks and valleys to the center line or mean. It is calculated as the integral of the absolute value of the roughness profile height over the evaluation length:

$$Ra = \frac{1}{L}\int_0^L |r(x)dx|$$

where Ra is the average roughness and L is the evaluation length.

A substantially smooth surface, as defined by the invention, has an average surface roughness (Ra) less than about 5 microns, while a substantially not smooth surface, as defined by the invention, has an average surface roughness (Ra) greater than about 5 microns. A first surface texture 106, 108, 110 may be different than another surface texture 106, 108, 110 by having a different surface feature 100, 102 or by being a substantially smooth surface or a substantially not smooth surface, as described above with regard to surface roughness. Moreover, it will be appreciated that a first surface texture 106 may also be different than a second surface texture 108 by having a difference in average surface roughness (Ra) of at least about 5 microns.

Any surface features 100, 102 according to the present invention may be created using a number of different methods. For example, surface features 100, 102 may be created using sand blasting or shot peening. Machining marks may also be intentionally machined into the exterior surface $S_0$ or subsurface $S_i$ to leave a surface feature 100, 102, such as a groove, in the surface. Preferably, the exterior surface $S_0$ or subsurface $S_i$ may be roughened with a Computer Numerically Controlled (CNC) mill. Additionally, it will be appreciated that different surface features 100, 102 may be accomplished using varied settings on an EDM (electric discharge machine). It will also be appreciated that the surface features 100, 102 may be created as described in U.S. application Ser. No. 14/476,843, incorporated by reference herein in its entirety.

It will be appreciated that either dimples 60, 62, 66 or frets 104 may have a surface feature 100, 102 according to the invention. FIGS. 34A-B show examples of either frets 104 or dimples 60, 62, 66 having a sandblasted surface feature 100. It will be appreciated that the sandblasted surface may have random shapes and patterns. Alternatively, FIGS. 35A-B show examples of frets 104 or dimples 60, 62, 66 having machined grooves to create the surface feature 102. It will be appreciated that the machined grooves 102 may have particularly defined shapes and sizes and be placed as desired on the exterior surface $S_0$ or subsurface $S_i$. Alternatively, the machined grooves 102 may be randomly created.

Moreover, it will be appreciated that the surface features 100, 102 may be added at various stages of processing. In one embodiment, a tooling hob or cavities are made with the surface features 100, 102 on the desired exterior surface $S_0$ and/or subsurface $S_i$. The balls 52 molded from the cavities result in the different surface features 100, 102 being applied to the exterior surface $S_0$ or subsurfaces $S_i$. Thus, the first surface texture 106 and the second surface texture 108 are created on one or more of the frets 104 and/or dimples 60, 62, 66 of the exterior surface $S_0$ and subsurface $S_i$ such that the first surface texture 106 is different than the second surface texture 108.

Alternatively, a ball 52 may be molded and a surface feature may be applied as a post processing step. For example, part of the ball 52 may be masked, such as an exterior surface $S_0$ or subsurface $S_i$, and/or including the dimples 60, 62, 66 or frets 104 of either surface $S_0$, $S_i$, and then the ball 52 may be sandblasted. In another embodiment, the exterior surface $S_0$ or subsurface $S_i$ or a part thereof may be ground with a particular surface feature 100, 102.

U.S. Pat. No. 9,302,155 is incorporated by reference herein in its entirety and discloses golf balls having dimples with directional surface texturing. Although the dimples may have different diameters, they include linear channels or protrusions. According to the present invention, a golf ball 52 has an exterior surface $S_0$ and a subsurface $S_i$ comprising a plurality of dimples 60, 62, 66 and frets 104. Preferably, dimples 60, 62, 66 cover greater than 70 percent of the exterior surface $S_0$ or subsurface $S_i$ and at least 20 percent of the dimples 60, 62, 66 incorporate directional surface texturing. Directional surface texturing is defined as a plurality of indentations or protrusions that form aligned arrangements within the dimple 60, 62, 66. The dimple depth, volume and edge angles of the dimples 60, 62, 66 are measured as set forth in U.S. Pat. No. 7,226,369, as shown in FIG. 7 and discussed in col. 11, line 64 through, col. 12, line 46, which is incorporated by reference herein in its entirety.

It will be appreciated that the surface features 100, 102 are relatively small in comparison to the dimple 60, 62, 66 and are intended as a secondary aerodynamic function as discuss below. For example, as shown in FIG. 35C, preferably the linear channels 102 have a linear channel perimeter 103 and a maximum channel height h of less than ¼ of a dimple depth $D_d$. Linear protrusions 102 within a dimple would be the inverse of the linear channels 102 shown. More preferably, the directional surface texturing height h is less than about 0.002 inches. Also, the directional surface texturing has a width, such as the channel width w shown, that is equal to or greater than the height h, and preferably greater than about twice the height h. Further, the length l between the directional surface texturing is preferably equal to or greater than the width w. More preferably, the length l is greater than twice the width w. FIG. 35C illustrates linear channel 102 having a substantially U-shaped cross-section; however, it will be appreciated that the cross-section of the linear channels 102 may be V-shaped, rectangular or other partial polygonal shape or any continuous curve. Examples of such curves include those defined by superposed curves such as those described in U.S. Publication No. 2012/0165130, incorporated herein by reference in its entirety. Further, the directional surface texturing is substantially elongated. The lengths l of the directional surface texturing elements 102 are most preferably greater than 5 times the widths w and extend substantially across the dimples 60, 62, 66.

If a dimple 60, 62, 66 is about 0.15 inches, the directional surface texturing in the center of the dimple 60, 62, 66 preferably has a length of at least 0.1 inch, and more preferably, about 0.11-0.13 inch. The same directional surface texturing preferably has a width w of less than about 0.02 inch. Similarly, smaller dimples 60, 62, 66 having a diameter of about 0.11 inch may have directional surface texturing with a length l of about 0.08 to 0.09 inch.

It will also be appreciated that at least two linear channels or protrusions 102 of the surface texture 106, 108, 110 may be substantially parallel to one another. Alternatively, the at least two linear channels or protrusions 102 may be disposed at an angle $\alpha$ of about 30 to about 90 degrees with respect to each other. Alternatively to linear channels or protrusions, it will be appreciated that the surface feature 100, 102 may comprise a repeating shape having a perimeter 103 that may consist of circular or regular polygon shapes.

Figure 36:
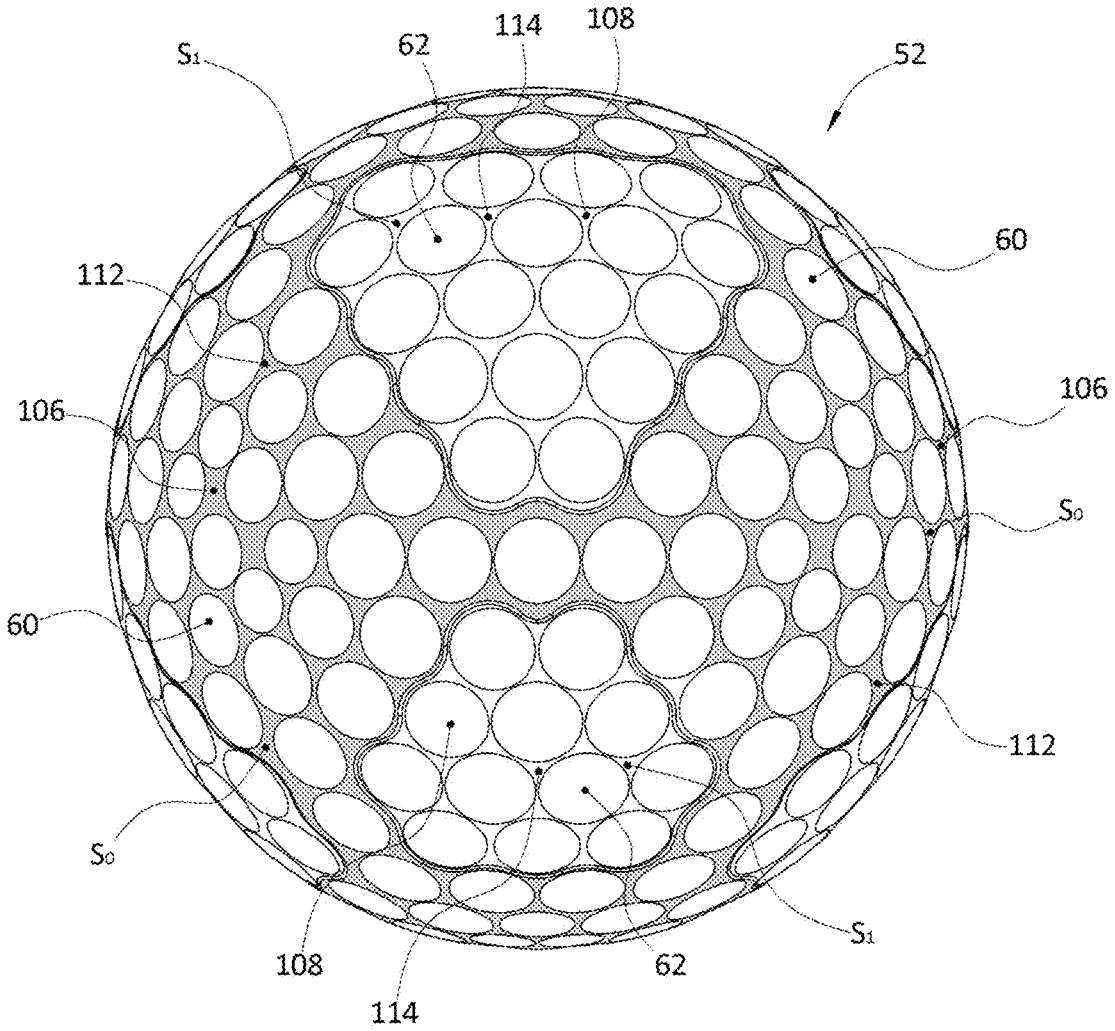
FIG. 36 illustrates an embodiment of the present invention where the exterior surface is shaded showing where the surface texture of FIGS. 34 and 35 may be applied.

Referring now to FIG. 36, the exterior surface $S_0$ has a first surface texture 106 (shown as shading) and the first subsurface $S_1$ has a second surface texture 108 different than the first surface texture 106. It will be appreciated that the first and second surface textures 106, 108 may be substantially smooth or substantially not smooth so long as the surface textures are different. Moreover, as explained above, the first and second surface textures 106, 108 may also be different surface features 100, 102 and/or have a difference in average surface roughness (Ra) of at least 5 microns and be considered different than one another. Thus, the surface textures 106, 108 may be different by being substantially smooth versus not substantially smooth or they may have a different surface feature 100, 102 or a difference in average surface roughness (Ra) of at least 5 microns. Thus, the surface textures 106, 108 may be substantially smooth or have any desired surface feature 100, 102 and may be made by any known method. One method of measuring the surface texture is to measure the average surface roughness as described above. It will be appreciated that according to the invention, a substantially smooth surface will have an average surface roughness of less than 30 Ra. Conversely, a substantially not smooth surface will have an average surface roughness of greater than 30 Ra. As shown in FIG. 36, the surface texture 106 (shown with shading) provided on the exterior surface frets 112 on the exterior surface $S_0$ are different than the first surface texture 108 provided on the first surface frets 114 and first surface dimples 62 on the first subsurface $S_1$. Additionally, it will be appreciated that the exterior surface dimples 60 do not include the first surface texture 106 in this embodiment and may have the same surface texture as the second surface texture 108 on the first subsurface $S_1$. Preferably, the first surface texture 106 on the exterior frets 112 of the exterior surface $S_0$ is substantially not smooth, while the second surface texture 108 on the first subsurface $S_1$, including first subsurface frets 114 and first subsurface dimples 62, is substantially smooth according to the present invention.

Figure 37:
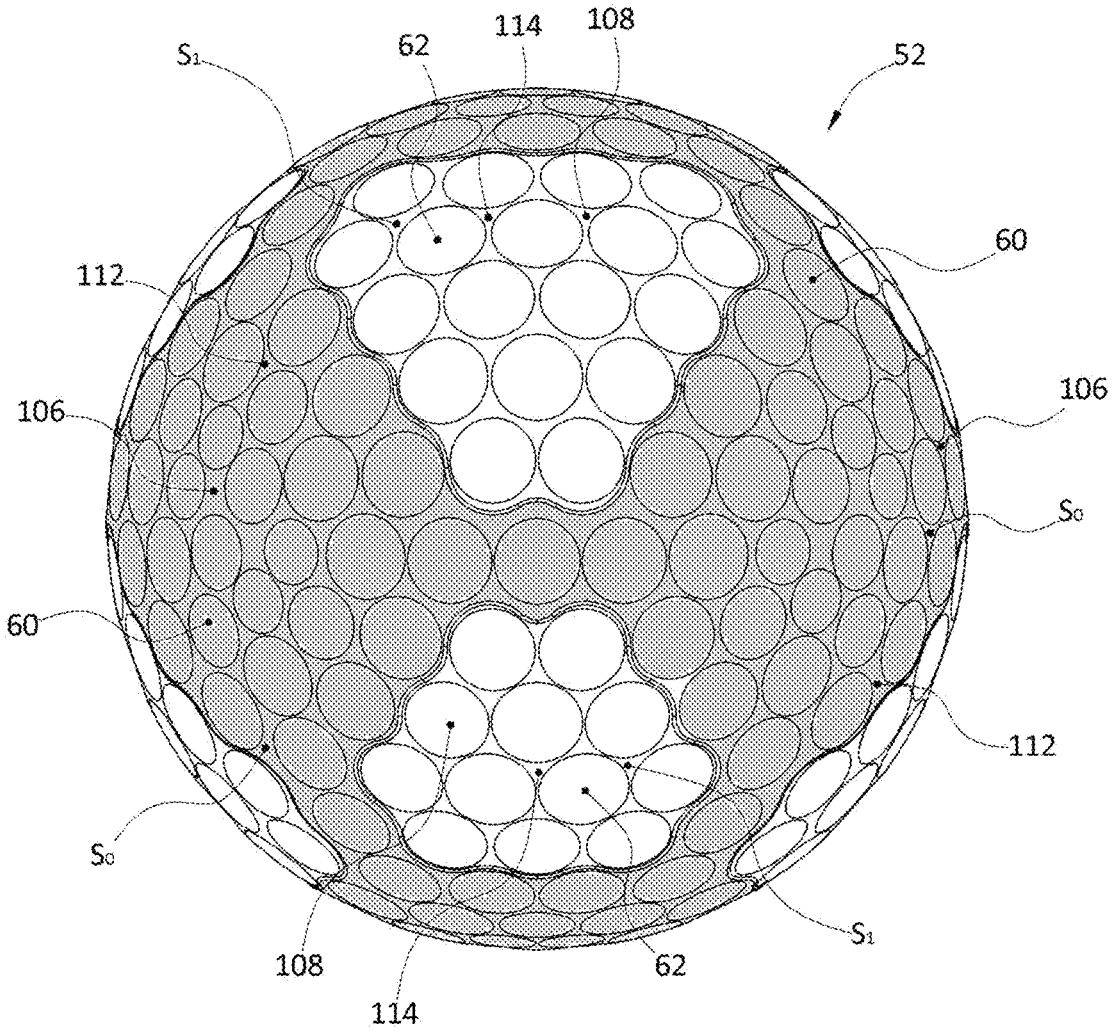
FIG. 37 illustrates another embodiment of the present invention where the exterior surface and dimples provided on the exterior surface are shaded showing where the surface texture may be applied.

Referring now to FIG. 37, the exterior surface $S_0$ has exterior surface frets 112 and exterior surface dimples 60 and both include the first surface texture 106 (shown with shading). The first subsurface frets 114 and first subsurface dimples 62 on the first subsurface $S_1$ include the second surface texture 108. Preferably, in this embodiment the first surface texture 106 on the exterior surface $S_0$, including the exterior surface frets 112 and exterior surface dimples 60, is substantially not smooth and the second surface texture 108 on the first subsurface $S_1$, including the first subsurface frets 114 and first subsurface dimples 62, is substantially smooth according to the present invention.

Figure 38:
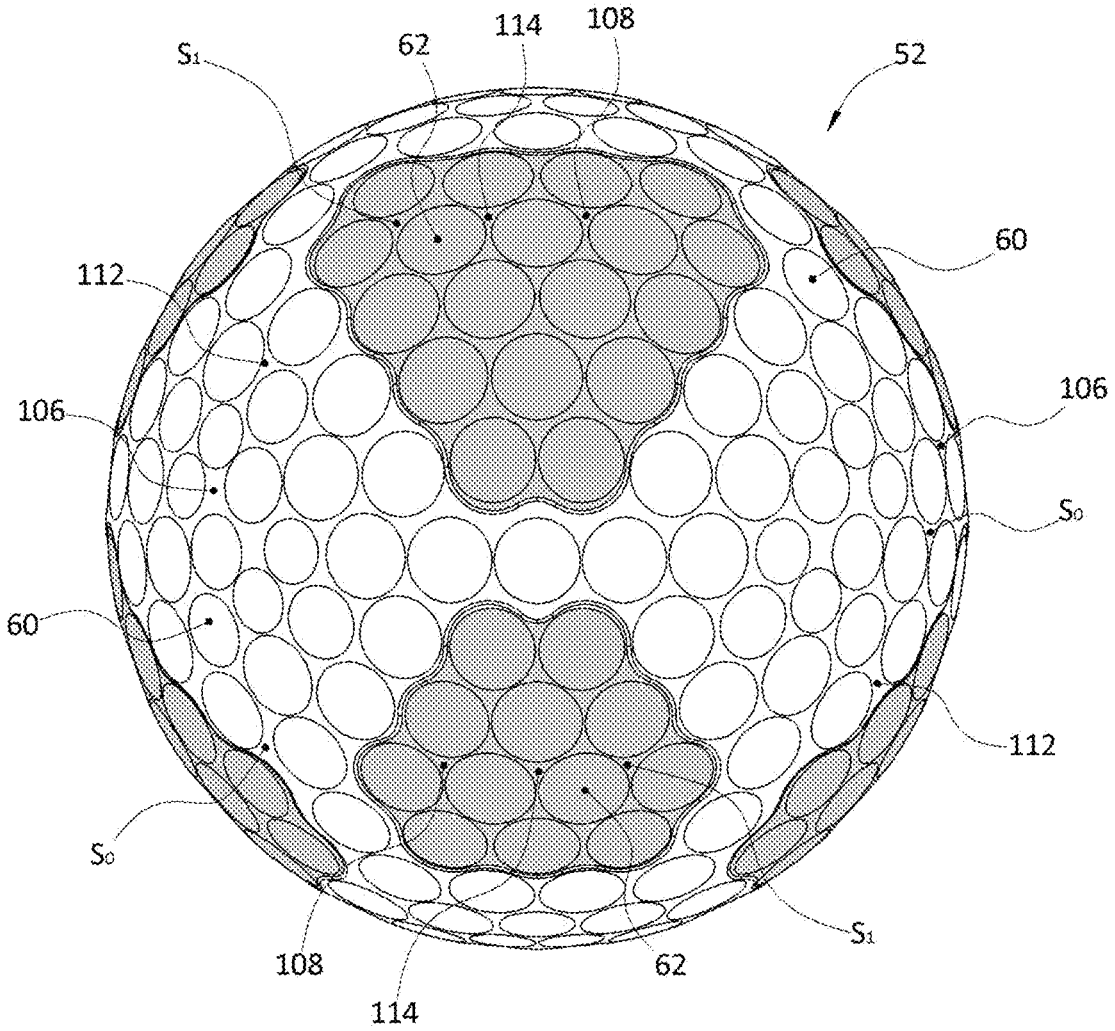
FIG. 38 illustrates another embodiment of the present invention where the subsurface is shaded showing where the surface texture may be applied.

Now referring to FIG. 38, the exterior surface $S_0$ has the first surface texture 106 on the exterior surface frets 112 and exterior surface dimples 60. The first subsurface $S_1$ has the second surface texture 108 (shown with shading) on the first subsurface frets 114 and first subsurface dimples 62. Preferably in this embodiment, the first surface texture 106 is substantially smooth and the second surface texture is substantially not smooth.

Figure 39:
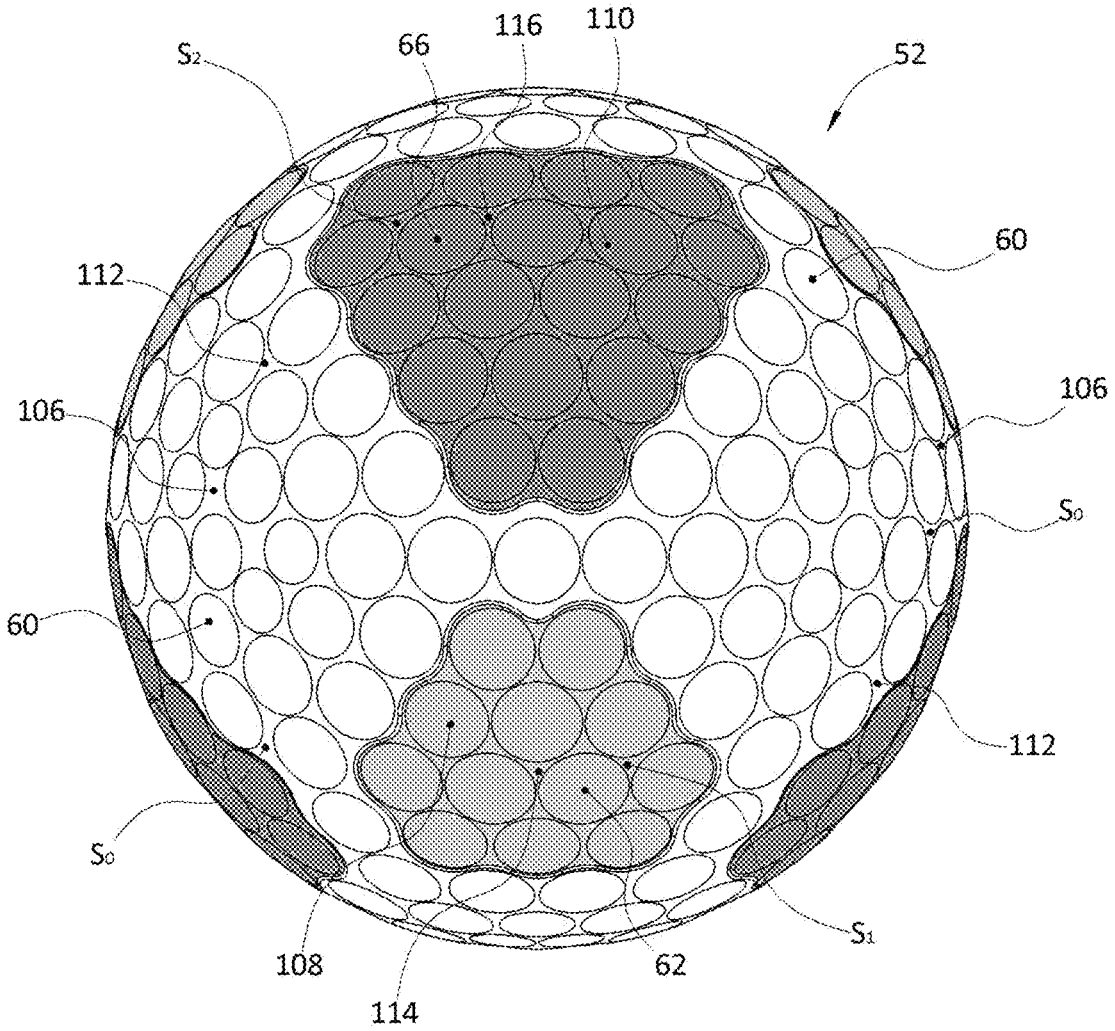
FIG. 39 illustrates another embodiment of the present invention where the subsurface and subsurface dimples are shaded showing where the surface texture may be applied.

Now referring to FIG. 39, the exterior surface $S_0$ has a first surface texture 106 provided on the exterior frets 112 and exterior surface dimples 60. The first subsurface $S_1$ has a second surface texture 108 (shown with lighter shading) being provided on the first subsurface frets 114 and first subsurface dimples 62. A second subsurface $S_2$ is provided having a third surface texture 110 (shown with darker shading) provided on second subsurface frets 116 and second subsurface dimples 66. Preferably, the first surface texture 106, second surface texture 108 and third surface texture 116 are each different from each other. In another embodiment, at least two of a first, second and third surface textures 106, 108, 110 are the same and the other surface texture is different. According to the embodiment shown in FIG. 39, the first surface texture 106 is substantially smooth, and the second and third surface textures 108, 110, while different from each other, are not substantially smooth. Moreover, although the surface textures 106, 108, 110 are shown on both the frets 112, 114, 116 and the dimples 60, 62, 66, it will be appreciated that the surface texture 106, 108, 110 may be different on the frets 112, 114, 116 and/or dimples 60, 62, 66 of the surfaces $S_0$, $S_1$, $S_2$.

Figure 40:
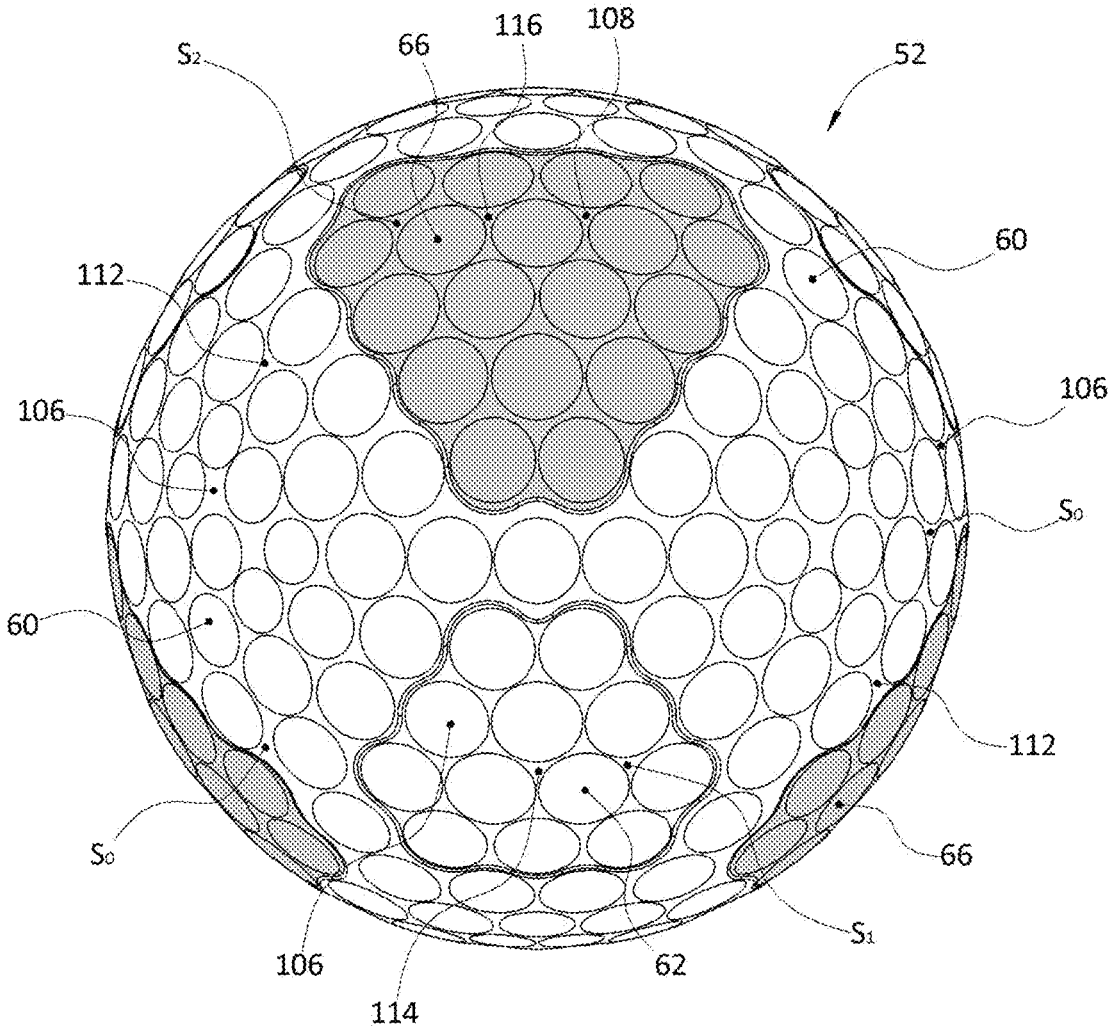
FIG. 40 illustrates another embodiment of the present invention where one subsurface and subsurface dimples are shaded showing where the surface texture may be applied.

FIG. 40 illustrates another embodiment of the present invention. The first surface texture 106 is provided on the exterior surface $S_0$, including the exterior surface frets 112 and exterior dimples 60, and on the first subsurface $S_1$, including the first subsurface frets 114 and first subsurface dimples 62. A second surface texture 108 (shown with shading) is provided on the second subsurface $S_2$, including on the second subsurface frets 116 and second subsurface dimples 66. Preferably, as illustrated, the first surface texture 106 is substantially smooth, while the second surface texture 108 is substantially not smooth.

Referring now to FIGS. 41-47, it will be appreciated that the golf ball 52 exterior surface $S_0$ and subsurfaces $S_i$ may have different colors, including a difference in appearance of the surface, either on the whole or a part of the surface $S_0$, Si. This difference in color may be achieved in a number of different ways as described below.

Figure 41:
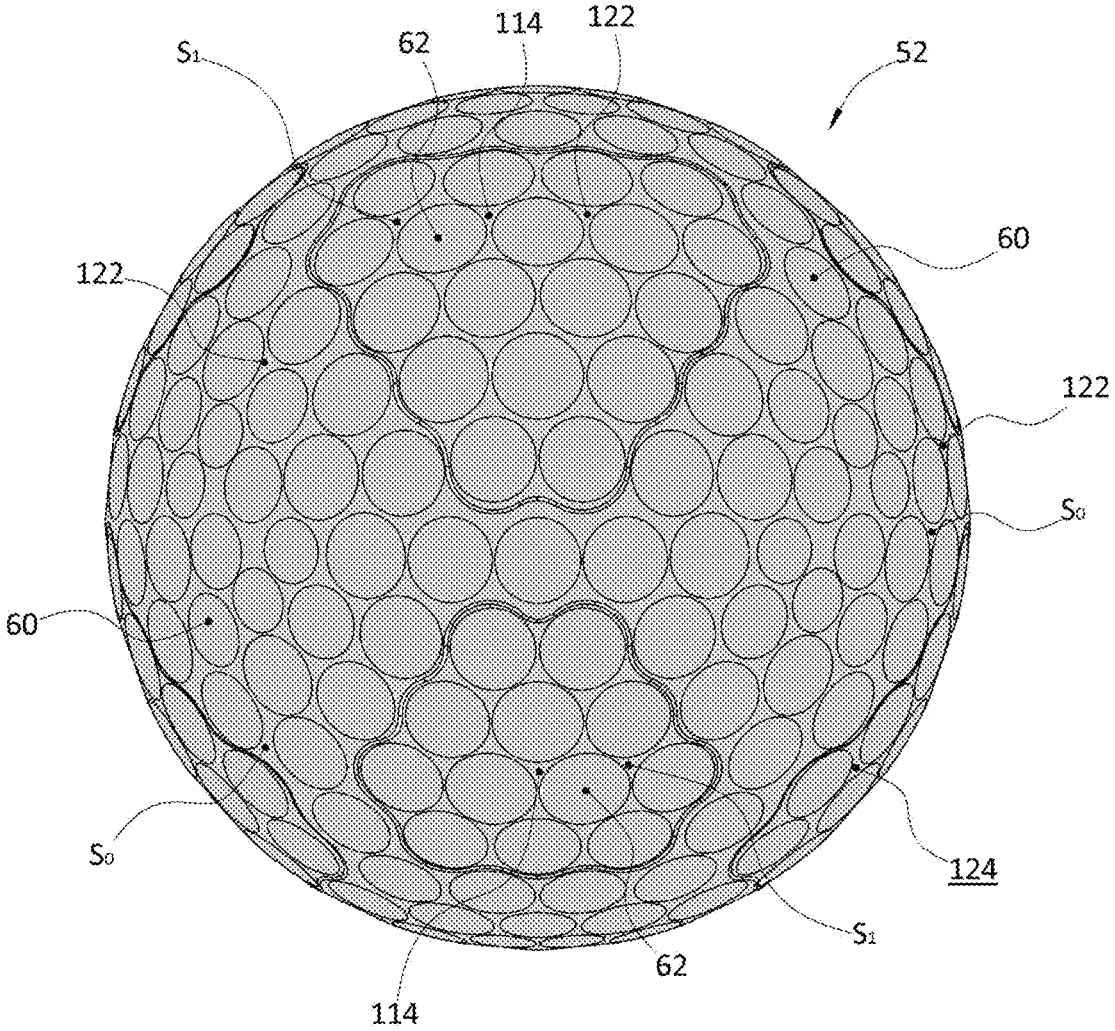
FIG. 41 illustrates an embodiment of the present invention where the exterior surface is has a color according to the present invention.
Figure 42:
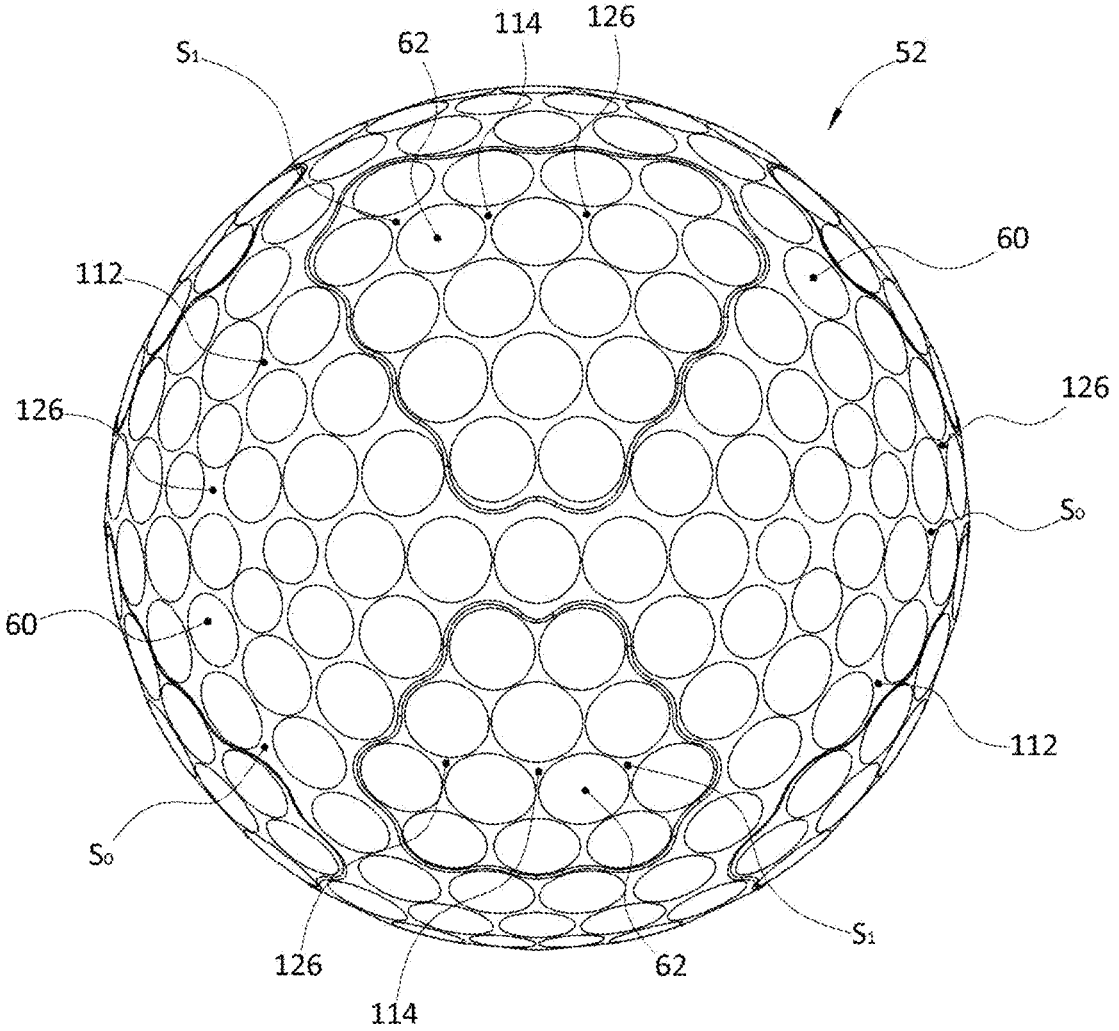
FIG. 42 illustrates another embodiment of the present invention where the exterior surface and subsurface have a painted color according to the present invention.
Figure 43:
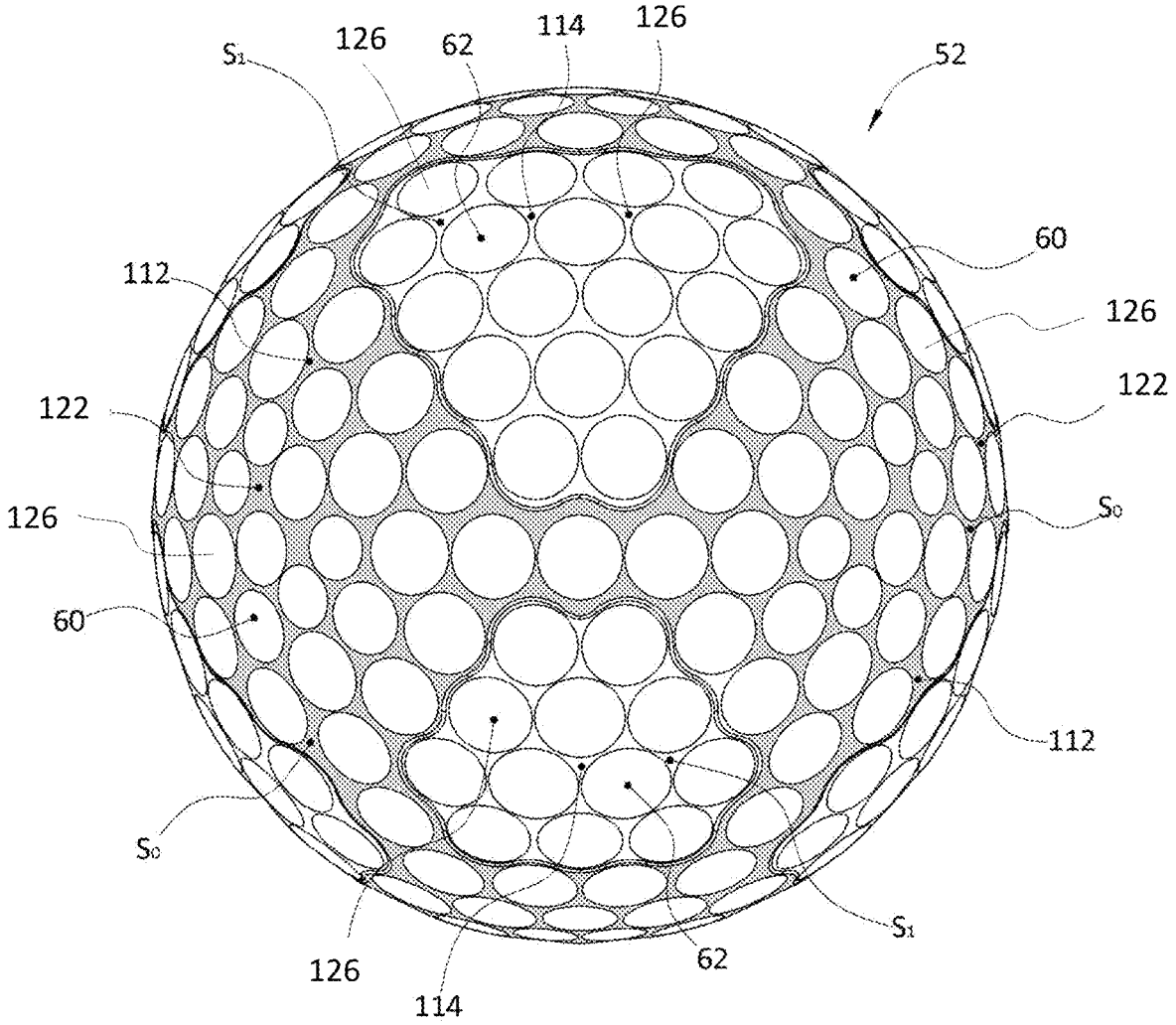
FIG. 43 illustrates another embodiment of the present invention where the exterior surface comprises a color different than the first subsurface according to the present invention.

As shown in FIG. 41, the exterior surface $S_0$ has a first color 122 (shown with shading). This golf ball 52 is preferably molded or cast using a cover 124 of a first color 122. Then, as shown in FIG. 42, the golf ball 52 is taken through a finishing process and painted as is known to those of ordinary skill in the art. The golf ball 52 is painted with a second color 126 that is different than the first color 122. Next, the golf ball 52 may be taken through additional processes to remove certain portions of the second color 126 provided by the paint. For example, as shown in FIG. 43, a centerless grinding technique is used and results in a finished golf ball 52 showing the first color 122 on the exterior surface frets 112 and the second color 126 provided by the paint on the exterior surface dimples 60 of the exterior surface $S_0$, first subsurface frets 114 and first subsurface dimples 62 of the first subsurface $S_1$. Thus, resulting golf ball 52 has an exterior surface $S_0$ having a first color 122 on at least a portion of the exterior surface $S_0$ and a first subsurface $S_1$ having a second color 126 on at least a portion of the first subsurface $S_1$.

Figure 44:
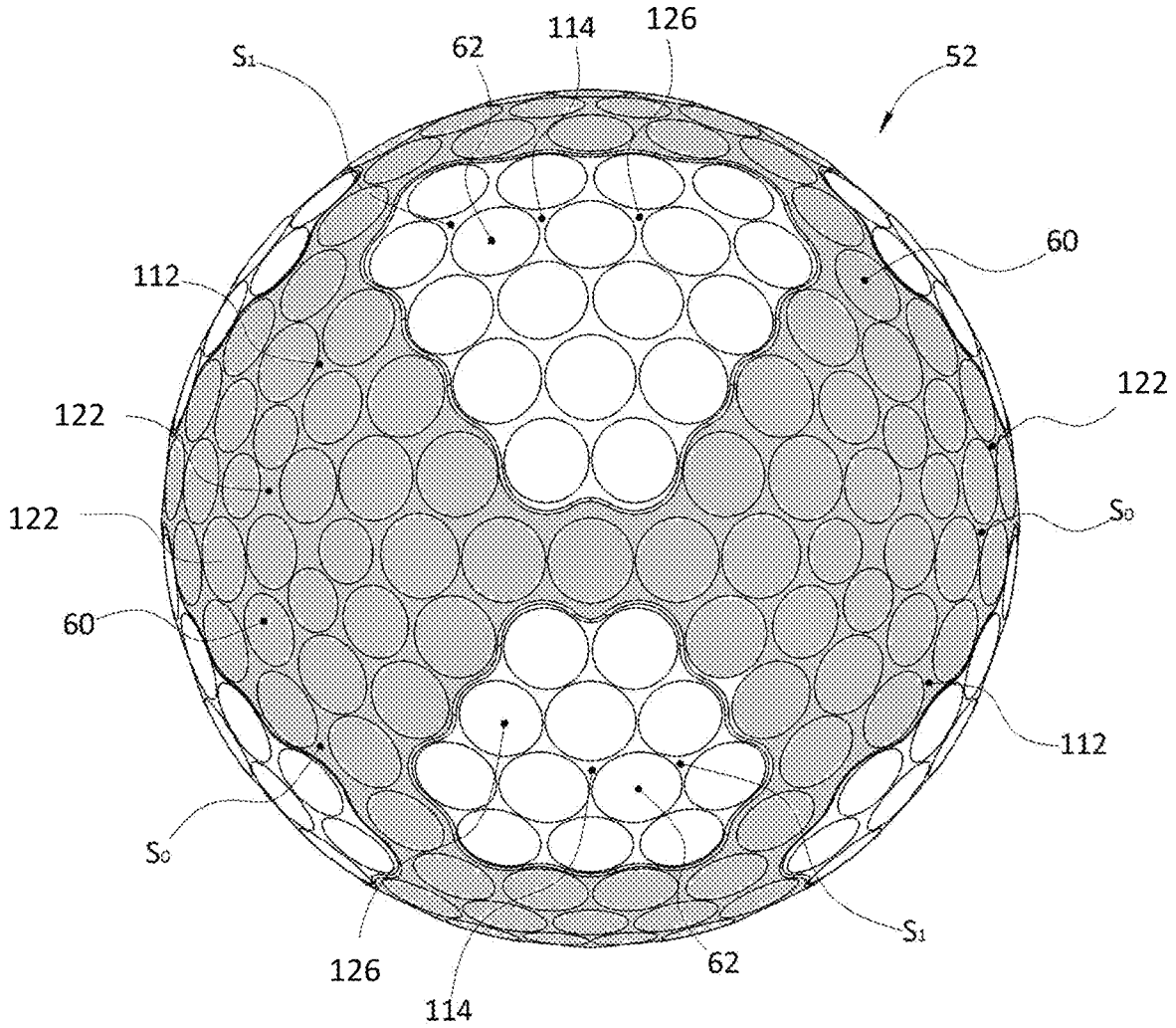
FIG. 44 illustrates another embodiment of the present invention where the exterior surface and subsurface have different colors according to the present invention.

In another embodiment shown in FIG. 44, a mask is provided that covers the subsurfaces $S_i$. The mask is provided on portions of the golf ball 52 as is known to one of ordinary skill in the art. The paint is then removed from all the exterior surface frets 112 and exterior surface dimples 60 by any suitable method, for example by use of pressure blasting. As shown in FIG. 44, the mask is provided on the first subsurface frets 114 and first subsurface dimples 62, then the golf ball 52 is pressure blasted to remove the paint from the remainder of the golf ball 52. The resulting golf ball 52 has an exterior surface $S_0$ with a first color 122 on both the exterior surface frets 112 and exterior surface dimples 60 and a first subsurface $S_1$ having a second color 126 on both first subsurface frets 114 and first subsurface dimples 62.

Figure 45:
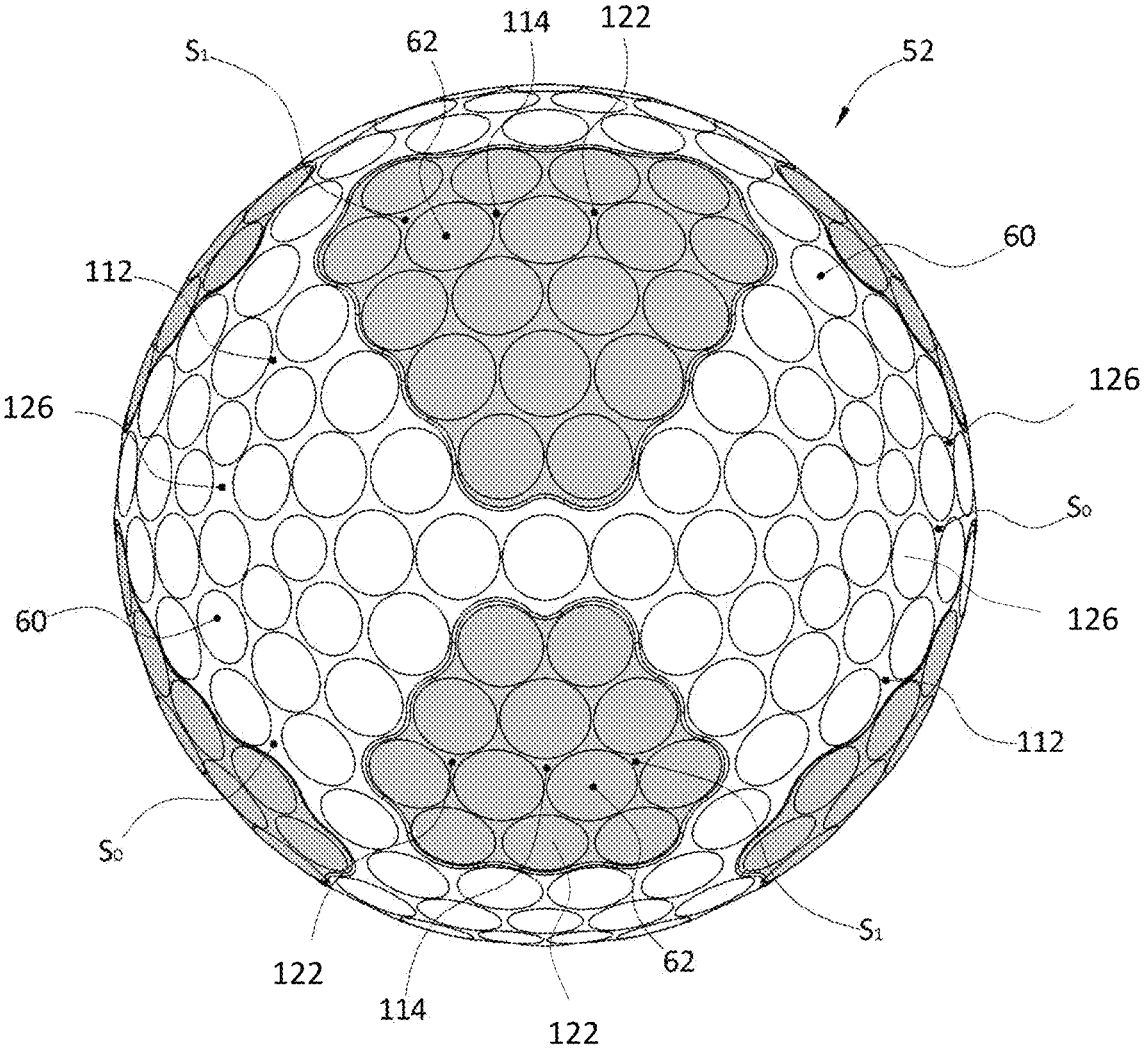
FIG. 45 illustrates another embodiment of the present invention where the exterior surface and subsurface have different colors according to the present invention.

In yet another embodiment as shown in FIG. 45, a mask is provided that covers the exterior surface dimples 60 and exterior surface frets 114 of the exterior surface $S_0$. The paint is then removed from the subsurfaces $S_i$. As is shown, the paint is removed from the first subsurface frets 114 and first subsurface dimples 62 of the first subsurface $S_1$. The resulting golf ball 52 has an exterior surface $S_0$ with a second color 126 on both the exterior surface dimples 60 and exterior surface frets 112 and a first subsurface $S_1$ having a first color 122 on both first subsurface frets 114 and first subsurface dimples 62. It will be appreciated that in either embodiment of FIGS. 44 and 45, both the first and second colors 122 and 126 may be layers of paint provided on the golf ball 52.

Figure 46:
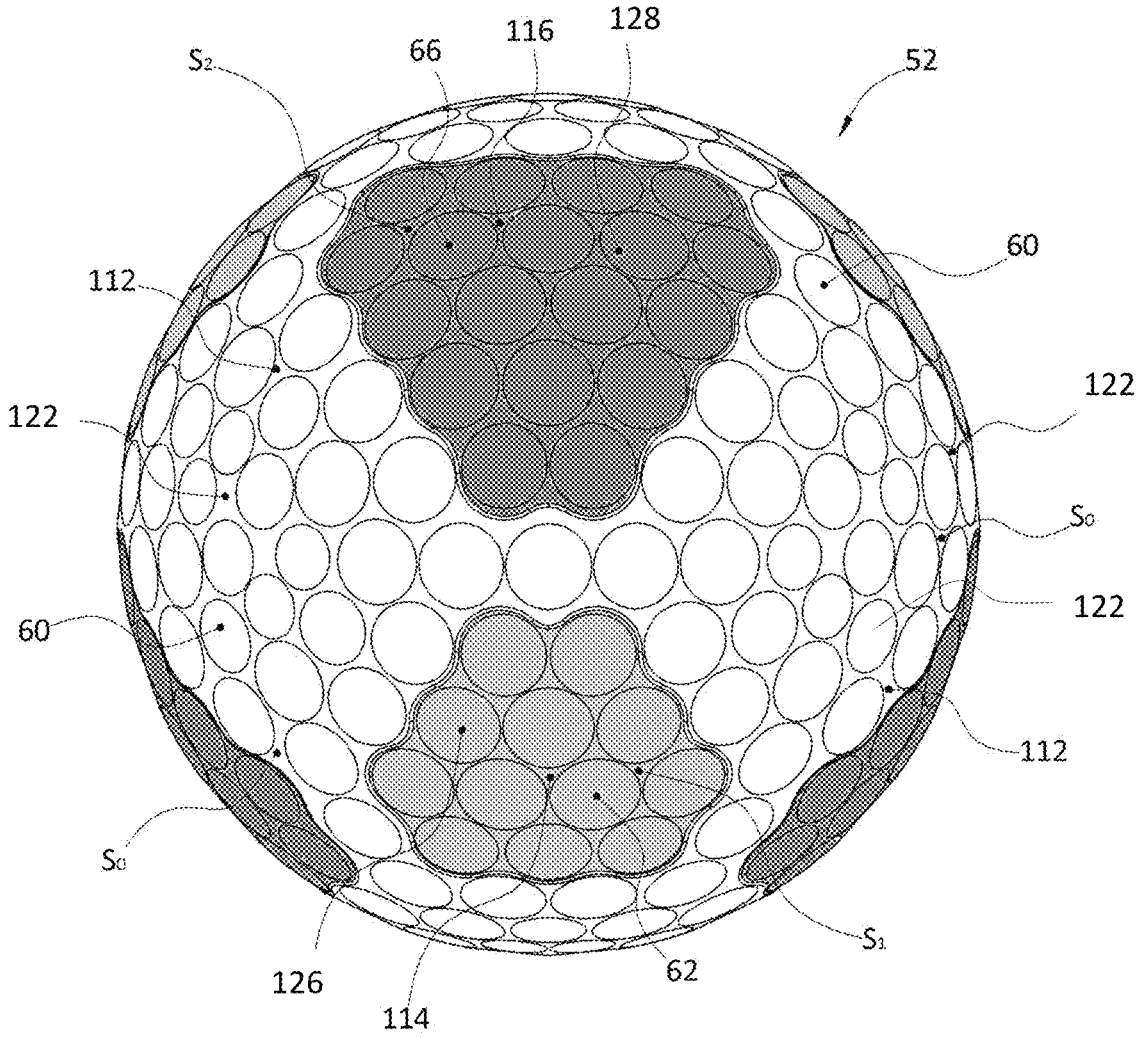
FIG. 46 illustrates another embodiment of the present invention where the exterior surface, first subsurface and second subsurface have different colors according to the present invention.

Now referring to FIG. 46, the exterior surface $S_0$ has a first color 122 provided on the exterior frets 112 and exterior surface dimples 60. The first subsurface $S_1$ has a second color 126 (shown with lighter shading) being provided on the first subsurface frets 114 and first subsurface dimples 62. A second subsurface $S_2$ is provided having a different third color 128 (shown with darker shading) provided on second subsurface frets 116 and second subsurface dimples 66. Preferably, the first color 122, second color 126 and third color 128 are each different from each other.

Figure 47:
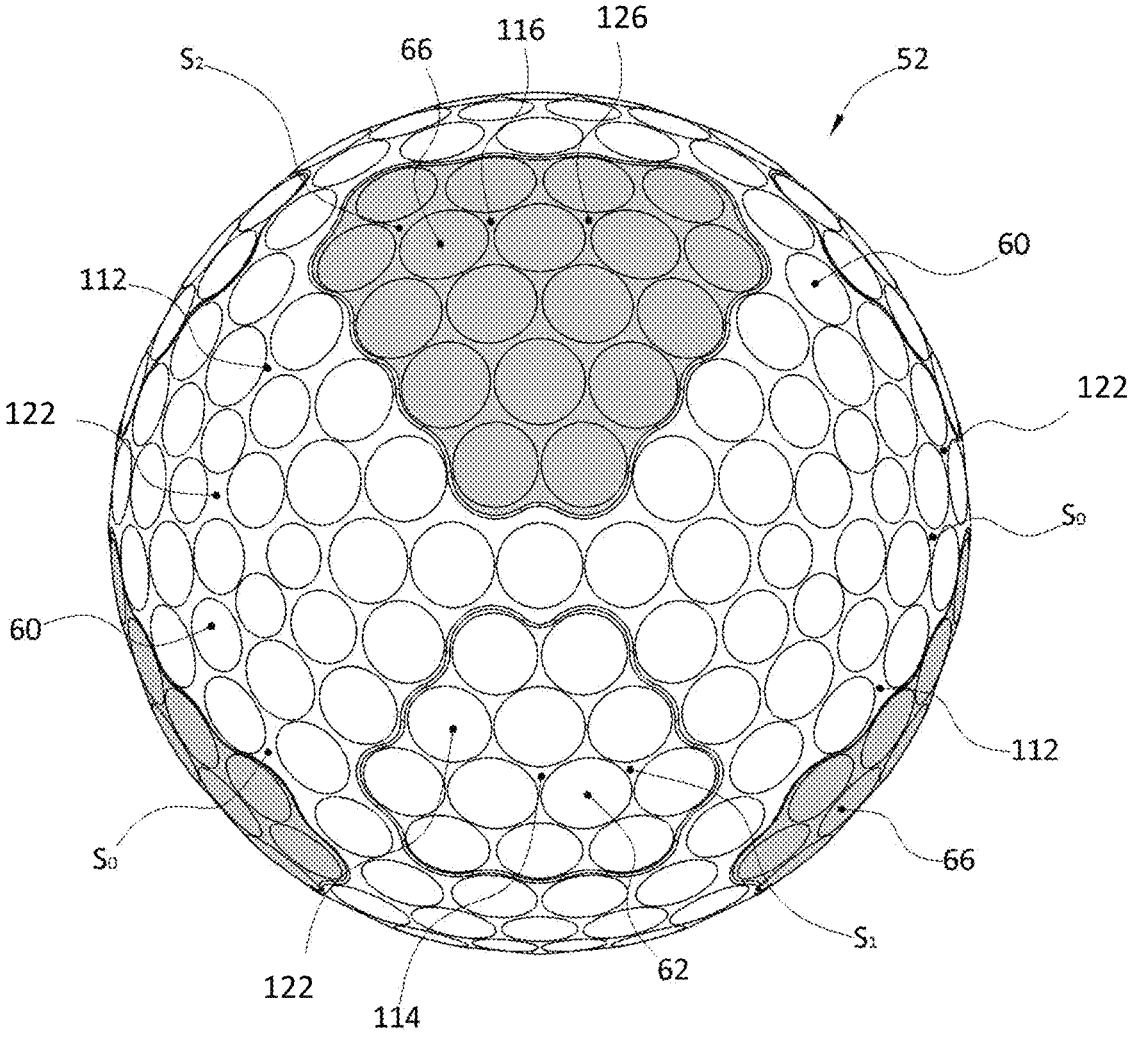
FIG. 47 illustrates another embodiment of the present invention where two of the exterior surface, first subsurface and second subsurface have the same color and the other has a different color according to the present invention.

In another embodiment, it will be appreciated that at least two of a first, second and third colors 122, 126, 128 are the same and the other surface color is different. For example, FIG. 47 illustrates the first color 122 provided on the exterior surface $S_0$, including the exterior surface frets 112 and exterior dimples 60, and on the first subsurface $S_1$, including the first subsurface frets 114 and first subsurface dimples 62. A second color 126 (shown with shading) is provided on the second subsurface $S_2$, including on the second subsurface frets 116 and second subsurface dimples 66. Preferably, as illustrated, the first color 122 is different than the second color 126.

It will be appreciated that different first, second, third and/or more colors of the present invention may be made in a number of different ways known to those of skill in the art. For example, different colors may be made using different colored covers and/or layers of the golf ball during molding. Alternatively or in combination, the different colors may be provided by using different color paints, primers, tints of paint, speckled paint, reflective paint or different paint sheen as is known in the art. It will be appreciated that the different colors may be provided as described in U.S. Pat. Nos. 8,915,802, 9,056,224 and 9,339,843 and in U.S. Publ. No. 2016/0158605, the entire disclosures of which are hereby incorporated herein by reference. Preferably, in the case where there are two different sheens, there is a difference of at least 40 gloss units as measured by ASTM method for 60° specular gloss (ASTM D523). In the case where there are two different colors, the colors preferably have a CMC l:c Delta-E value greater than or equal to 5 when the ratio l:c is equal to 2:1.

It will be appreciated that the dimples 60, 62, 66 may be arranged within the exterior surface $S_0$ and any subsurfaces $S_i$ in any suitable manner and preferably may be arranged as described in U.S. Pat. Nos. 9,440,115 and 9,504,877 and in U.S. Publ. No. 2016/0375312, the entire disclosures of which are hereby incorporated herein by reference.

It should be understood that manufacturing variances are to be taken into account when determining the number of different dimple diameters. The placement of the dimple in the overall pattern should also be taken into account. Specifically, dimples located in the same location within the multiple copies of the spherical section 50 that are tessellated to form the dimple pattern are assumed to be same diameter dimples, unless they have a difference in diameter of 0.005 inches or greater.

It will be appreciated that the golf ball 52 of the present invention may have any desired construction and be formed of any desired materials. The novel dimple patterns formed by the repeating spherical sections 50 of the present invention can be used with any type of golf ball with any playing characteristics. The present invention is not limited by any particular golf ball construction or any particular composition for forming the golf ball layers. For example, spherical sections 50 of the present invention can be used to form dimple patterns on one-piece, two-piece (i.e., a core and a cover), multi-layer (i.e., a core of one or more layers and a cover of one or more layers), and wound golf balls, having a variety of core structures, intermediate layers, covers, and coatings. The cores of solid balls are generally formed of a polybutadiene composition. These core materials may include organosulfur or antioxidants, and may be uniform in cross-sectional hardness or may have a gradient in hardness across the cross-section. Alternatively, one of more core layers may comprise a highly neutralized polymer (HNP). In addition to one-piece cores, solid cores can also contain a number of layers, such as in a dual core golf ball. Golf ball cover layers generally comprise ionomer resins, ionomer blends, non-ionomeric thermoplastics, HNP's, grafted or non-grafted metallocene catalyzed polyolefins, thermoplastic polyurethanes, thermoset polyureas or polyurethanes, castable or RIM polyureas or polyurethanes. The golf ball cover can consist of a single layer or include a plurality of layers and, optionally, at least one intermediate layer disposed about the core.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising:

a core;

a cover surrounding the core;

an exterior surface provided on the cover having an exterior radius $R_0$;

at least a first subsurface having a first perimeter and a subsurface radius $R_1$ and at least two subsurface dimples located solely within the first subsurface; and wherein the first subsurface is offset from the exterior surface by a value $\delta_1$ such that $R_1=R_0-\delta_1$ and $\delta_1$ is between about 0.009 and about 0.020 inches, wherein the first subsurface is spherical and concentric to the exterior surface, and wherein the exterior surface has a first surface color and the first subsurface has a second surface color different than the first surface color.

2. The golf ball of claim 1, wherein the exterior surface has exterior surface dimples and exterior surface frets between the exterior surface dimples and the first surface color is provided on the exterior surface frets.

3. The golf ball of claim 1, wherein the first subsurface has first subsurface frets between the first subsurface dimples and the second surface color is provided on the first subsurface frets.

4. The golf ball of claim 1, wherein the exterior surface has exterior surface dimples and the exterior surface dimples include the first surface color.

5. The golf ball of claim 1, wherein the first subsurface dimples on the first subsurface include the second surface color.

6. The golf ball of claim 1, wherein the exterior surface has exterior surface frets between exterior surface dimples and the first subsurface has first subsurface frets between the first subsurface dimples provided on the first subsurface, and the first color is provided on both the exterior surface frets and exterior surface dimples and the second surface color is provided on both the first subsurface frets and first subsurface dimples.

7. The golf ball of claim 1, wherein the exterior surface has a first surface texture and the first subsurface has a second surface texture different than the first surface texture.

8. The golf ball of claim 7, wherein one of the first or second surface texture comprises a substantially smooth surface, wherein a substantially smooth surface has an average surface roughness (Ra) of less than about 5 microns determined according to the relationship:

$$Ra = \frac{1}{L}\int_0^L |r(x)dx|$$

wherein Ra is the average roughness and L is the evaluation length.

9. The golf ball of claim 7, wherein one of the first and second surface texture is a substantially not smooth surface, wherein a substantially not smooth surface has an average surface roughness (Ra) of greater than about 5 microns determined according to the relationship:

$$Ra = \frac{1}{L}\int_0^L |r(x)dx|$$

wherein Ra is the average roughness and L is the evaluation length.

10. The golf ball of claim 1, wherein a second subsurface is provided having a second perimeter and a subsurface radius $R_2$ and at least two subsurface dimples located solely within the second subsurface, wherein the second subsurface is spherical and concentric to the exterior surface and $R_2$ is different than $R_1$ and $R_0$.

11. The golf ball of claim 10, wherein first and second subsurface frets are provided on each of the first and second subsurface between the subsurface dimples and at least one of the second and a third surface colors is provided on both the frets and subsurface dimples of only one of the first and second subsurface.

12. The golf ball of claim 10, wherein at least two of the first, second and third surface colors are the same.

13. The golf ball of claim 10, wherein at least one of the first, second or third surface colors are on at least one dimple.

* * * * *